US006870351B2

(12) United States Patent
Sugimura

(10) Patent No.: US 6,870,351 B2
(45) Date of Patent: Mar. 22, 2005

(54) VOLTAGE REGULATOR CIRCUIT AND INTEGRATED CIRCUIT DEVICE INCLUDING THE SAME

(75) Inventor: Naoaki Sugimura, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 7 days.

(21) Appl. No.: 10/401,742

(22) Filed: Mar. 31, 2003

(65) Prior Publication Data

US 2003/0193320 A1 Oct. 16, 2003

(30) Foreign Application Priority Data

Apr. 15, 2002 (JP) ..... 2002-111813

(51) Int. Cl.[7] ..... G05F 1/573; G05F 5/571
(52) U.S. Cl. ..... 323/277; 323/907
(58) Field of Search ..... 323/277, 276, 323/278, 907, 901

(56) References Cited

U.S. PATENT DOCUMENTS 5,635,823 A * 6/1997 Murakami et al. ..... 323/277
5,691,630 A * 11/1997 Chosa ..... 323/267
5,977,758 A * 11/1999 Noguchi et al. ..... 323/283
6,294,903 B1 * 9/2001 Yamashita et al. ..... 323/282
6,366,068 B1 * 4/2002 Morishita ..... 323/282
6,429,631 B2 * 8/2002 Inaba et al. ..... 323/277
6,465,993 B1 * 10/2002 Clarkin et al. ..... 323/272
6,469,481 B1 * 10/2002 Tateishi ..... 323/282
6,559,626 B2 * 5/2003 Horie ..... 323/282
6,677,738 B1 * 1/2004 Hesse ..... 323/284
6,686,728 B2 * 2/2004 Nakajima ..... 323/281

FOREIGN PATENT DOCUMENTS

JP 2001-306163 11/2001

* cited by examiner

*Primary Examiner*—Bao Q. Vu
(74) *Attorney, Agent, or Firm*—Volentine Francos & Whitt, PLLC

(57) ABSTRACT

A voltage regulator circuit includes an output stage circuit which operates either in a normal operation state in which a regulator output voltage stabilized in accordance with an input control voltage is supplied from a regulator output terminal to an external load circuit or in an overcurrent protection state in which a regulator output current supplied from the regulator output terminal to the external load circuit is limited up to a predetermined level. The voltage regulator circuit further includes a first control circuit which generates the control voltage in accordance with the regulator output voltage and outputs the control voltage to the output stage circuit, and a second control circuit which monitors a state of the output stage circuit and switches the output stage circuit between the normal operation state and the overcurrent protection state in accordance with the monitored state of the output stage circuit.

17 Claims, 29 Drawing Sheets

COMPARATIVE EXAMPLE

COMPARATIVE EXAMPLE 5
10
AMPLIFIER CIRCUIT
25
OVERCURRENT PROTECTIVE CIRCUIT
30
OUTPUT STAGE CIRCUIT
OUTPUT CURRENT MONITORING CIRCUIT
OUTPUT VOLTAGE MONITORING CIRCUIT
SWITCH CONTROL CIRCUIT
VDD
Vref1
VG
PD
PDN
PL
REGout
(Vout,Iout)
GND
V1
V2
V1a
COMP1
SNFF1
PDN2
SN
D
CK
Q
INV1
INV2
BUF254
SW201
SW202
SW203
SW232
NA201
NA202
NA203
AN241
251
252
253
311

VOLTAGE REGULATOR CIRCUIT AND INTEGRATED CIRCUIT DEVICE INCLUDING THE SAME

BACKGROUND OF THE INVENTION

The present invention relates to a voltage regulator circuit with functions of output short-circuit protection and output overcurrent protection and an integrated circuit device including the voltage regulator circuit.

FIG. 1 is a circuit diagram showing the structure of a conventional voltage regulator circuit, which is disclosed in Japanese Patent Kokai (Laid-open) Publication No. 2001–306163, for example. As shown in FIG. 1, the voltage regulator circuit includes an input terminal REGin for a reference voltage Vref1, an operational amplifier OP1, a regulator output terminal REGout, resistors R1, R2, and R3, and PNP transistors Q1 and Q2. The operational amplifier OP1 outputs a control voltage V2 depending on a difference between a feedback voltage V1 at a node nd1 between the resistors R1 and R2 and the reference voltage Vref1, to a node nd2 which is connected to the base of the PNP transistor Q1. The PNP transistor Q1 allows a current I1 depending on the control voltage V2 to flow, thereby stabilizing an output voltage Vout from the regulator output terminal REGout. If an abnormality in an external load circuit (not shown in FIG. 1) connected to the regulator output terminal REGout causes an overcurrent to flow from the regulator output terminal REGout, a voltage V3 at a node nd3 between the resistor R3 and the PNP transistor Q1 drops; the PNP transistor Q2 is turned on; the control voltage V2 of the node nd2 increases to a high level close to the power supply voltage VDD; the PNP transistor Q1 is turned off; and the regulator output voltage Vout from the regulator output terminal REGout decreases to a low level close to the ground voltage VG at the ground GND.

The above-mentioned conventional voltage regulator circuit, however, stops monitoring the status of the external load circuit connected to the regulator output terminal REGout after it detects an output overcurrent and turns off the PNP transistor Q1, that is, after it enters the overcurrent protection state. Accordingly, even if the external load circuit recovers to the normal state, the voltage regulator circuit does not automatically return from the overcurrent protection state to the normal operation state, thereby maintaining the overcurrent protection state until a reset operation is made.

SUMMARY OF THE INVENTION

It is an object of the present invention to provide a voltage regulator circuit which can automatically return from the overcurrent protection state to the normal operation state so that the stabilized voltage output is automatically restarted when an external load circuit recovers to the normal state, and to provide an integrated circuit device including the voltage regulator circuit.

A voltage regulator circuit according to the present invention includes an output stage circuit which operates either in a normal operation state in which a regulator output voltage stabilized in accordance with an input control voltage is supplied from a regulator output terminal to an external load circuit or in an overcurrent protection state in which a regulator output current supplied from the regulator output terminal to the external load circuit is limited up to a predetermined level. The voltage regulator circuit further includes a first control circuit which generates the control voltage in accordance with the regulator output voltage and outputs the control voltage to the output stage circuit, and a second control circuit which monitors a state of the output stage circuit and switches the output stage circuit between the normal operation state and the overcurrent protection state in accordance with the monitored state of the output stage circuit.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 2A and FIG. 2B are block diagrams schematically showing the structure of a voltage regulator circuit according to a first embodiment of the present invention, wherein FIG. 2A illustrates the normal operation state and FIG. 2B illustrates the overcurrent protection state;

FIG. 8A and FIG. 8B are block diagrams schematically showing the structure of a voltage regulator circuit according to a second embodiment of the present invention, wherein FIG. 8A illustrates the normal operation state and FIG. 8B illustrates the overcurrent protection state;

FIG. 12A and FIG. 12B are block diagrams schematically showing the structure of a voltage regulator circuit according to a third embodiment of the present invention, wherein FIG. 12A illustrates the normal operation state and FIG. 12B illustrates the overcurrent protection state;

FIG. 16A and FIG. 16B are block diagrams schematically showing the structure of a voltage regulator circuit according to a fourth embodiment of the present invention, wherein FIG. 16A illustrates the normal operation state and FIG. 16B illustrates the overcurrent protection state;

FIG. 21A and FIG. 21B are block diagrams schematically showing the structure of a voltage regulator circuit according to a fifth embodiment of the present invention, wherein FIG. 21A illustrates the normal operation state and FIG. 21B illustrates the overcurrent protection state;

FIG. 26A and FIG. 26B are block diagrams schematically showing the structure of a voltage regulator circuit according to a sixth embodiment of the present invention, wherein FIG. 26A illustrates the normal operation state and FIG. 26B illustrates the overcurrent protection state;

DETAILED DESCRIPTION OF PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

First Embodiment

Figure 1:
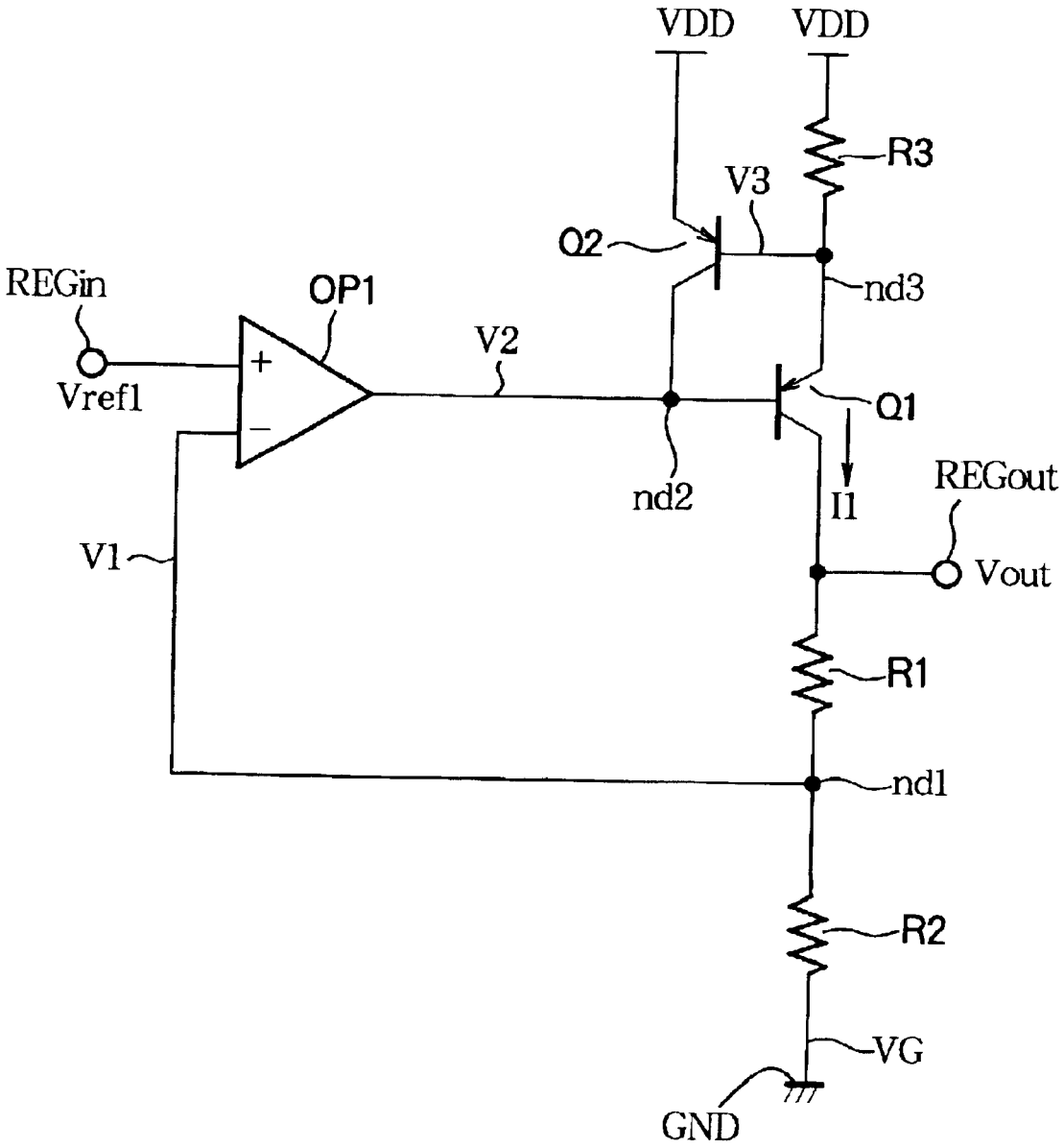
FIG. 1 PRIOR ART
FIG. 1 is a circuit diagram showing the structure of a conventional voltage regulator circuit.
Figure 2A:
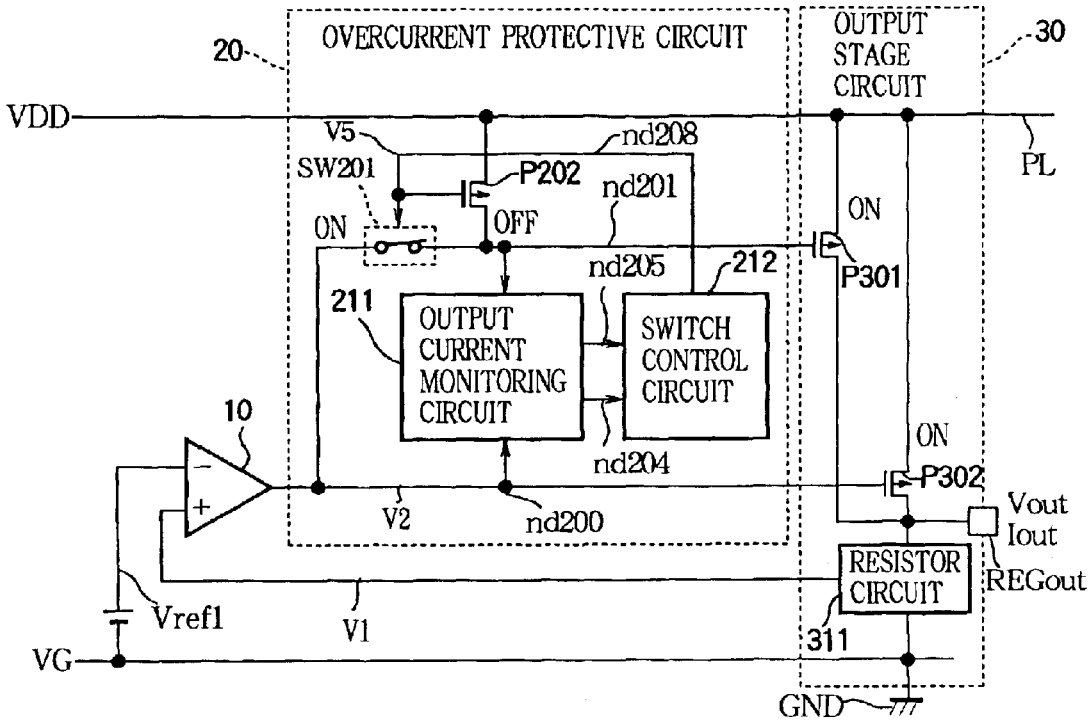
Figure 2B:
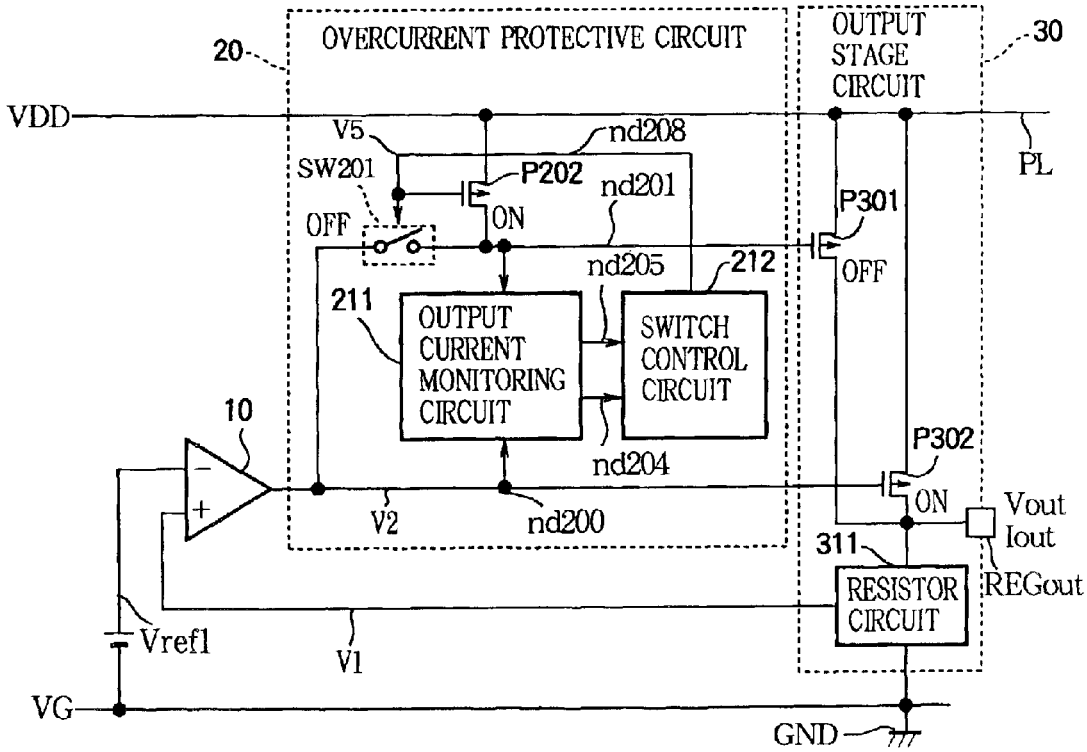

FIG. 2A and FIG. 2B are block diagrams schematically showing the structure of the voltage regulator circuit according to the first embodiment of the present invention. FIG. 2A shows the voltage regulator circuit in the normal operation state, in which a stabilized regulator output voltage Vout is supplied to an external load circuit. FIG. 2B shows the voltage regulator circuit in the overcurrent protection state, in which the regulator output current Iout is limited. As shown in FIG. 2A and FIG. 2B, the voltage regulator circuit according to the first embodiment mainly includes an amplifier circuit 10, an overcurrent protective circuit (or a short-circuit protective circuit) 20, and an output stage circuit 30.

As shown in FIG. 2A, the amplifier circuit 10 receives a constant reference voltage Vref1 and a feedback voltage V1 depending on a regulator output voltage Vout (that is, a voltage divided by a resistor circuit 311, which will be describe later). The amplifier circuit 10 outputs a control voltage V2 determined in accordance with a difference between the reference voltage Vref1 and the feedback voltage V1, to an output node nd200, thereby bringing the feedback voltage V1 closer to the reference voltage Vref1 to stabilize the regulator output voltage Vout.

As shown in FIG. 2A, the output stage circuit 30 is connected to the power line PL and the ground GND. The output stage circuit 30 includes a first switch circuit (a first P-channel transistor (MOSFET) P301, for instance) coupled between the power line PL and the regulator output terminal REGout and a second switch circuit (a second P-channel transistor (MOSFET) P302, for instance) coupled between the power line PL and the regulator output terminal REGout. The output stage circuit 30 also includes a resistor circuit 311 which is connected between the regulator output terminal REGout and the ground GND and generates the feedback voltage V1 determined in accordance with the regulator output voltage Vout.

As shown in FIG. 2A and FIG. 2B, the overcurrent protective circuit 20 includes a switch (a MOS transfer gate switch SW201, for instance) which makes or breaks a connection between the output node nd200 of the amplifier circuit 10 and a gate (that is, a node nd201) of the first P-channel transistor P301, and another switch (a P-channel transistor P202, for instance) which breaks or makes a connection between the power line PL and the gate of the first P-channel transistor P301. The overcurrent protective circuit 20 also includes an output current monitoring circuit 211 and a switch control circuit 212. The output current monitoring circuit 211 monitors a regulator output current Iout, which substantially equals to Ids (P301)+Ids (P302), by monitoring the source-drain current Ids (P301) passing through the first P-channel transistor P301 and the source-drain current Ids (P302) passing through the second P-channel transistor P302. The switch control circuit 212 controls the switch SW201 and the P-channel transistor P202 in accordance with the regulator output current Iout monitored by the output current monitoring circuit 211.

An outline of the operation of the voltage regulator circuit according to the first embodiment will now be described. In the normal operation state as illustrated in FIG. 2A, the control voltage V5 output from the switch control circuit 212 to a node nd208 turns on the switch SW201 and turns off the P-channel transistor P202. In the meantime, the first P-channel transistor P301 and second P-channel transistor P302 in the output stage circuit 30 are controlled by the control voltage V2 output from the amplifier circuit 10 to the node nd200; the regulator output current Iout supplied via either the first P-channel transistor P301 or second P-channel transistor P302 is output from the regulator output terminal REGout to the external load circuit (not shown in FIG. 2A and FIG. 2B); and the regulator output voltage Vout is maintained at a stable level.

If the output current monitoring circuit 211 detects that the regulator output current Iout exceeds a predetermined first current threshold level Ith1 (shown in FIG. 4), the overcurrent protective circuit 20 causes the output stage circuit 30 to switch from the normal operation state illustrated in FIG. 2A to the overcurrent protection state illustrated in FIG. 2B. When the switch to the overcurrent protection state illustrated in FIG. 2B is made, the switch control circuit 212 brings the control voltage V5 of the node nd208 to a low (L) level; the switch SW201 is turned off; and the P-channel transistor P202 is turned on. Then, the voltage at the gate (that is, the node nd201) of the first P-channel transistor P301 in the output stage circuit 30 is pulled up to a high (H) level close to the power supply voltage VDD of the power line PL; the first P-channel transistor P301 is turned off; and the current Ids (P302) flowing through the second P-channel transistor P302 is supplied to the external load circuit as the regulator output current Iout. Therefore, a current not larger than the maximum permissible current (the current Ipr in FIG. 4) determined by the current output characteristics of the second P-channel transistor P302 in the overcurrent protection state becomes the regulator output current Iout, and an overcurrent will not flow from the regulator output terminal REGout to the external load circuit.

If the output current monitoring circuit 211 detects that the regulator output current Iout falls below the second current threshold level Ith2 (shown in FIG. 4), the overcurrent protective circuit 20 causes the output stage circuit 30 to return from the overcurrent protection state shown in FIG. 2B to the normal operation state shown in FIG. 2A. When the switch to the normal operation state shown in FIG. 2A is made, the switch control circuit 212 brings the control voltage V5 at the node nd208 to a high level. Therefore, the switch SW201 is turned on and the P-channel transistor P202 is turned off. Then, both the first P-channel transistor P301 and second P-channel transistor P302 of the output stage circuit 30 are controlled by the control voltage V2 output from the amplifier circuit 10 to the node nd200; the regulator output current Iout is supplied to the external load circuit through either the first P-channel transistor P301 or second P-channel transistor P302. Thus, the regulator output voltage Vout is maintained at a stable level.

Figure 3:
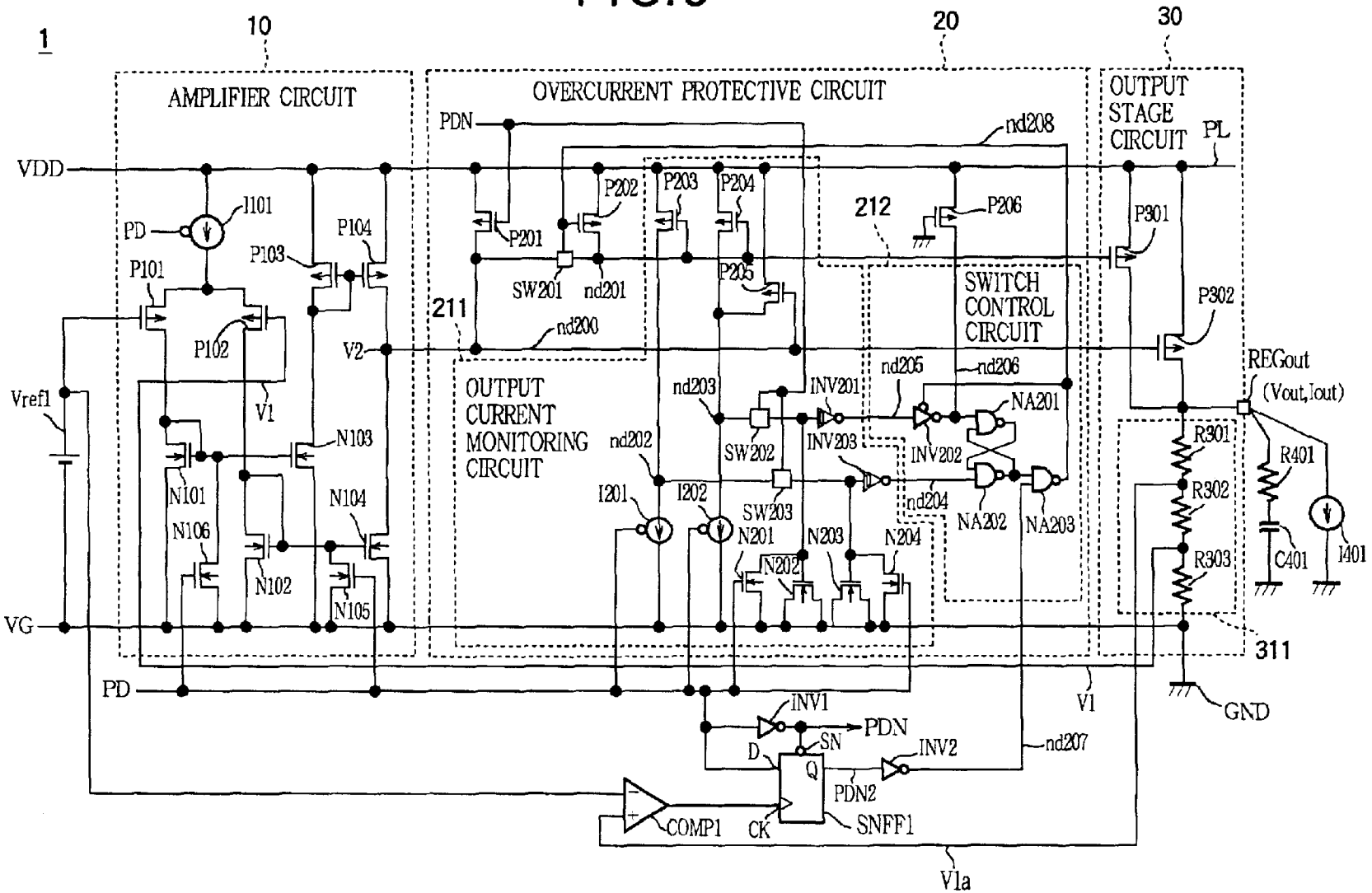
FIG. 3 is a circuit diagram showing the detailed structure of the voltage regulator circuit according to the first embodiment.
Figure 4:
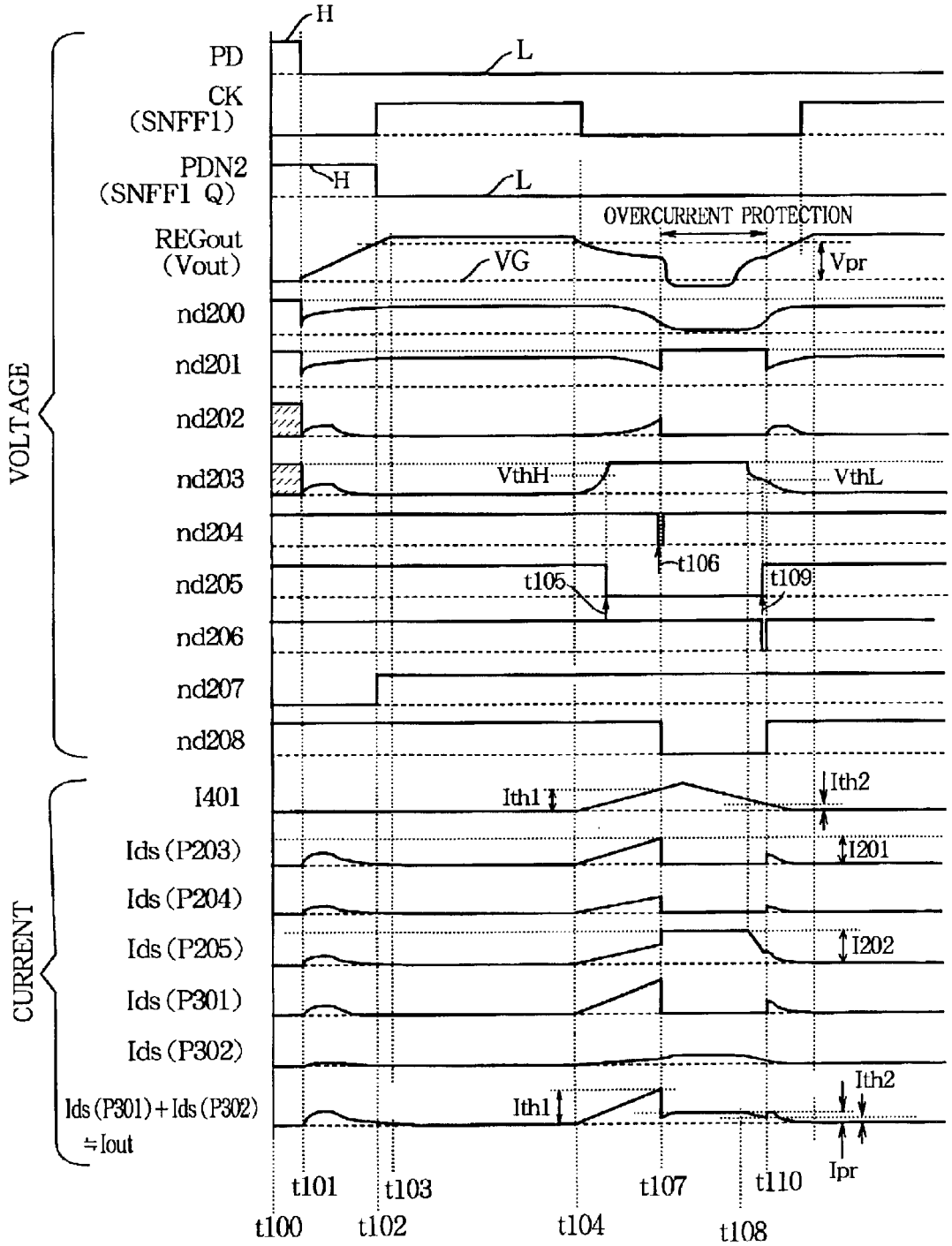
FIG. 4 is a timing chart illustrating the operation of the voltage regulator circuit according to the first embodiment.

Next, the voltage regulator circuit according to the first embodiment will now be described in detail. FIG. 3 is a circuit diagram showing the detailed structure of the voltage regulator circuit according to the first embodiment. FIG. 4 is a timing chart illustrating the operation of the voltage regulator circuit according to the first embodiment. The voltage regulator circuit according to the first embodiment can be manufactured as a semiconductor integrated circuit device 1.

As shown in FIG. 3, the amplifier circuit 10 includes a constant current source I101 connected to the power line PL, P-channel transistors P101 and P102 with their sources coupled to the constant current source I101, an N-channel transistor N101 coupled between the drain of the P-channel transistor P101 and the ground GND, and an N-channel transistor N102 coupled between the drain of the P-channel transistor P102 and the ground GND. A constant (or adjustable) reference voltage Vref1 is applied to the gate of the P-channel transistor P101, and the feedback voltage V1 output from the resistor circuit 311 of the output stage circuit 30 is applied to the gate of the P-channel transistor P102. The amplifier circuit 10 includes N-channel transistors N101, N103, N102, and N104, a P-channel transistor P103 coupled between the power line PL and the N-channel transistor N103, and a P-channel transistor P104 coupled between the power line PL and the N-channel transistor N104. The N-channel transistors N101 and N103 form a current mirror circuit; the N-channel transistors N102 and N104 form another current mirror circuit; and the P-channel transistors P103 and P104 form a further current mirror circuit. In the normal operation state, the amplifier circuit 10 controls the control voltage V2 at the output node nd200, which is the gate voltage of the first P-channel transistor P301 and second P-channel transistor P302, in such a way that the feedback voltage V1 output from the resistor circuit 311 matches the reference voltage Vref1 (that is, the current flowing through the P-channel transistor P103 equals the current flowing through the P-channel transistor P104, and the current flowing through the P-channel transistor P101 equals the current flowing through the P-channel transistor P102).

The amplifier circuit 10 also includes an N-channel transistor N105 coupled between the ground GND and the gates of the N-channel transistors N102 and N104, and an N-channel transistor N106 coupled between the ground GND and the gates of the N-channel transistors N101 and N103. The gate of the N-channel transistor N105 and the gate of the N-channel transistor N106 receive a power-down signal PD. While the voltage regulator circuit is in the power-down state, the power-down signal PD is kept high; the N-channel transistors N105 and N106 are held on; the N-channel transistors N101, N103, N102, and N104 are held off; and the amplifier circuit 10 remains in its deactivated state. An example of this state is a period from time t100 to time t101 shown in FIG. 4. While the voltage regulator circuit is in the non-power-down state, the power-down signal PD is kept low; the N-channel transistors N105 and N106 are held off; the N-channel transistors N101, N103, N102, and N104 are held on; and the amplifier circuit 10 remains in its activated state. An example of the activated state is a period after time t101 shown in FIG. 4.

As shown in FIG. 3, the overcurrent protective circuit 20 includes a MOS transfer gate switch SW201 and a P-channel transistor P202. The MOS transfer gate switch SW201 makes or breaks a connection between the output node nd200 of the amplifier circuit 10 and the gate (that is, the node nd201) of the first P-channel transistor P301. The P-channel transistor P202 breaks or makes a connection between the power line PL and the gate (that is, the node nd201) of the first P-channel transistor P301. The overcurrent protective circuit 20 also includes an output current monitoring circuit 211 and a switch control circuit 212. The output current monitoring circuit 211 monitors the current Ids (P301) flowing through the first P-channel transistor P301 and the current Ids (P302) flowing through the second P-channel transistor P302, thereby monitoring the regulator output current Iout, which substantially equals to Ids (P301)+Ids (P302). The switch control circuit 212 controls the switch SW201 and the P-channel transistor P202 in accordance with the regulator output current Iout monitored by the output current monitoring circuit 211. The overcurrent protective circuit 20 further includes a P-channel transistor P201 coupled between the node nd200 to which the control voltage V2 output from the amplifier circuit 10 is applied and the power line PL. The gate of the P-channel transistor P201 receives the inverted power-down signal PDN output from the inverter INV1. While the voltage regulator circuit is in the power-down state, the inverted power-down signal PDN is kept low; the P-channel transistor P201 is held on; the voltages at the nodes nd200 and nd201 are pulled up to the power supply voltage VDD; the first P-channel transistor P301 and second P-channel transistor P302 in the output stage circuit 30 are held off; and the output stage circuit 30 remains in its deactivated state. While the voltage regulator circuit is in the non-power-down state, the inverted power-down signal PDN is kept high; the P-channel transistor P201 is held off; the voltage at the nodes nd200 and nd201 matches the control voltage V2 output from the amplifier circuit 10; the first P-channel transistor P301 and second P-channel transistor P302 in the output stage circuit 30 are held on; and the output stage circuit 30 remains in its activated state.

The output current monitoring circuit 211 includes P-channel transistors P203, P204, and P205. The sources of the P-channel transistors P203, P204, and P205 are coupled to the power line PL, and the power supply voltage VDD is applied to them. The gates of the P-channel transistors P203 and P204 are coupled to the gate (that is, the node nd201) of the first P-channel transistor P301. The gate of the P-channel transistor P205 is coupled to the gate of the second P-channel transistor P302 (that is, the node nd200). The drains of the P-channel transistors P204 and P205 are coupled to the output node nd203 of the constant current source I202. The drain of the P-channel transistor P203 is coupled to the output node nd202 of the constant current source I201. The node nd202 is connected to an end of the MOS transfer gate switch SW203, and the node nd203 is connected to an end of the MOS transfer gate switch SW202. The other end of the switch SW203 is connected to the input terminal of a Schmitt inverter INV203, and the other end of the switch SW202 is connected to the input terminal of a Schmitt inverter INV201. An N-channel transistor N201 is connected between the ground GND and the connection node between the switch SW202 and the inverter INV201, and pulls down the voltage at the input terminal of the inverter INV201 to the ground voltage VG in the power-down state (while the power-down signal PD is kept high). The gate of an N-channel transistor N202 with its drain and source coupled to the ground GND is connected to the connection node between the switch SW202 and the inverter INV201, and the N-channel transistor N202 and switch SW202 form a low-pass filter in the non-power-down state (while the power-down signal PD is kept low). An N-channel transistor N204 is connected between the ground GND and the connection node between the switch SW203 and the inverter INV203, and pulls down the input of the inverter INV203 to the ground voltage VG in the power-down state (while the power-down signal PD is kept high). The gate of an N-channel transistor N203 with its drain and source coupled to the ground GND is connected to the connection node between the switch SW203 and the inverter INV203, and the N-channel transistor N203 and the switch SW203 form a low-pass filter in the non-power-down state (while the power-down signal PD is kept low). The control voltage of the output current monitoring circuit 211 is output to the output node nd205 of the inverter INV201 and the output node nd204 of the inverter INV203.

The switch control circuit 212 includes a 3-state inverter INV202 with an enable terminal and a set-reset circuit formed by NAND gates NA201 and NA202. An input terminal of the 3-state inverter INV202 is connected to the node nd205, and an input terminal of the NAND gate NA202 is connected to the node nd204. The switch control circuit 212 also includes a NAND gate NA203, which receives the output voltage of the set-reset circuit and the voltage at the node nd207, which will be described later, and outputs the control voltage V5 to the output node nd208. The NAND gate NA203 keeps the overcurrent protective circuit 20 from starting its operation until the regulator output voltage Vout reaches a predetermined level (a period before time t102 shown in FIG. 4) while the voltage regulator circuit is in the non-power-down state.

The output node nd206 of the 3-state inverter INV202 is coupled to an input terminal of the NAND gate NA201. A P-channel transistor P206 with its gate coupled to the ground GND is provided between the node nd206 and the power line PL. The P-channel transistor P206 pulls up the node nd206 with a high resistance while the 3-state inverter INV202 is in the high-impedance (HiZ) output state. The output node nd208 of the switch control circuit 212 is coupled to the active-low enable terminal of the 3-state inverter INV202 in the switch control circuit 212, the control terminal of the switch SW201, and the gate of the P-channel transistor P202.

The output stage circuit 30 includes a first P-channel transistor P301, a second P-channel transistor P302, and resistors R301, R302, and R303 for dividing the regulator output voltage Vout to generate the feedback voltage V1, providing negative feedback to the positive input of the amplifier circuit 10, and generating a voltage V1*a* to the positive input of a comparator COMP1 which detects that the regulator output voltage Vout reaches a predetermined level. The first P-channel transistor P301 has a gate coupled to the output node nd201 of the overcurrent protective circuit 20, a source coupled to the power line PL, and a drain coupled to the regulator output terminal REGout. The second P-channel transistor P302 has a gate coupled to the output node nd200 of the amplifier circuit 10, a source coupled to the power line PL, and a drain coupled to the regulator output terminal REGout. The resistors R301, R302, and R303 forming the resistor circuit 311 are connected in series, between the regulator output terminal REGout and the ground GND.

The operation of the voltage regulator circuit according to the first embodiment will next be described in detail, with reference to FIG. 3 and FIG. 4. In the power-down state between time t100 and time t101 shown in FIG. 4, the power-down signal PD is kept high; the voltage regulator circuit is in the power-down state; the voltage regulator circuit is halted; and the regulator output terminal REGout is set to the ground voltage VG. In the meantime, the terminal SN of the synchronous flip-flop circuit SNFF1 receives the inverted power-down signal PDN (a low level signal) from the inverter INV1. Accordingly, the signal PDN2 output from the output terminal Q of the flip-flop circuit SNFF1 is at a high level. The input node nd207 of the NAND gate NA203 receives a low level signal inverted by the inverter INV2, and the output node nd208 of the switch control circuit 212 outputs a high level signal.

When the power-down signal PD is brought to a low level at time t101 shown in FIG. 4, the voltage regulator circuit enters the non-power-down state, and the regulator output voltage Vout from the regulator output terminal REGout starts increasing. The inverted power-down signal PDN input to the terminal SN of the flip-flop circuit SNFF1 goes high at time t101; the flip-flop circuit SNFF1 is reset; and the power-down signal PD input to the input terminal D goes low. Because no clock is supplied to the terminal CK, the output signal PDN2 of the flip-flop circuit SNFF1 is kept high. In the meantime, in the overcurrent protective circuit 20, the node nd207 is low; the node nd208 is high; the switch SW201 is turned on; and the P-channel transistor P202 is turned off. Accordingly, the output node nd200 of the amplifier circuit 10 and the output node nd201 of the overcurrent protective circuit 20 are at the same voltage.

When the voltage regulator circuit starts operating, the rise in the regulator output voltage Vout from the regulator output terminal REGout can be sped up by allowing a large current to flow through either the first P-channel transistor P301 or second P-channel transistor P302 in the output stage circuit 30 (that is, disabling overcurrent protection) for a very short period. To enable this, the overcurrent protective circuit 20 is disabled during a period from time t101 to time t102 shown in FIG. 4, by bringing the node nd207 to a low level and keeping the output node nd208 of the switch control circuit 212 high.

When the regulator output voltage Vout from the regulator output terminal REGout exceeds a predetermined level Vpr, where Vpr=((R301+R302+R303)/(R302+R303))*Vref1 (at time t102 shown in FIG. 4), the output of the comparator COMP1 goes from high to low; a low-to-high clock is supplied to the terminal CK of the flip-flop circuit SNFF1; the output signal PDN2 of the flip-flop circuit SNFF1 goes from high to low; and the voltage at the node nd207 goes from low to high. Accordingly, the overcurrent protective circuit 20 starts monitoring the operation of the output stage circuit 30 at time t102, as shown in FIG. 4.

If an external load circuit (including a resistor R401, a capacitor C401, and a current source I401, for instance) is connected to the regulator output terminal REGout, a regulator output current Iout supplied via either the first P-channel transistor P301 or second P-channel transistor P302 in the output stage circuit 30 is output from the regulator output terminal REGout. Then, the regulator output voltage Vout, which varies depending on the output voltage—output current characteristics (VI characteristics) of the voltage regulator circuit, decreases as the regulator output current Iout increases.

A current Ids (P203) proportional to the dimension ratio (that is, current output capability ratio) between the P-channel transistor P203 and the first P-channel transistor P301 flows through the P-channel transistor P203 in the output current monitoring circuit 211. The gate of the P-channel transistor P203 is coupled to the gate of the first P-channel transistor P301 in the output stage circuit 30 (that is, the node nd201). A current Ids (P204) proportional to the dimension ratio between the P-channel transistors P204 and the first P-channel transistor P301 flows through the P-channel transistor P204 in the output current monitoring circuit 211. The gate of the P-channel transistor P204 is coupled to the gate of the first P-channel transistor P301 in the output stage circuit 30 (that is, the node nd201). A current Ids(P205) proportional to the dimension ratio between the P-channel transistors P205 and the second P-channel transistor P302 flows through the P-channel transistor P205 in the output current monitoring circuit 211. The gate of the P-channel transistor P205 is coupled to the gate of the second P-channel transistor P302 in the output stage circuit 30 (that is, the node nd200).

If the regulator output current Iout from the regulator output terminal REGout increases after time t104 shown in FIG. 4, the currents Ids (P203), Ids (P204), and Ids (P205) also increase in proportional to the regulator output current Iout. Then, the voltages at the node nd202 between the drain of the P-channel transistor P203 and the constant current source I201 and at the node nd203 between the drains of the P-channel transistors P204 and P205 and the constant current source I202 rise from the level of the ground voltage VG. If the regulator output current Iout from the regulator output terminal REGout increases further, causing the voltage at the node nd203 to exceed the higher threshold level VthH of the inverter INV201 (at time t105), the output node nd205 of the inverter INV201 goes from high to low after a delay caused by the low-pass filter including the switch SW202 and N-channel transistor N202. If the voltage at the node nd202 exceeds the higher threshold level of the inverter INV203, the output node nd204 of the inverter INV203 goes from high to low after a delay caused by the low-pass filter including the switch SW203 and N-channel transistor N203 (at time t106).

Before the output node nd205 of the output current monitoring circuit 211 goes from high to low (at time t105) the set-reset circuit including the NAND gates NA201 and NA202 in the switch control circuit 212 is in such a state that the node nd208 is brought to a high level. The active-low enable terminal of the 3-state inverter INV202 is high; the 3-state inverter INV202 is in the high-impedance (HiZ) output state; and the node nd206 is pulled up to the level of the power supply voltage VDD by the P-channel transistor P206. This can be understood because the following contradiction would arise if the node nd208 were low: the active-low enable terminal of the 3-state inverter INV202 would be low; the 3-state inverter INV202 would become active; the node nd206 would go low; the output of the NAND gate NA201 would go high; the two inputs of the NAND gate NA202 would go high; the output of the NAND gate NA202 would go low; and the output of the NAND gate NA203 (that is, the node nd208) would go high. Therefore, when the output node nd205 of the output current monitoring circuit 211 goes from high to low (at time t105), the output of the NAND gate NA202, which is an input of the NAND gate NA201, is low, and the output of the NAND gate NA201, which is another input of the NAND gate NA202, is high. Even if the node nd205 goes low in this state, the set-reset circuit including the NAND gates NA201 and NA202 in the switch control circuit 212 does not change its state.

When the output node nd204 of the output current monitoring circuit 211 goes from high to low in this state (at time t106), the set-reset circuit including the NAND gates NA201 and NA202 in the switch control circuit 212 operates, bringing the output node nd208 of the switch control circuit 212 to a low level (at time t107), turning off the switch SW201, turning on the P-channel transistor P202, thereby pulling up the output node nd201 of the overcurrent protective circuit 20 to the level of the power supply voltage VDD. When the node nd201 reaches the level of the power supply voltage VDD, the first P-channel transistor P301 in the output stage circuit 30 is turned off. At this time, the current Ids (P302) passing through the second P-channel transistor P302 becomes the regulator output current Iout. The value of the regulator output current Iout is limited in accordance with the current output capability of the second P-channel transistor P302, and the regulator output voltage Vout of the regulator output terminal REGout decreases (after time t107 in FIG. 4). The decrease in the regulator output voltage Vout from the regulator output terminal REGout decreases the positive input level (feedback voltage V1) of the amplifier circuit 10, decreasing the voltage at the output node nd200 of the amplifier circuit 10 to a level close to the ground voltage VG. Accordingly, while the overcurrent protective circuit 20 is performing overcurrent protection, the regulator output current Iout is limited in accordance with the current output capability of the second P-channel transistor P302 in the output stage circuit 30, of which gate voltage has become close to the ground voltage VG.

On the other hand, the output node nd201 of the overcurrent protective circuit 20 is pulled up to the level of the power supply voltage VDD, and the first P-channel transistor P301 in the output stage circuit 30 is turned off. At the same time, the P-channel transistor P203 with its gate coupled to the node nd201 in the output current monitoring circuit 211 is turned off; the current Ids (P203) becomes zero; the voltage at the node nd202 matches the ground voltage VG; and the node nd204 goes high. The P-channel transistor P204 with its gate coupled to the node nd201 also is turned off, and the current Ids (P204) becomes zero. Because the voltage at the node nd200 decreases down to the ground voltage VG, the current Ids (P205) passing the P-channel transistor P205 increases. Accordingly, the voltage at the node nd203 exceeds the lower threshold level VthL of the 3-state inverter INV201, and the node nd205 is kept low.

The output node nd208 of the switch control circuit 212 brings the active-low enable terminal of the 3-state inverter INV202 in the switch control circuit 212 to a low level, thereby enabling the inverter INV202. However, because the node nd205 is low, the node nd206 is kept high.

If the regulator output current Iout from the regulator output terminal REGout in the overcurrent protection state falls below the current output capability (the current Ipr shown in FIG. 4, for instance) of the second P-channel transistor P302 in the output stage circuit 30, that is, the current output capability of the second P-channel transistor P302 while the gate voltage of the second P-channel transistor P302 is kept higher than the ground voltage VG (at time t108), the regulator output voltage Vout from the regulator output terminal REGout increases, decreasing the current Ids (P205) passing through the P-channel transistor P205. This causes the voltage at the node nd203 to decrease. When the voltage at the node nd203 falls below the lower threshold level VthL of the inverter INV201, the voltage at the node nd205 goes from low to high (at time t109). The output of the NAND gate NA201 in the switch control circuit 212 is brought to a high level to activate the set-reset circuit including the NAND gates NA201 and NA202. Then, the voltage at the output node nd208 of the switch control circuit 212 goes high again (at time t110); the sum of the currents passing through the first P-channel transistor P301 and the second P-channel transistor P302 becomes the regulator output current Iout from the regulator output terminal REGout; and the voltage regulator circuit returns to its normal operation state.

The regulator output current Iout which turns off the first P-channel transistor P301 is determined by the constant current value of the constant current source I201 and the dimension ratio between the P-channel transistor P203 and the first P-channel transistor P301. The regulator output current Iout which turns on the first P-channel transistor P301 is determined by the constant current value of the constant current source I201 and the dimension ratio between the P-channel transistor P205 and the second P-channel transistor P302. The regulator output current Iout which turns off the first P-channel transistor P301 in the overcurrent protection state is determined by the power supply voltage VDD of the power line PL and the current output capability of the second P-channel transistor P302 in the output stage circuit 30.

As has been described above, the voltage regulator circuit according to the first embodiment performs overcurrent protection to limit the regulator output current Iout below the predetermined current level Ipr, so that the voltage regulator circuit can be protected from an overload or short-circuit.

If the external load circuit returns to the normal state during the overcurrent protection state of the voltage regulator circuit, the voltage regulator circuit according to the first embodiment can automatically restart the stabilized voltage output. Accordingly, an instantaneous surge in the regulator output current Iout or an instantaneous drop of the regulator output voltage Vout due to disturbance may enable the overcurrent protection function, but the normal operation state, in which a stabilized voltage is output from the regulator output terminal REGout, can be automatically restored. This eliminates the need for carrying out a reset operation to bring the whole voltage regulator circuit into the power-down state and then back to the non-power-down state.

The voltage regulator circuit according to the first embodiment detects the regulator output current Iout by comparing the current Ids (P204) passing through the P-channel transistor P204 in the output current monitoring circuit 211 and the current passing through the constant current source I201. The P-channel transistor P204 in the output current monitoring circuit 211 and the first P-channel transistor P301 in the output stage circuit 30 forms a current mirror circuit. This structure is suitable for determining the overcurrent protection condition in accordance with the load current.

Example to be Compared with First Embodiment

Figure 5:
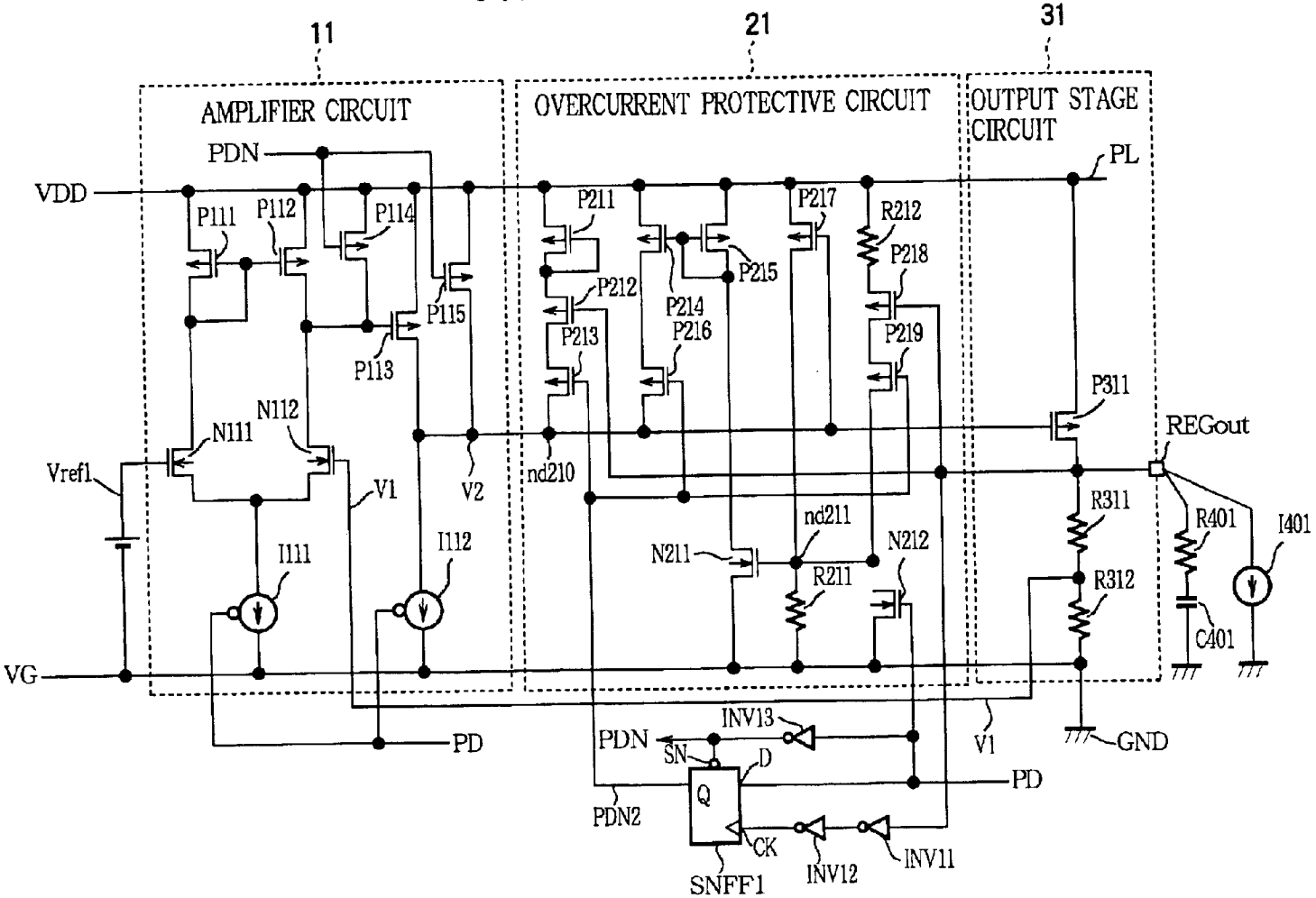
FIG. 5 is a circuit diagram showing the structure of a sample voltage regulator circuit provided for the sake of comparison.
Figure 6:
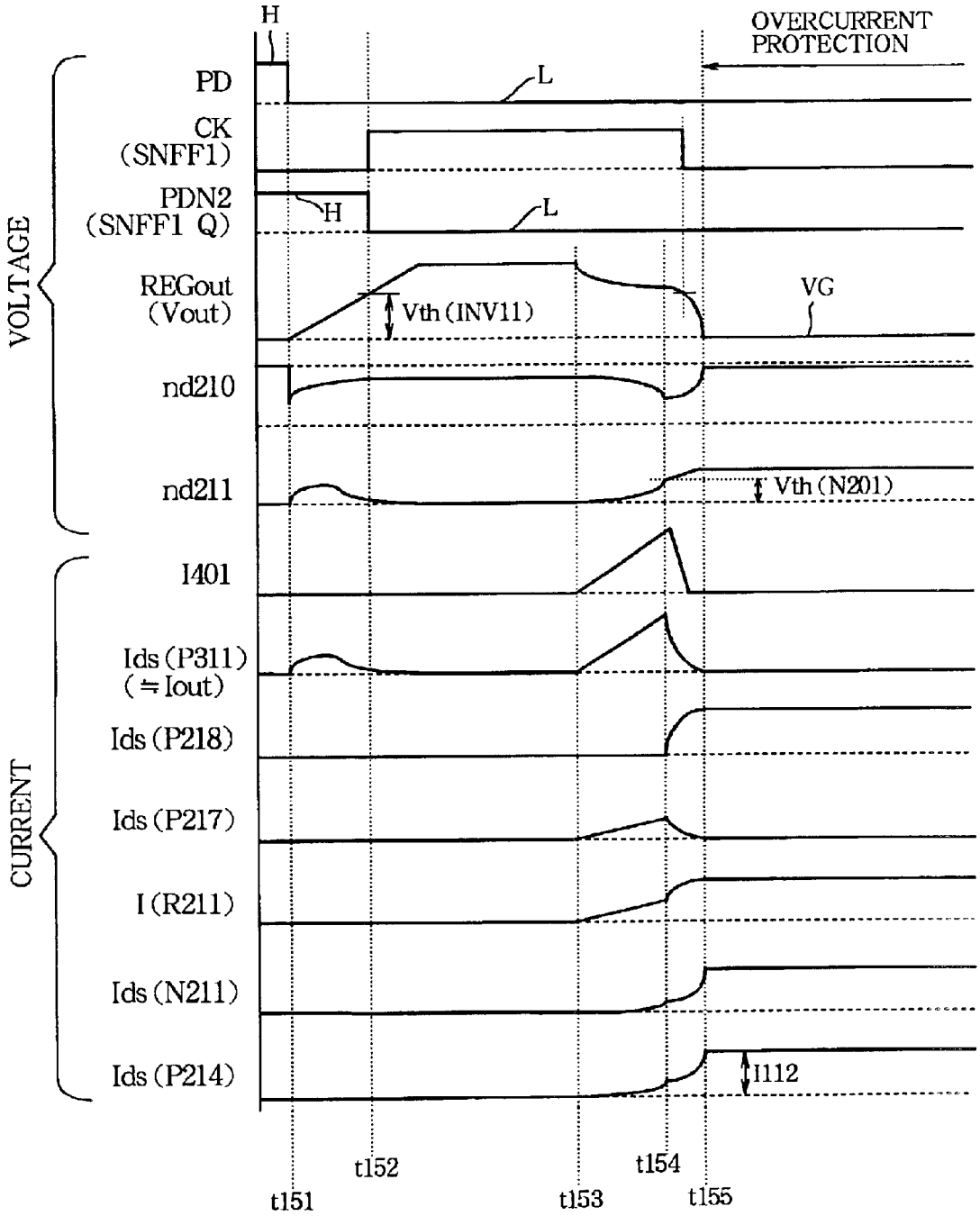
FIG. 6 is a timing chart illustrating the operation of the voltage regulator circuit shown in FIG. 5.

FIG. 5 is a circuit diagram showing the structure of a voltage regulator circuit to be compared with the first embodiment. FIG. 6 is a timing chart illustrating the operation of the voltage regulator circuit shown in FIG. 5. The voltage regulator circuit shown in FIG. 5 does not automatically return to the normal operation state from the overcurrent protection state. The voltage regulator circuit shown in FIG. 5 mainly includes an amplifier circuit 11, an overcurrent protective circuit (or a short-circuit protective circuit) 21, and an output stage circuit 31.

As shown in FIG. 5, the amplifier circuit 11 includes a constant current source I111 connected to the ground GND, N-channel transistors N111 and N112 with their drains coupled to the constant current source I111, a P-channel transistor P111 connected between the source of the N-channel transistor N111 and the power line PL, and a P-channel transistor P112 connected between the source of the N-channel transistor N112 and the power line PL. A constant reference voltage Vref1 is applied to the gate of the N-channel transistor N111, and a feedback voltage V1 output from a node between the resistors R311 and R312 of the output stage circuit 31 is applied to the gate of the N-channel transistor N112. The P-channel transistors P111 and P112 form a current mirror circuit. The amplifier circuit 11 also includes a constant current source I112 connected to the ground GND and a P-channel transistor P113 connected between the constant current source I112 and the power line PL. The P-channel transistor P113 has a gate coupled to a node between the N-channel transistor N112 and the P-channel transistor P112. In the normal operation state, the amplifier circuit 11 controls the control voltage V2 at the output node nd210, that is, the gate voltage of the P-channel transistor P311 in the output stage circuit 31 in such a way that the feedback voltage V1 matches the reference voltage Vref1.

The amplifier circuit 11 further includes a P-channel transistor P114 connected between the gate of the P-channel transistor P113 and the power line PL. The gate of the P-channel transistor P114 receives the inverted power-down signal PDN from the inverter INV13. While the voltage regulator circuit is in the power-down state, the power-down signal PD is high; the inverted power-down signal PDN is low; the P-channel transistors P114 and P115 are held on; the P-channel transistor P113 is held off; and the amplifier circuit 11 remains in its deactivated state. While the voltage regulator circuit is in the non-power-down state, the power-down signal PD is low; the inverted power-down signal PDN is high; the P-channel transistors P114 and P115 are held off; the p-channel transistor P113 is held on; and the amplifier circuit 11 remains in its activated state.

The operation of the overcurrent protective circuit 21 will now be described. When the power-down signal PD is kept high, the voltage regulator circuit is in the power-down state and stops its operation, and the output voltage from the regulator output terminal REGout becomes the ground voltage VG. At this time, because the terminal SN of the synchronous flip-flop circuit SNFF1 is low, the output signal PDN2 of the flip-flop circuit SNFF1 is high. If the power-down signal PD is brought to a low level, the voltage regulator circuit enters the non-power-down state, and the regulator output voltage Vout from the regulator output terminal REGout starts increasing. Then, the terminal SN of the flip-flop circuit SNFF1 goes high, the flip-flop circuit SNFF1 is reset, and the terminal D of the flip-flop circuit SNFF1 goes low. However, because the terminal CK is not provided with a clock, the output signal PDN2 is held high.

When the voltage regulator circuit starts operating, the rise of output voltage Vout from the regulator output terminal REGout can be sped up by outputting a large current from the P-channel transistor P311 in the output stage circuit 31. Accordingly, while the regulator output voltage Vout is increasing, the output signal PDN2 of the flip-flop circuit SNFF1 is held high; the P-channel transistors P213, P216, and P219 in the overcurrent protective circuit 21 are held off; and the overcurrent protective circuit 21 is isolated from the output node of the amplifier circuit 11, which is a node nd210 coupled to the gate of the P-channel transistor P311 in the output stage circuit 31. Therefore, the overcurrent protective circuit 21 is halted and does not affect the voltage increase at the regulator output terminal REGout (a period from time t151 to time t152 in FIG. 6).

If the regulator output voltage Vout from the regulator output terminal REGout increases further to exceed the threshold voltage Vth (INV11) of the inverter INV11, the output of the inverter INV11 goes from high to low; the output of the inverter INV12 goes from low to high; the terminal CK of the flip-flop circuit SNFF1 receives a low-to-high clock signal; and the output signal PDN2 of the flip-flop circuit SNFF1 goes from high to low (at time t152 in FIG. 6). At the same time, the P-channel transistors P213, P216, and P219 in the overcurrent protective circuit 21 are turned on. Then, the overcurrent protective circuit 21 can affect the output node of the amplifier circuit 11, that is, the node nd210 for controlling the P-channel transistor P311 in the output stage circuit 31.

If a load is connected to the regulator output terminal REGout-after the regulator output voltage Vout from the regulator output terminal REGout exceeds the threshold voltage Vth (INV11) of the inverter INV11, a regulator output current Iout flows. Then, the regulator output voltage Vout varies with the output voltage—output current characteristics (VI characteristics) of the voltage regulator circuit, and the regulator output voltage Vout decreases with the load current value.

On the other hand, a current Ids (P217) proportional to the dimension ratio between the P-channel transistors P217 and P311 flows through the P-channel transistor P217 in the overcurrent protective circuit 21. The P-channel transistor P217 has a gate coupled to the gate of the P-channel transistor P311 in the output stage circuit 31 (that is, the node nd210). A current Ids (P217) flows through the resistor R211, generating the voltage at the node nd211. If the voltage at the node nd211 does not exceed the threshold voltage of the N-channel transistor N211, the current Ids (N211) flowing through the N-channel transistor N211 is very small, and the current Ids (P215) flowing through the P-channel transistor P215 with a drain and gate coupled to the drain of the N-channel transistor N211 is very small, too. In addition, the current Ids (P214) flowing through the P-channel transistor P214, which gives a current depending on the current Ids (P217) to the node nd210 via the P-channel transistor P216, is also very small. These P-channel transistors P214 and P215 form a current mirror circuit. Therefore, the current Ids (P214) generated from the current Ids (P217) proportional to the regulator output current Iout from the regulator output terminal REGout has little effect on the voltage at the node nd210.

If the regulator output current Iout from the regulator output terminal REGout increases further (after time t153), the current Ids (P217) flowing through the P-channel transistor P217 increases, increasing the voltage at the node nd211. If the voltage at the node nd211 exceeds the threshold voltage Vth (N201) of the N-channel transistor N211, the current Ids (N211) abruptly increases. Because the current Ids (P214) generated from the current Ids (P217) proportional to the current Iout output from the regulator output terminal REGout passes through the constant current source I112 connected to the node nd210 in the amplifier circuit 11, the voltage at the node nd210 increases, decreasing the current output capability of the voltage regulator circuit and decreasing the regulator output voltage Vout from the regulator output terminal REGout. The decrease in the regulator output voltage Vout increases the voltage across the power line PL and the source of the P-channel transistor P218 with a gate coupled to the regulator output terminal REGout, increasing the current Ids (P218) determined by the resistance of resistor R212 connected between the source of the P-channel transistor P218 and the power line PL. The decrease in the current Ids (P218) increases the voltage at the node nd211, increasing the currents Ids (N211) and Ids (P214) further and increasing the voltage at the node nd210 further. If the current Ids (P214) reaches a level (which is shown in FIG. 6 as "I112") determined by the constant current source I112 (at time t155), the node nd210 is pulled up to a level substantially equal to the power supply voltage VDD by the P-channel transistor P214, and the P-channel transistor P311 in the output stage circuit 31 fully is turned off.

The regulator output current Iout which fully turns off the P-channel transistor P311 is determined by the power supply voltage value VDD of the power line PL, the constant current value of the constant current source I112, the dimension ratio between the P-channel transistors P217 and P311, the resistance of resistor R211, the current mirror ratio between the P-channel transistors P215 and P214, and the resistance of resistor R212. Therefore, overcurrent protection can be configured in accordance with the specified supply voltage VDD and the regulator output current Iout.

Once overcurrent protection is performed and the P-channel transistor P311 is fully turned off (at time t155) the regulator output voltage Vout from the regulator output terminal REGout matches the ground voltage VG; the voltage across the source of the P-channel transistor P218 and the power line PL is maximized; the current Ids (P218) is maximized; the voltage at the node nd211 is maximized; the current Ids (P214) is maximized (exceeding the current value of the constant current source I112); the amplifier circuit 11 is disabled (that is, the P-channel transistor P113 cannot control the voltage at the node nd210); and the regulator output voltage Vout from the regulator output terminal REGout matches the ground voltage VG. That is, positive feedback for disabling the amplifier circuit 11 is carried out. Therefore, overcurrent protection cannot be cleared by decreasing the regulator output current Iout at a later time, and the voltage Vout from the regulator output terminal REGout cannot be automatically increased to a predetermined level.

Modified Example of First Embodiment

Figure 7:
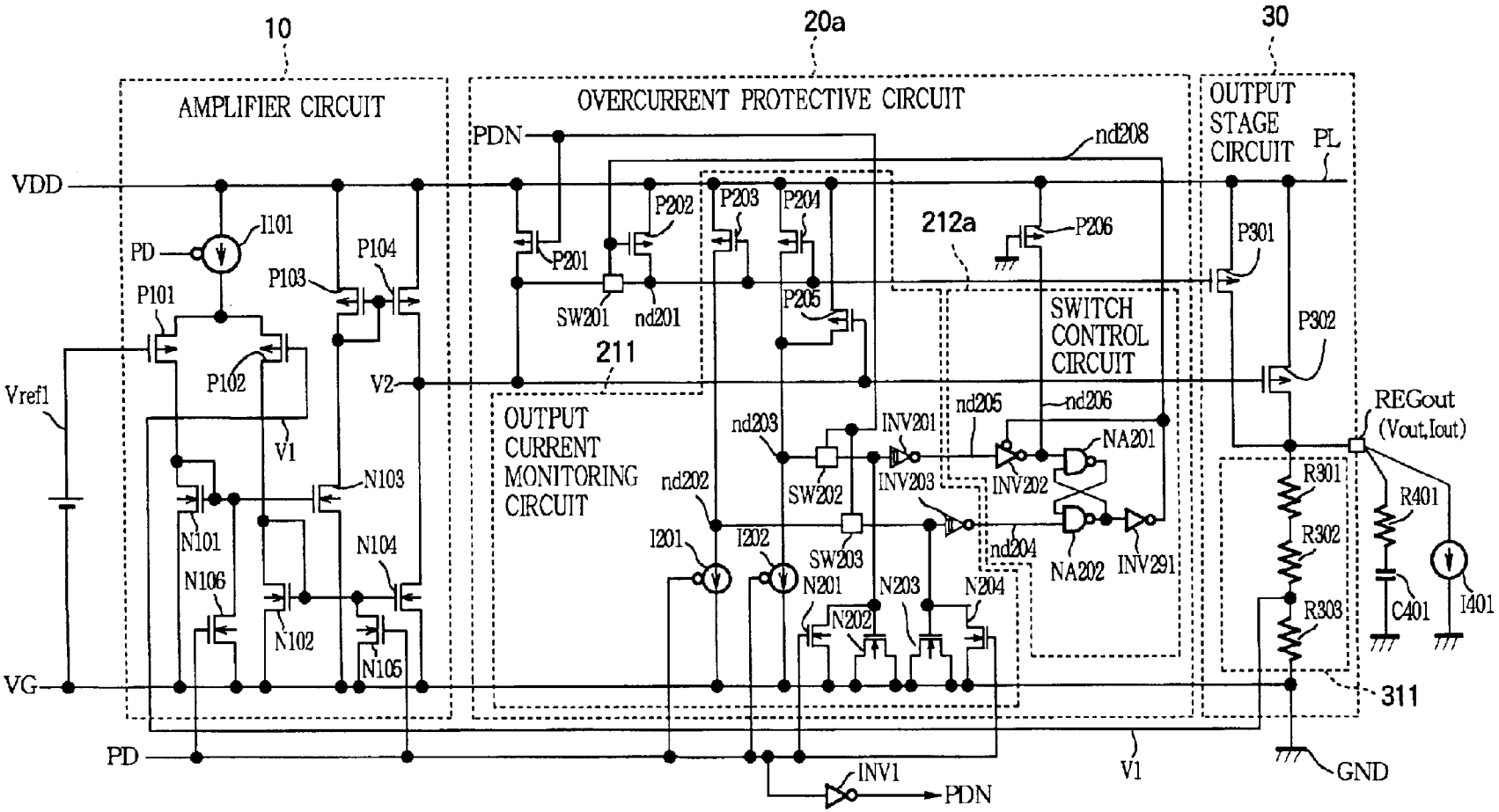
FIG. 7 is a circuit diagram showing the detailed structure of a modified example of the voltage regulator circuit according to the first embodiment.

FIG. 7 is a circuit diagram showing the detailed structure of a modified example of the voltage regulator circuit according to the first embodiment. In FIG. 7, elements that are the same as or correspond to elements in FIG. 3 are indicated by the same reference characters.

The voltage regulator circuit shown in FIG. 7 differs from the voltage regulator circuit shown in FIG. 3 in that the structure for speeding up the rise of the regulator output voltage Vout from the regulator output terminal REGout in the non-power-down state of the voltage regulator circuit is not provided. More specifically, the voltage regulator circuit shown in FIG. 7 does not have the comparator COMP1, the flip-flop circuit SNFF1, and the inverter INV2, which are seen in FIG. 3. In addition, the structure of the switch control circuit 212*a* in the overcurrent protective circuit 20*a* of the voltage regulator circuit shown in FIG. 7 differs from the structure of the switch control circuit 212 in the overcurrent protective circuit 20 of the voltage regulator circuit shown in FIG. 3. The overcurrent protective circuit 20*a* shown in FIG. 7 does not have the NAND gate NA203 shown in FIG. 3 and has an inverter INV291 instead. With the voltage regulator circuit shown in FIG. 7, the circuit structure can be simplified. Except for the above-mentioned respects, the voltage regulator circuit shown in FIG. 7 is the same as the voltage regulator circuit shown in FIG. 3.

Second Embodiment

Figure 8A:
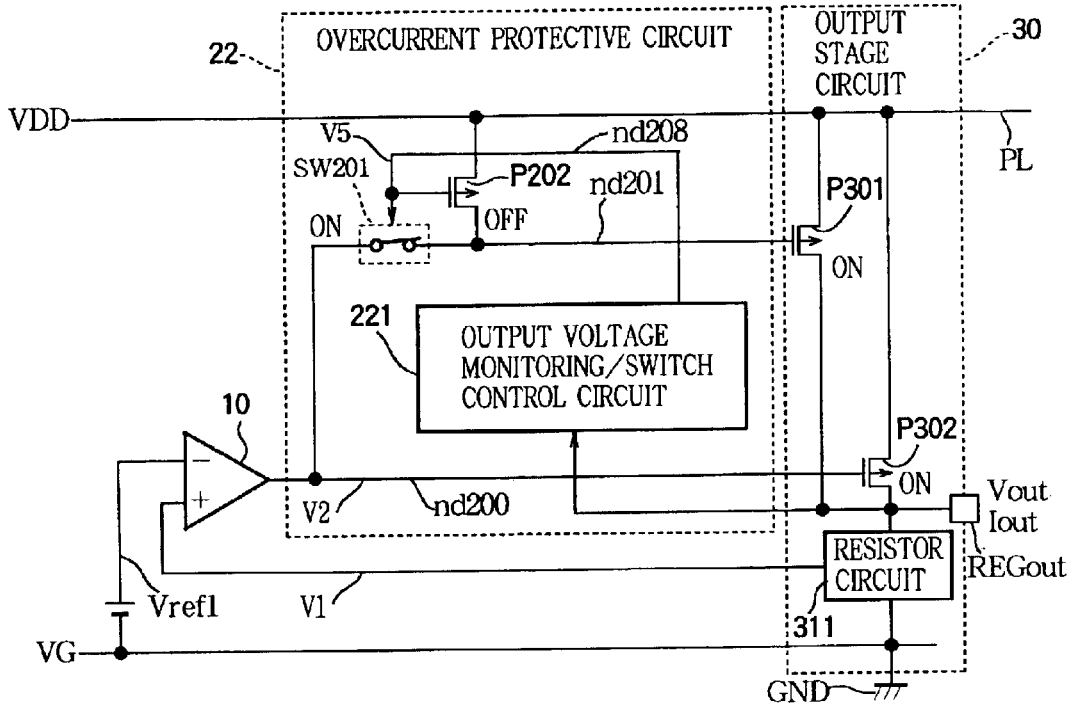
Figure 8B:
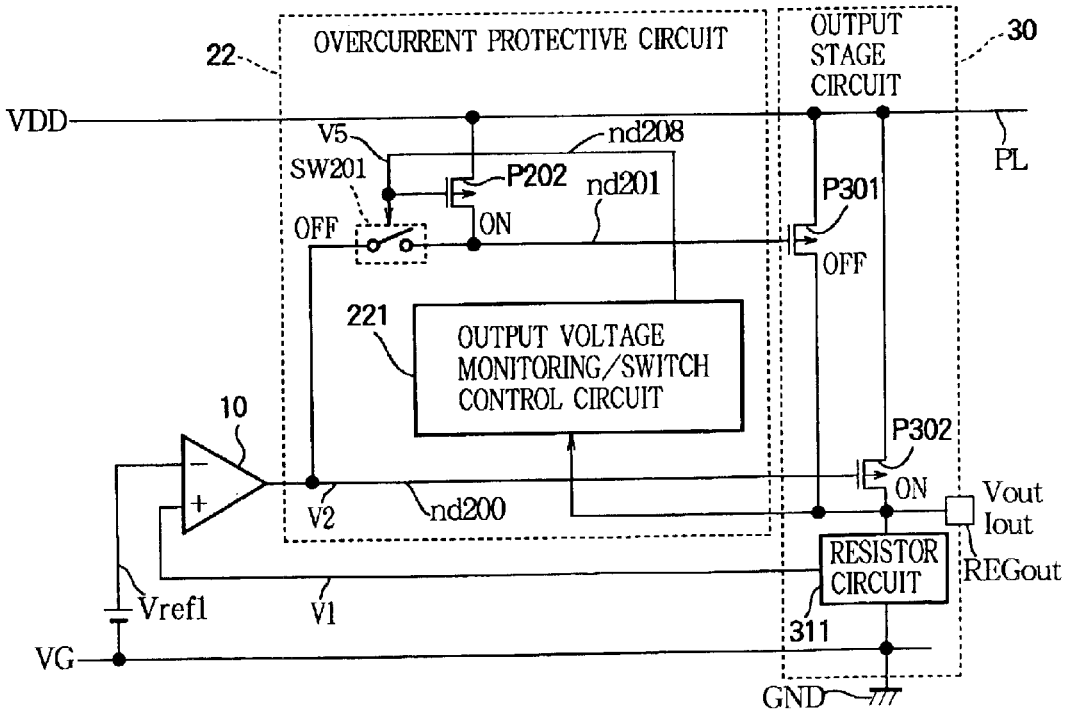

FIG. 8A and FIG. 8B are block diagrams schematically showing the structure of the voltage regulator circuit according to the second embodiment of the present invention. FIG. 8A illustrates the normal operation state in which a stabilized regulator output voltage Vout is supplied to an external load circuit. FIG. 8B illustrates the overcurrent protection state in which the regulator output current Iout is limited. In FIG. 8A and FIG. 8B, elements that are the same as or correspond to elements in FIG. 2A and FIG. 2B (first embodiment) are indicated by the same reference characters.

As shown in FIG. 8A and FIG. 8B, the voltage regulator circuit according to the second embodiment mainly includes an amplifier circuit 10, an overcurrent protective circuit (or a short-circuit protective circuit) 22, and an output stage circuit 30. The amplifier circuit 10 and the output stage circuit 30 in the second embodiment have the same structure as those in the first embodiment.

The overcurrent protective circuit 22 shown in FIG. 8A and FIG. 8B includes a MOS transfer gate switch SW201 and a P-channel transistor P202. The MOS transfer gate switch SW201 makes or breaks a connection between the output node nd200 of the amplifier circuit 10 and the gate (that is, the node nd201) of the first P-channel transistor P301. The P-channel transistor P202 breaks or makes a connection between the power line PL and the gate (that is, the node nd201) of the first P-channel transistor P301. The overcurrent protective circuit 22 includes an output voltage monitoring/switch control circuit 221, which monitors the regulator output voltage Vout from the regulator output terminal REGout (consequently monitoring the regulator output current Iout) and controls the switch SW201 and P-channel transistor P202 according to the monitored regulator output voltage Vout.

An outline of the operation of the voltage regulator circuit according to the second embodiment will now be described. In the normal operation state illustrated in FIG. 8A, the control voltage V5 output from the output voltage monitoring/switch control circuit 221 to the node nd208 turns on the switch SW201 and turns off the P-channel transistor P202. In the meantime, the first P-channel transistor P301 and second P-channel transistor P302 in the output stage circuit 30 are controlled by the control voltage V2 output from the amplifier circuit 10 to the node nd200; the regulator output current Iout is supplied to the external load circuit (not shown in FIG. 8A and FIG. 8B) via either the first P-channel transistor P301 or second P-channel transistor P302; and the regulator output voltage Vout is maintained at a stable level.

If the regulator output voltage Vout monitored by the output voltage monitoring/switch control circuit 221 falls below a certain reference voltage Vref2 (shown in FIG. 10) the overcurrent protective circuit 22 switches the output stage circuit 30 from the normal operation state illustrated in FIG. 8A to the overcurrent protection state illustrated in FIG. 8B. When the switch to the overcurrent protection state illustrated in FIG. 8B is made, the output voltage monitoring/switch control circuit 221 brings the node nd208 to a low level, turns off the switch SW201, and turns on the P-channel transistor P202. Then, the voltage at the gate of the first P-channel transistor P301 of the output stage circuit 30 (that is, the node nd201) is pulled up to a high level close to the power supply voltage VDD; the first P-channel transistor P301 is turned off; and the current Ids (P302) passing through the second P-channel transistor P302 is supplied to the external load circuit as the regulator output current Iout. Therefore, a current not larger than the maximum permissible current Ipr (shown in FIG. 10) determined by the current output characteristics of the second P-channel transistor P302 becomes the regulator output current Iout in the overcurrent protection state, and an overcurrent will not flow from the regulator output terminal REGout to the external load circuit.

If the regulator output voltage Vout monitored by the output voltage monitoring/switch control circuit 221 exceeds the reference voltage Vref2 in the overcurrent protection state illustrated in FIG. 8B, the overcurrent protective circuit 22 switches the output stage circuit 30 to the normal operation state illustrated in FIG. 8A. When the switch to the normal operation state illustrated in FIG. 8A is made, the output voltage monitoring/switch control circuit 221 brings the node nd208 to a high level, turns on the switch SW201, and turns off the P-channel transistor P202. Then, both the first P-channel transistor P301 and the second P-channel transistor P302 of the output stage circuit 30 are controlled by the control voltage V2 output from the amplifier circuit 10 to the node nd200; the regulator output current Iout is supplied to the external load circuit via either the first P-channel transistor P301 or second P-channel transistor P302; and the regulator output voltage Vout is kept at a stable level.

Figure 9:
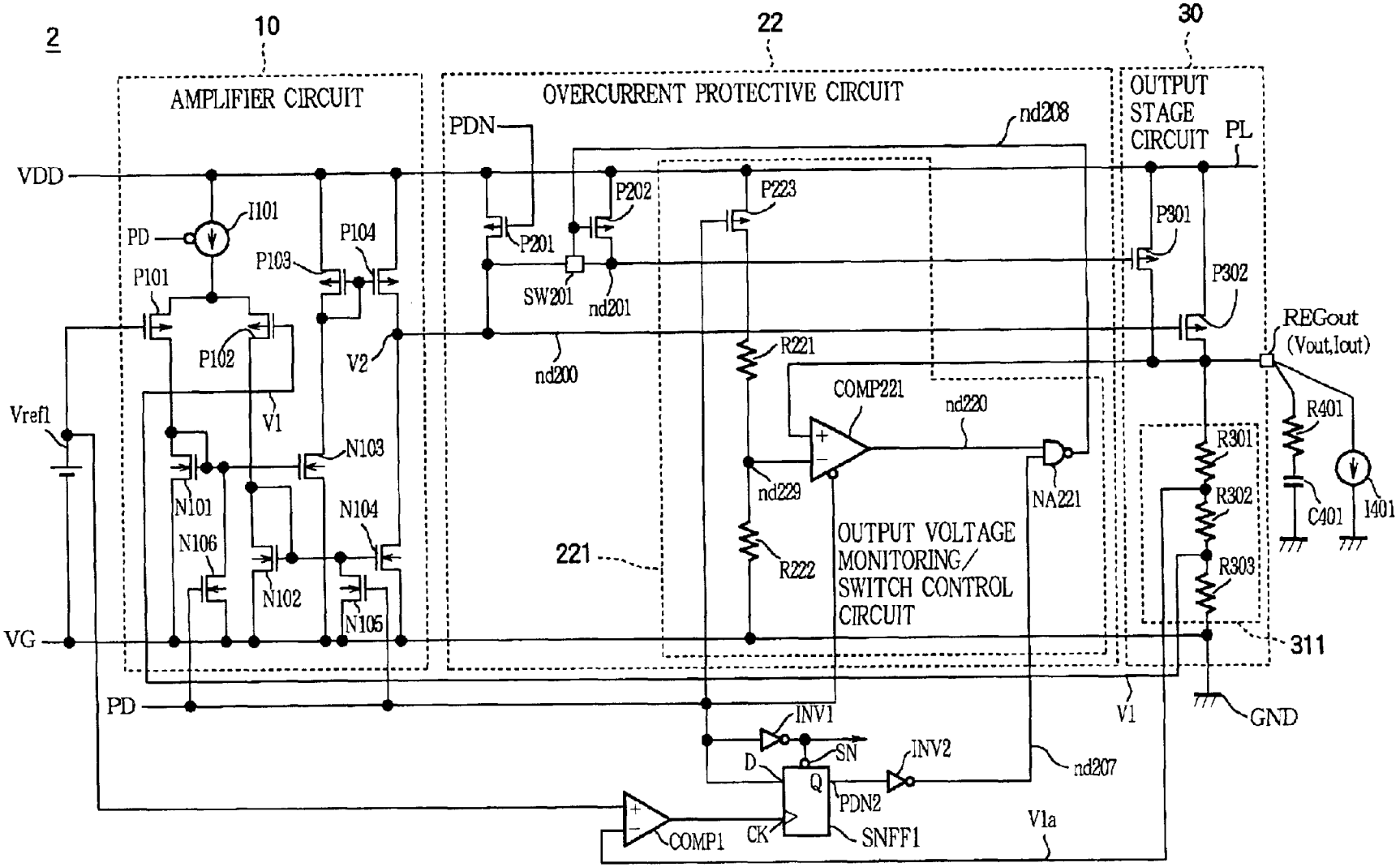
FIG. 9 is a circuit diagram showing the detailed structure of the voltage regulator circuit according to the second embodiment.
Figure 10:
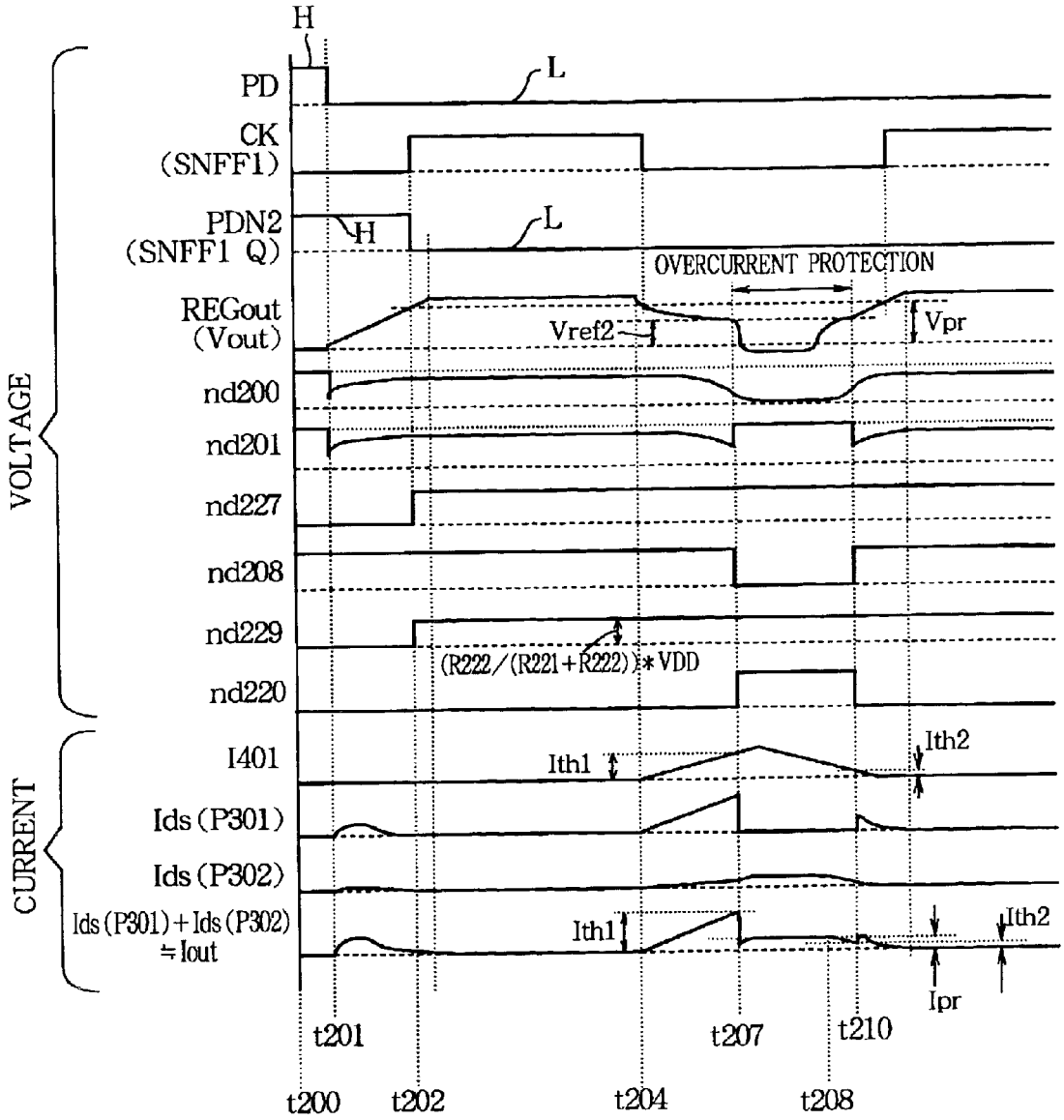
FIG. 10 is a timing chart illustrating the operation of the voltage regulator circuit according to the second embodiment.

Next, the voltage regulator circuit according to the second embodiment will now be described in detail. FIG. 9 is a circuit diagram showing the detailed structure of the voltage regulator circuit according to the second embodiment. FIG. 10 is a timing chart illustrating the operation of the voltage regulator circuit according to the second embodiment. In FIG. 9, elements that are the same as or correspond to elements in FIG. 3 (first embodiment) are indicated by the same reference characters. The voltage regulator circuit according to the second embodiment can be manufactured as a semiconductor integrated circuit device 2.

The overcurrent protective circuit 22 shown in FIG. 9 includes a MOS transfer gate switch SW201 and a P-channel transistor P202. The MOS transfer gate switch SW201 makes or breaks a connection between the output node nd200 of the amplifier circuit 10 and the gate (that is, the node nd201) of the first P-channel transistor P301. The P-channel transistor P202 breaks or makes a connection between the power line PL and the gate (that is, the node nd201) of the first P-channel transistor P301. The overcurrent protective circuit 22 also includes an output voltage monitoring/switch control circuit 221, which monitors the regulator output voltage Vout from the regulator output terminal REGout and controls the switch SW201 and the P-channel transistor P202 in accordance with the monitored regulator output voltage Vout. The overcurrent protective circuit 22 further includes a P-channel transistor P201, which is connected between the power line PL and the node nd200 to which the control voltage V2 output from the amplifier circuit 10 is applied. The gate of the P-channel transistor P201 receives the inverted power-down signal PDN. When the voltage regulator circuit is in the power-down state, the inverted power-down signal PDN is low; the P-channel transistor P201 is in on-state; the voltage at the nodes nd200 and nd201 are pulled up to the level of the power supply voltage VDD; the first P-channel transistor P301 and the second P-channel transistor P302 are in off-state; and the output stage circuit 30 is in the deactivated state. When the voltage regulator circuit enters the non-power-down state, the inverted power-down signal PDN is high; the P-channel transistor P201 is in off-state; the voltage at the nodes nd200 and nd201 matches the control voltage V2 output from the amplifier circuit 10; the first P-channel transistor P301 and second P-channel transistor P302 are in on-state; and the output stage circuit 30 enters the activated state.

The output voltage monitoring/switch control circuit 221 includes resistors R221 and R222 connected in series. The resistors R221 and R222 divide the power supply voltage VDD of the power line PL and generate the reference voltage Vref2 at the node nd229. A P-channel transistor P223 is connected between an end of the resistor R221 and the power line PL. The P-channel transistor P223 isolates resistor R221 from the power line PL while the voltage regulator circuit is in the power-down state. The output voltage monitoring/switch control circuit 221 also includes a comparator COMP221 with an enable terminal. The comparator COMP221 compares the regulator output voltage Vout from the regulator output terminal REGout and the reference voltage Vref2 at the node nd229. The negative input of the comparator COMP221 is connected to a connection node nd229 between the resistors R221 and R222, and the positive input of the comparator COMP221 is connected to the regulator output terminal REGout. The output voltage monitoring/switch control circuit 221 further includes a NAND gate NA221, which receives the output voltage of the comparator COMP221 and the voltage at the node nd207 and outputs the control voltage V5 to the output node nd208. The NAND gate NA221 keeps the overcurrent protective circuit 22 from starting its operation until the regulator output voltage Vout reaches a predetermined level while the voltage regulator circuit is in the non-power-down state (a period before time t202 shown in FIG. 10).

Next, the operation of the voltage regulator circuit according to the second embodiment will now be described in detail, with reference to FIG. 9 and FIG. 10. In the period between time t200 and time t201 in FIG. 10, the power-down signal PD is high; the voltage regulator circuit is in the power-down state; the voltage regulator circuit is disabled; and the regulator output terminal REGout outputs the ground voltage VG. Because the terminal SN of the flip-flop circuit SNFF1 receives the inverted power-down signal PDN, that is, a low level signal from the inverter INV1, the signal PDN2 output from the terminal Q of the flip-flop circuit SNFF1 is high; the input node nd207 of the NAND gate NA221 receives a low voltage from the inverter INV2; and the output node nd208 of the output voltage monitoring/switch control circuit 221 outputs a high voltage.

When the power-down signal PD is brought from a high level to a low level at time t201 in FIG. 10, the voltage regulator circuit enters the non-power-down state, and the regulator output voltage Vout from the regulator output terminal REGout starts increasing. The flip-flop circuit SNFF1 is reset at time t201 by a high voltage input to the terminal SN, a low voltage is input to the input terminal D, and no clock is supplied to the terminal CK, so that the output signal PDN2 of the flip-flop circuit SNFF1 is kept high. In the meantime, the node nd2O7 is low, the node nd208 is high, the switch SW201 is in on-state, and the P-channel transistor P202 is in off-state, in the overcurrent protective circuit 22. Accordingly, the output node nd200 of the amplifier circuit 10 and the output node nd201 of the overcurrent protective circuit 22 are at the same voltage.

When the voltage regulator circuit starts operating, the rise in the regulator output voltage Vout from the regulator output terminal REGout can be sped up by allowing a large current to flow through either the first P-channel transistor P301 or second P-channel transistor P302 in the output stage circuit 30 (that is, disabling overcurrent protection) for a very short period. To enable this, the overcurrent protective circuit 22 is disabled during the period from time t201 to time t202 in FIG. 10, by bringing the node nd207 to a low level and keeping the output node nd208 of the output voltage monitoring/switch control circuit 221 high.

When the regulator output voltage Vout from the regulator output terminal REGout exceeds a predetermined level Vpr, where Vpr=((R301+R302+R303)/(R302+R303)*Vref1, (at time t202 in FIG. 10), the output of the comparator COMP1 goes from high to low; a low-to-high clock is supplied to the terminal CK of the flip-flop circuit SNFF1; the output signal PDN2 of the flip-flop circuit SNFF1 goes from high to low; and the voltage at the node nd207 goes from low to high. Accordingly, the overcurrent protective circuit 22 starts monitoring the operation of output overcurrent protection at time t202, as shown in FIG. 10.

If an external load circuit (including a resistor R401, a capacitor C401, and a current source I401, for instance) is connected to the regulator output terminal REGout, a current flows via either the first P-channel transistor P301 or second P-channel transistor P302 in the output stage circuit 30, and a regulator output current Iout flows from the regulator output terminal REGout. Then, the regulator output voltage Vout, which varies depending on the output voltage—output current characteristics (VI characteristics) of the voltage regulator circuit, starts decreasing depending on the regulator output current.

When the regulator output current Iout from the regulator output terminal REGout increases after time t204 in FIG. 10, bringing the regulator output voltage Vout from the regulator output terminal REGout below the reference voltage Vref2 (=(R222/(R221+R222))*VDD) obtained by dividing the power supply voltage VDD by means of the resistors R221 and R222 (at time t207 in FIG. 10), the voltage at the output node nd220 of the comparator COMP221 goes from low to high. Then, the voltage at the output node nd208 of the output voltage monitoring/switch control circuit 221 goes from high to low; the switch SW201 is turned off; the P-channel transistor P202 is turned on; and the output node nd201 of the overcurrent protective circuit 22 is pulled up to the power supply voltage VDD of the power line PL. Pulling up the node nd201 to the power supply voltage VDD turns off the first P-channel transistor P301 in the output stage circuit 30. The current Ids (P302) passing through the second P-channel transistor P302 becomes the regulator output current Iout, of which value is limited according to the current output capability of the second P-channel transistor P302, and the regulator output voltage Vout from the regulator output terminal REGout decreases (after time t207 in FIG. 4). This decrease in the regulator output voltage Vout from the regulator output terminal REGout decreases the level of the positive input of the amplifier circuit 10 (feedback voltage V1), decreasing the voltage at the output node nd200 of the amplifier circuit 10 to a level close to the ground voltage VG. Therefore, the regulator output current Iout while the overcurrent protective circuit 22 is performing overcurrent protection is limited in accordance with the current output capability of the second P-channel transistor P302, of which gate voltage is close to the ground voltage VG, in the output stage circuit 30.

If the regulator output current lout from the regulator output terminal REGout in the overcurrent protection state falls below the current output capability of the second P-channel transistor P302 in the output stage circuit 30 (the current Ipr of FIG. 10, that is the current output capability of the second P-channel transistor P302 while the gate voltage of the second P-channel transistor P302 is kept higher than the ground voltage VG) at time t208, the regulator output voltage Vout from the regulator output terminal REGout increases. When the regulator output voltage Vout from the regulator output terminal REGout exceeds the reference voltage Vref2, where Vref2 =(R222/(R221+R222))*VDD, the output node 220 of the comparator COMP221 goes from high to low (at time t210). Then, the voltage at the output node nd208 of the output voltage monitoring/switch control circuit 221 goes high again; the sum of the currents passing through the first P-channel transistor P301 and the second P-channel transistor P302 becomes the regulator output current lout from the regulator output terminal REGout; and the voltage regulator circuit returns to its normal operation state.

The output voltage Vout from the regulator output terminal REGout which turns off the first P-channel transistor P301 (that is, the reference voltage Vref2) is determined by the power supply voltage VDD and the resistor ratio between the resistors R221 and R222. The regulator output current lout of the regulator output terminal REGout which turns off the first P-channel transistor P301 is determined by the regulator output voltage—output current characteristics (VI characteristics), which depend on the reference voltage Vref2, the current capabilities of the first P-channel transistor P301 and the second P-channel transistor P302, and the amplifier circuit 10. The regulator output current Iout from the regulator output terminal REGout which turns on the first P-channel transistor P301 again is determined by the regulator output voltage—output current characteristics (VI characteristics) depending on the current capability of the second P-channel transistor P302 and the amplifier circuit 10 and by the reference voltage Vref2.

As has been described above, the voltage regulator circuit according to the second embodiment can be protected from overload or short-circuit because the regulator output current Iout will not exceed a predetermined current level Ipr in the overcurrent protection state when the regulator output voltage falls below the reference voltage Vref2.

If the external load circuit returns to the normal state during the overcurrent protection state of the voltage regulator circuit, the voltage regulator circuit according to the second embodiment can automatically restart the stabilized voltage output. Accordingly, an instantaneous surge in the regulator output current Iout or an instantaneous drop of the regulator output voltage Vout due to disturbance may enable the overcurrent protection function, but the normal operation state, in which a stabilized voltage is output from the regulator output terminal REGout, can be automatically restored. This eliminates the need for carrying out a reset operation to bring the whole voltage regulator circuit into the power-down state and then back to the non-power-down state.

In the second embodiment, the regulator output current Iout from the regulator output terminal REGout which turns off the first P-channel transistor P301 is determined also by the reference voltage Vref2 (=(R222/(R221+R222))*VDD). Increase in supply voltage VDD increases the reference voltage Vref2, decreasing the regulator output current Iout to turn off the first P-channel transistor P301. As the power supply voltage VDD increases, the reference voltage Vref2 increases in proportion to the power supply voltage VDD, with a proportionality constant of (R222/(R221+R222)), but the amount of decrease in the regulator output current Iout which turns off the first P-channel transistor P301 is the amount of change in drain conductance of the first P-channel transistor P301 and is greater than the amount of increase in reference voltage Vref2. The power consumption of the first P-channel transistor P301 is calculated by (Second power of Iout)*(VDD−Vout). Accordingly, increase in supply voltage VDD increases the power consumption even if the current is constant. In the second embodiment, the increase in power consumption of the first P-channel transistor P301 caused by an increase in supply voltage VDD is smaller than decrease in the regulator output current Iout which turns off the first P-channel transistor P301. The second embodiment is suitable for performing safe output overcurrent protection against large load current, when mounted in a package with a widely varying supply voltage VDD and a high thermal resistance.

Modified Example of Second Embodiment

Figure 11:
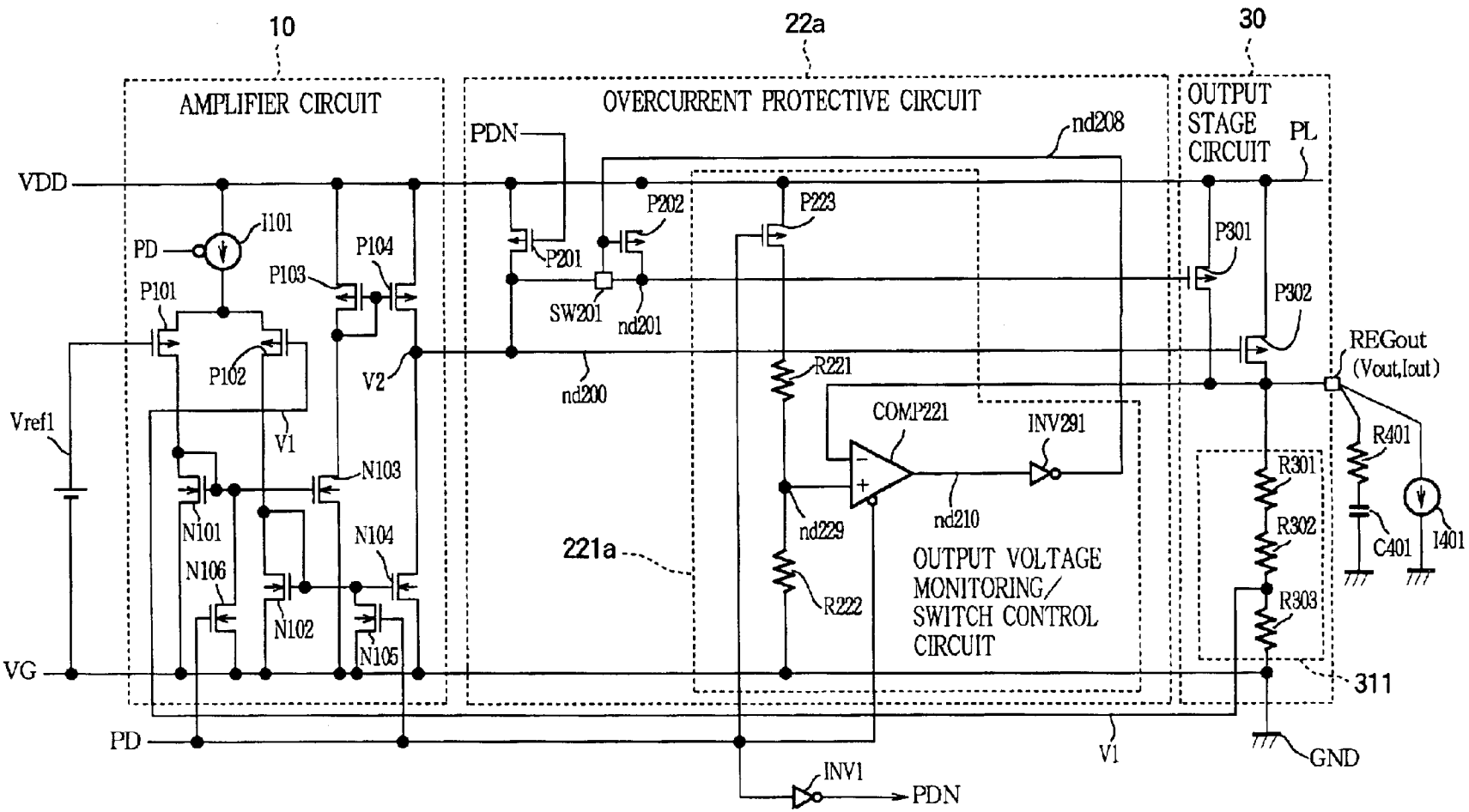
FIG. 11 is a circuit diagram showing the detailed structure of a modified example of the voltage regulator circuit according to the second embodiment.

FIG. 11 is a detailed circuit diagram showing a modified example of the voltage regulator circuit according to the second embodiment. In FIG. 11, elements that are the same as or correspond to elements in FIG. 9 are indicated by the same reference characters.

The voltage regulator circuit shown in FIG. 11 differs from the voltage regulator circuit shown in FIG. 9 in that a structure for speeding up the rise of the regulator output voltage Vout from the regulator output terminal REGout in the non-power-down state of the voltage regulator circuit is not provided. More specifically, the voltage regulator circuit shown in FIG. 11 does not have the comparator COMP1, the flip-flop circuit SNFF1, and the inverter INV2, which are seen in FIG. 9. In addition, the structure of the output voltage monitoring/switch control circuit 221*a* in the overcurrent protective circuit 22*a* of the voltage regulator circuit shown in FIG. 11 differs from the structure of the output voltage monitoring/switch control circuit 221 in the overcurrent protective circuit 22 of the voltage regulator circuit shown in FIG. 9. The overcurrent protective circuit 22*a* shown in FIG. 11 does not have the NAND gate NA221 shown in FIG. 9 and has an inverter INV291 instead. With the voltage regulator circuit shown in FIG. 11, the circuit structure can be simplified. Except for the above-mentioned respects, the voltage regulator circuit shown in FIG. 11 is the same as the voltage regulator circuit shown in FIG. 9.

Third Embodiment

Figure 12A:
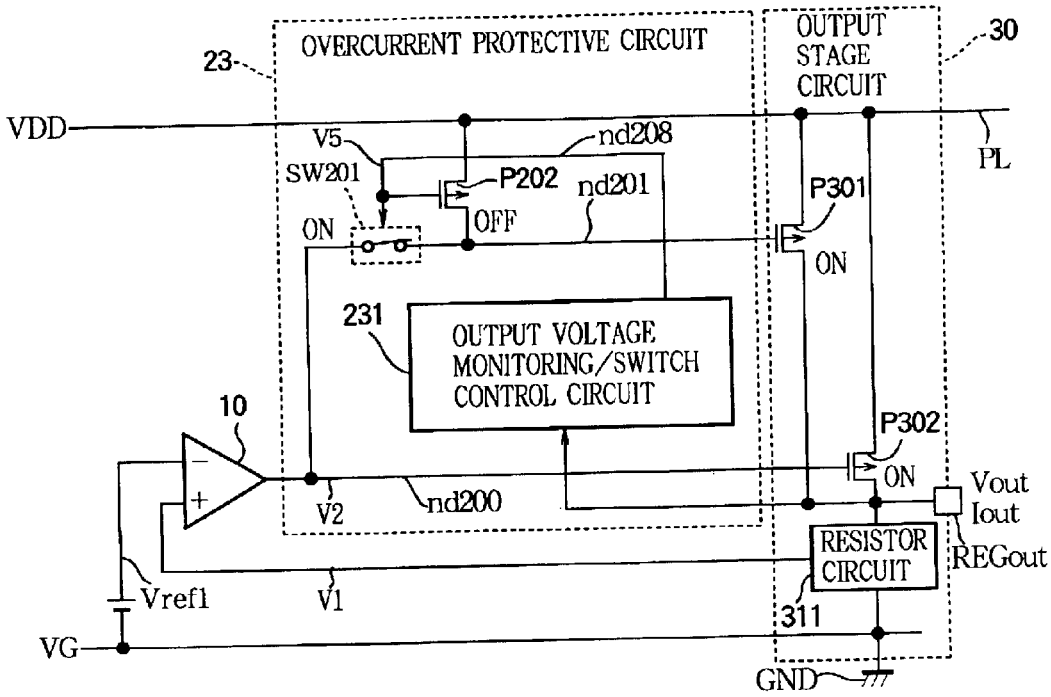
Figure 12B:
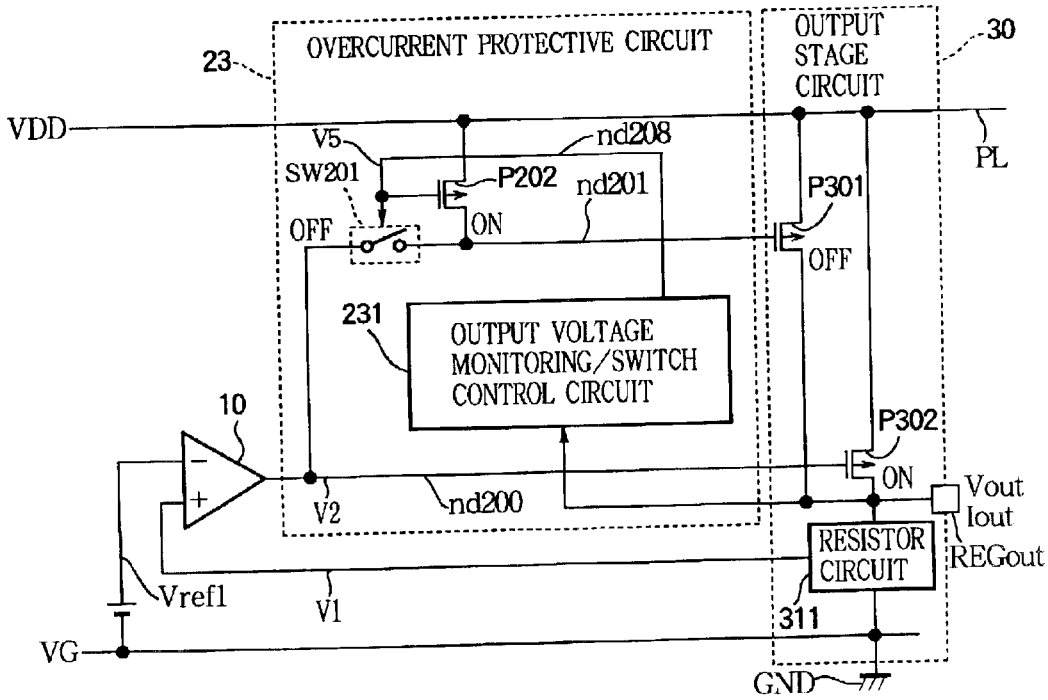

FIG. 12A and FIG. 12B are block diagrams schematically showing the structure of the voltage regulator circuit according to the third embodiment of the present invention. FIG. 12A illustrates the normal operation state in which a stabilized regulator output voltage Vout is supplied to an external load circuit. FIG. 12B illustrates the overcurrent protection state in which the regulator output current Iout is limited. In FIG. 12A and FIG. 12B, elements that are the same as or correspond to elements in FIG. 2A and FIG. 2B (first embodiment) or FIG. 8A and FIG. 8B (second embodiment) are indicated by the same reference characters.

As shown in FIG. 12A and FIG. 12B, the voltage regulator circuit according to the third embodiment mainly includes an amplifier circuit 10, an overcurrent protective circuit (or a short-circuit protective circuit) 23, and an output stage circuit 30. The amplifier circuit 10 and the output stage circuit 30 in the third embodiment have the same structure as those in the first or second embodiment. The overcurrent protective circuit 23 in the third embodiment is the same as the overcurrent protective circuit 22 in the second embodiment, except for the structure of the output voltage monitoring/switch control circuit 231 in the overcurrent protective circuit 23.

Figure 13:
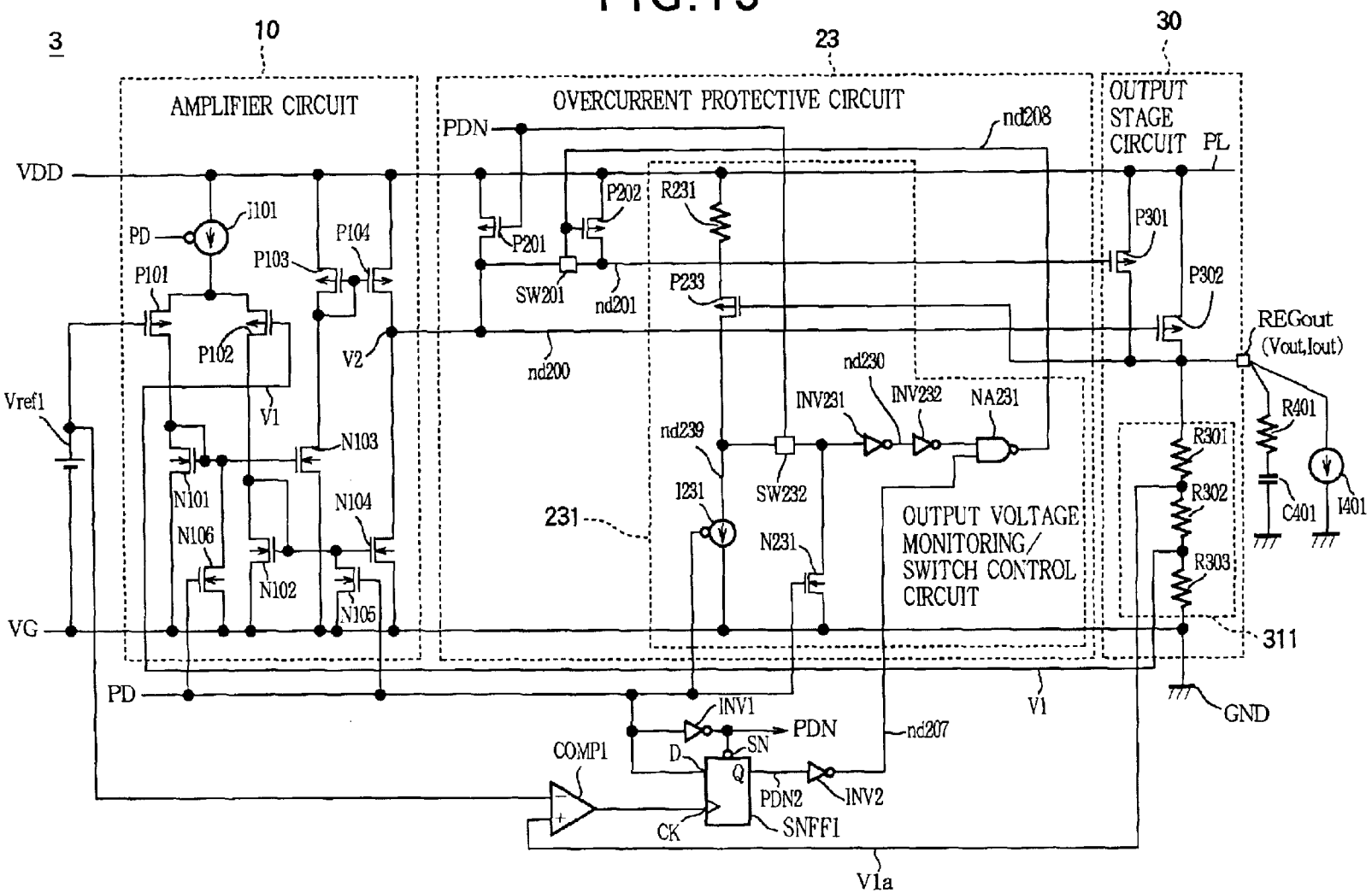
FIG. 13 is a circuit diagram showing the detailed structure of the voltage regulator circuit according to the third embodiment.
Figure 14:
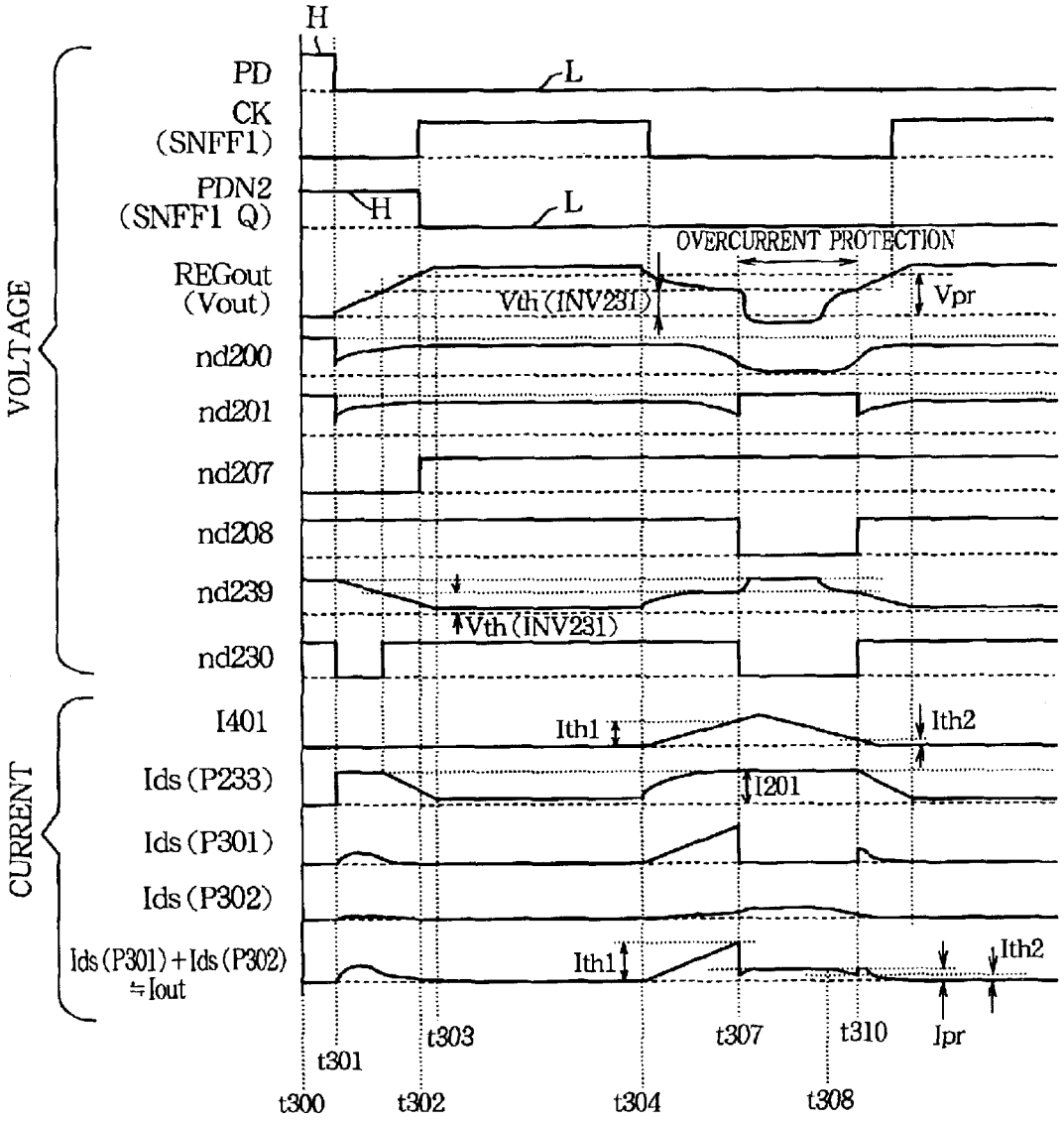
FIG. 14 is a timing chart illustrating the operation of the voltage regulator circuit according to the third embodiment.

Next, the voltage regulator circuit according to the third embodiment will now be described in detail. FIG. 13 is a circuit diagram showing the detailed structure of the voltage regulator circuit according to the third embodiment. FIG. 14 is a timing chart illustrating the operation of the voltage regulator circuit according to the third embodiment. In FIG. 13, elements that are the same as or correspond to elements in FIG. 3 (first embodiment) or FIG. 9 (second-embodiment) are indicated by the same reference characters. The voltage regulator circuit according to the third embodiment can be manufactured as a semiconductor integrated circuit device 3. The overcurrent protective circuit 23 shown in FIG. 13 includes a MOS transfer gate switch SW201 and a P-channel transistor P202. The MOS transfer gate switch SW2O1 makes or breaks a connection between the output node nd200 of the amplifier circuit 10 and the gate (that is, the node nd201) of the first P-channel transistor P301. The P-channel transistor P202 breaks or makes a connection between the power line PL and the gate (that is, the node nd201) of the first P-channel transistor P301. The overcurrent protective circuit 23 also includes an output voltage monitoring/switch control circuit 231, which monitors the regulator output voltage Vout from the regulator output terminal REGout and controls the switch SW201 and the P-channel transistor P202 in accordance with the monitored regulator output voltage Vout. The overcurrent protective circuit 23 further includes a P-channel transistor P201, which is connected between the power line PL and the node nd200 to which the control voltage V2 output from the amplifier circuit 10 is applied. The gate of the P-channel transistor P201 receives the inverted power-down signal PDN. When the voltage regulator circuit is in the power-down state, the power-down signal PD is high; the inverted power-down signal PDN is low; the P-channel transistor P201 is in on-state; the voltage at the nodes nd200 and nd201 are pulled up to the level of the power supply voltage VDD; the first P-channel transistor P301 and the second P-channel transistor P302 are in off-state; and the output stage circuit 30 enters the deactivated state. When the voltage regulator circuit enters the non-power-down state, the power-down signal PD is low; the inverted power-down signal PDN is high; the P-channel transistor P201 is in off-state; the voltage at the nodes nd200 and nd201 matches the control voltage V2 output from the amplifier circuit 10, the first P-channel transistor P301 and second P-channel transistor P302 are in on-state; and the output stage circuit 30 enters the activated state.

The output voltage monitoring/switch control circuit 231 includes a P-channel transistor P233 with a gate coupled to the regulator output terminal REGout, a resistor R231 connected between the power line PL and the source of the P-channel transistor P233, and a constant current source 1231 connected between the ground GND and the drain of the P-channel transistor P233. An end of a MOS transfer gate switch SW232 is coupled to the node nd239 between the P-channel transistor P233 and the constant current source I231. The other end of the switch SW232 is coupled to the input terminal of an inverter INV231. The output terminal of the inverter INV231 is coupled to the input terminal of another inverter INV232. The output voltage monitoring/switch control circuit 231 also includes an N-channel transistor N231, which is connected between the ground GND and the connection node between the switch SW232 and the inverter INV231. The N-channel transistor N231 pulls down the input terminal of the inverter INV231 to the ground voltage VG in the power-down state. The output voltage monitoring/switch control circuit 231 further includes a NAND gate NA231, which receives the voltage at output node nd230 via the inverter INV232 and the voltage at the node nd201 and outputs the control voltage V5 to the output node nd208. The NAND gate NA231 keeps the overcurrent protective circuit 23 from starting its operation until the regulator output voltage Vout reaches a predetermined level while the voltage regulator circuit is in the non-power-down state (until time t302 shown in FIG. 14).

The operation of the voltage regulator circuit according to the third embodiment will now be described in detail, with reference to FIG. 13 and FIG. 14. In the power-down state between time t300 and time t301 in FIG. 14, the power-down signal PD is high; the voltage regulator circuit is in the power-down state; the voltage regulator circuit is disabled; and the regulator output terminal REGout outputs the ground voltage VG. Because the terminal SN of the flip-flop circuit SNFF1 receives the inverted power-down signal PDN, that is, a low level signal from the inverter INV1, the signal PDN2 output from the terminal Q of the flip-flop circuit SNFF1 is high; the input node nd207 of the NAND gate NA221 receives a low voltage from the inverter INV2; and the output node nd208 of the output voltage monitoring/switch control circuit 231 outputs a high voltage.

When the power-down signal PD is brought to a low level at time t301 in FIG. 14, the voltage regulator circuit enters the non-power-down state, and the regulator output voltage Vout from the regulator output terminal REGout starts increasing. The flip-flop circuit SNFF1 is reset at time t301 by a high voltage input to the terminal SN, a low voltage is input to the input terminal D, and no clock is supplied to the terminal CK, so that the output signal PDN2 of the flip-flop circuit SNEF1 is kept high. In the meantime, the node nd207 is low, the node nd208 is high, the switch SW2O1 is in on-state, and the P-channel transistor P202 is in off-state, in the overcurrent protective circuit 23. Accordingly, the output node nd200 of the amplifier circuit 10 and the output node nd201 of the overcurrent protective circuit 23 are at the same voltage.

When the voltage regulator circuit starts operating, the rise in the regulator output voltage Vout from the regulator output terminal REGout can be sped up by allowing a large current to flow through either the first P-channel transistor P301 or second P-channel transistor P302 in the output stage circuit 30 (that is, disabling overcurrent protection) for a very short period. To enable this, the overcurrent protective circuit 23 is disabled during the period from time t301 to time t302 in FIG. 14, by bringing the node nd207 to a low level and keeping the output node nd208 of the output voltage monitoring/switch control circuit 231 high.

If an external load circuit (including a resistor R401, a capacitor C401, and a current source I401, for instance) is connected to the regulator output terminal REGout, a regulator output current Iout flows via either the first P-channel transistor P301 or second P-channel transistor P302 in the output stage circuit 30 and output from the regulator output terminal REGout. Then, the regulator output voltage Vout which varies depending on the output voltage—output current characteristics (VI characteristics) of the voltage regulator circuit, starts decreasing depending on the value of the regulator output current.

Increase in the regulator output current Iout from the regulator output terminal REGout decreases the regulator output voltage Vout, increasing the voltage across the power line PL and source of the P-channel transistor P233, of which gate is coupled to the regulator output terminal REGout. This increases also the current Ids (P233)=(VDD−Vout−Vth (P233))/R231), which flows through the P-channel transistor P233 and the resistor R231 connected between the power line PL and the source of the P-channel transistor P233 (after time t304 in FIG. 14), where Vth (P233) is the threshold voltage of the P-channel transistor P233, and R231 is the resistance of the resistor (R231). The voltage at the connection node nd239 between the drain of the P-channel transistor P233 and the constant current source I231 rises from the level of the ground voltage VG (after time t304 in FIG. 14). When a further increase in the regulator output current Iout from the regulator output terminal REGout causes the voltage at the node nd239 to exceed the threshold voltage Vth (INV231) of the inverter INV231, the output node nd230 of the inverter INV231 goes from high to low, and the output from the inverter INV232 goes from low to high (at time t307). Then, the output node nd208 of the output voltage monitoring/switch control circuit 23 goes from high to low; the switch SW201 is turned off; the P-channel transistor P202 is turned on; and the node nd201 is pulled up to the power supply voltage VDD by the P-channel transistor P202. Pulling up node nd201 to the power supply voltage VDD turns off the first P-channel transistor P301 in the output stage circuit 30. The current Ids (P302) flowing through the second P-channel transistor P302 becomes the regulator output current Iout, of which value is limited by the current output capability of the second P-channel transistor P302, decreasing the voltage Vout from the regulator output terminal REGout (after time t307 in FIG. 14). This decrease in output voltage Vout from the regulator output terminal REGout decreases the positive input level (feedback voltage V1) of the amplifier circuit 10. The voltage at output node nd200 of the amplifier circuit 10 decreases to a level close to the ground voltage VG. While the overcurrent protective circuit 23 is performing overcurrent protection, the regulator output current Iout is limited by the current output capability of the second P-channel transistor P302, of which gate voltage is brought to a level close to the ground voltage VG, in the output stage circuit 30.

If increase in the regulator output voltage Vout from the regulator output terminal REGout causes the voltage at the node nd239 to fall below the voltage threshold level Vth (INV231) in the overcurrent protection state, the output node nd230 goes high; the output of inverter INV232 goes low; the output node nd208 of the output voltage monitoring/switch control circuit 231 goes high again; the switch SW201 is turned on; the P-channel transistor P202 is turned off; and both the first P-channel transistor P301 and the second P-channel transistor P302 are turned on. Accordingly, the sum of the currents of the first P-channel transistor P301 and the second P-channel transistor P302 becomes the regulator output current Iout from the regulator output terminal REGout, and the voltage regulator circuit returns to its normal operation state (at time t310).

The regulator output current Iout from the regulator output terminal REGout which turns off the first P-channel transistor P301 is determined by the regulator output voltage—output current characteristics (VI characteristics) which depend on the current capabilities of the first P-channel transistor P301 and second P-channel transistor P302 and the amplifier circuit 10, the power supply voltage VDD, the threshold voltage Vth (P233) of the P-channel transistor P233, the resistance of the resistor R231 connected between the source of the P-channel transistor P233 and the power line PL, and the constant current source I231. The regulator output current Iout from the regulator output terminal REGout which turns on the first P-channel transistor P301 again is also determined by the regulator output voltage—output current characteristics (VI characteristics), which depend on the current capability of the second P-channel transistor P302 and the amplifier circuit 10, the power supply voltage VDD, the threshold voltage Vth (P233) of the P-channel transistor P233, the resistance of the resistor R231 connected between the source of the P-channel transistor P233 and the power line PL, and the constant current source I201. While overcurrent protection is being performed, the current of the first P-channel transistor P301 is determined by the power supply voltage VDD and the current output capability of the second P-channel transistor P302 in the output stage circuit 30.

As has been described above, the voltage regulator circuit according to the third embodiment produces the same effect as that of the second embodiment.

In the third embodiment, the regulator output current Iout which turns off the first P-channel transistor P301 is determined also by Ids (P233)*(VDD−Vout−Vth (P233))/R231) corresponding to the regulator output voltage Vout, where Ids (P233) is the current flowing through the P-channel transistor P233, Vth (P233) is the threshold voltage of the P-channel transistor P233, and "R231" is the resistance of the resistor R231. Accordingly, increase in supply voltage VDD decreases the regulator output current Iout which turns off the first P-channel transistor P301. As the power supply voltage VDD increases, the current Ids (P233) increases in proportion to (VDD−Vout−Vth (P233)), with a proportionality constant of 1/R231, decreasing the regulator output current Iout which turns off the first P-channel transistor P301. As the power supply voltage VDD increases, the current Ids (P233) increases in proportion to (VDD−Vout−Vth (P233)), with a proportionality constant of 1/R231, but the amount of decrease in regulator output current Iout to turn off the first P-channel transistor P301 is the amount of change in the drain conductance of the first P-channel transistor P301, which is greater than the amount of increase in the current Ids (P233). Because the power consumption of the first P-channel transistor P301 is (Second power of Iout)*(VDD−Vout), increase in the power supply voltage VDD increases the power consumption even if the current is constant. In the third embodiment, decrease in the regulator output current Iout to turn off the first P-channel transistor P301 is greater than the power consumption of the first P-channel transistor P301 resulting from increase in supply voltage VDD. Therefore, the second embodiment is suitable for performing safe output overcurrent protection against large load current, when mounted in a package with a widely varying supply voltage VDD and a high thermal resistance. In the third embodiment, the change in the current Ids (P233) depending on the varying regulator output voltage is proportional to 1/R231. The current capabilities of the first P-channel transistor P301 and the second P-channel transistor P302 decrease with increasing temperature. Accordingly, with a material which provides a positive temperature coefficient of the resistor R231, variations in regulator output current Iout to turn off the first P-channel transistor P301 depending on the temperature characteristics can be relieved.

Modified Example of Third Embodiment

Figure 15:
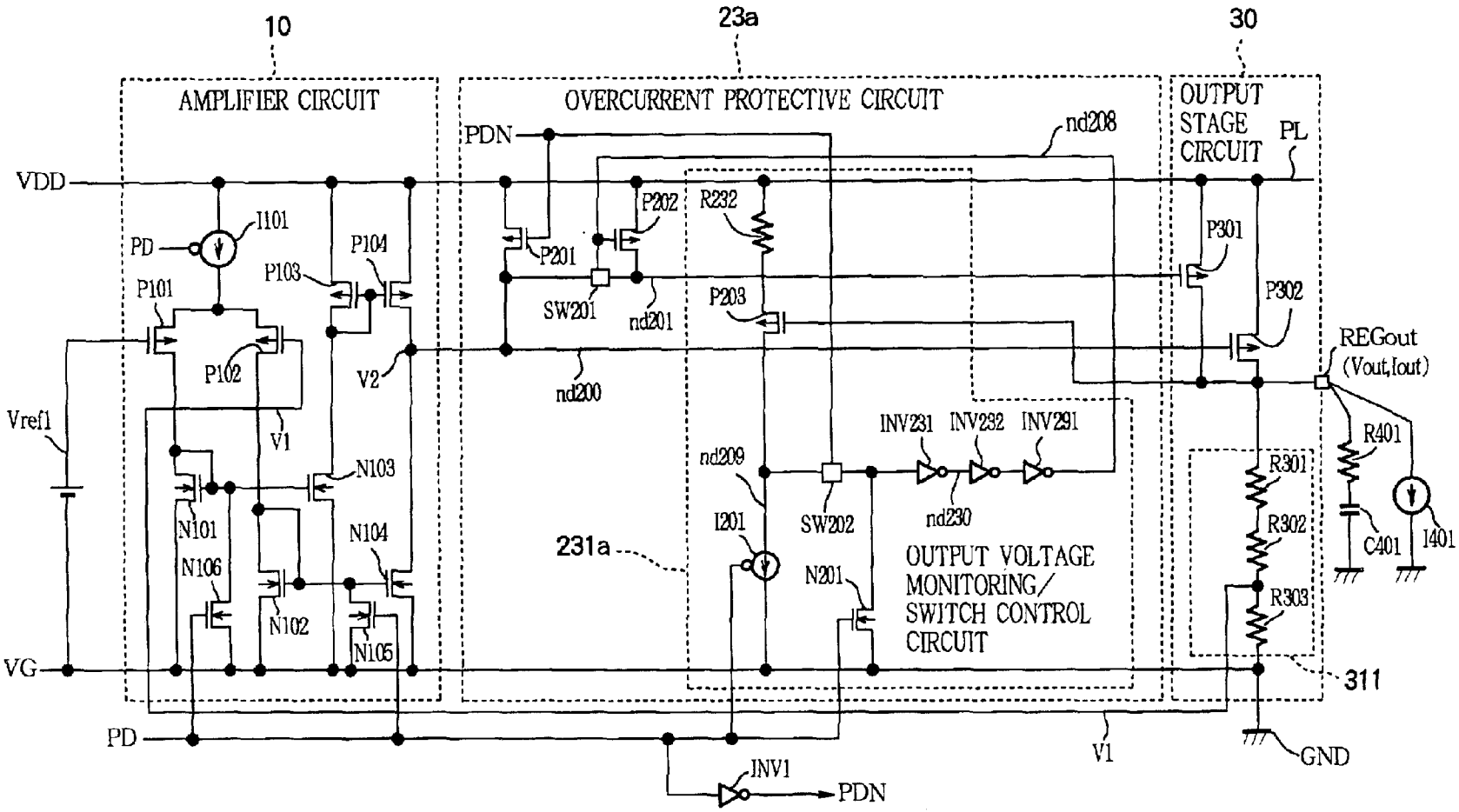
FIG. 15 is a circuit diagram showing the detailed structure of a modified example of the voltage regulator circuit according to the third embodiment.

FIG. 15 is a circuit diagram showing the detailed structure of a modified example of the voltage regulator circuit according to the third embodiment. In FIG. 15, elements that are the same as or correspond to elements in FIG. 13 are indicated by the same reference characters.

The voltage regulator circuit shown in FIG. 15 differs from the voltage regulator circuit shown in FIG. 13 in that a structure for speeding up the rise of the regulator output voltage Vout from the regulator output terminal REGout in the non-power-down state of the voltage regulator circuit is not provided. More specifically, the voltage regulator circuit shown in FIG. 15 does not have the comparator COMP1, the flip-flop circuit SNFF1, and the inverter INV2, which are seen in FIG. 13. In addition, the structure of the output voltage monitoring/switch control circuit 231*a* in the overcurrent protective circuit 23*a* of the voltage regulator circuit shown in FIG. 15 differs from the structure of the switch control circuit 231 in the overcurrent protective circuit 23 of the voltage regulator circuit shown in FIG. 13. The overcurrent protective circuit 23*a* shown in FIG. 15 does not have the NAND gate NA231 shown in FIG. 13 and has an inverter INV291 instead. With the voltage regulator circuit shown in FIG. 15, the circuit structure can be simplified. Except for the above-mentioned respects, the voltage regulator circuit shown in FIG. 15 is the same as the voltage regulator circuit shown in FIG. 13.

Fourth Embodiment

Figure 16A:
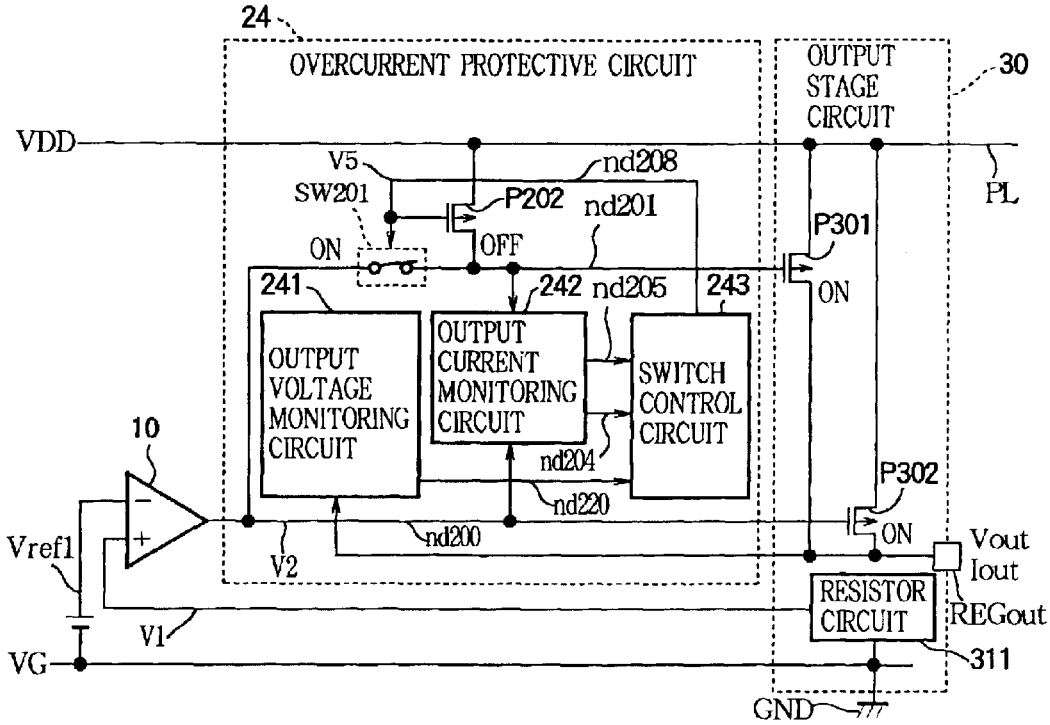
Figure 16B:
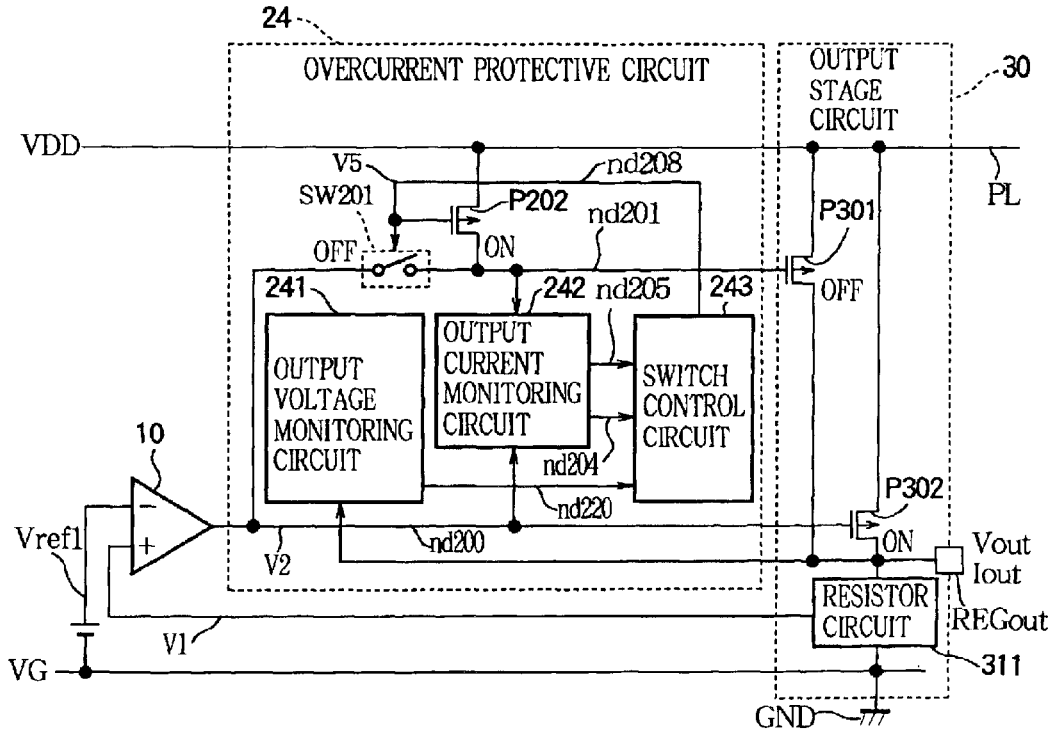

FIG. 16A and FIG. 16B are block diagrams schematically showing the structure of the voltage regulator circuit according to the fourth embodiment of the present invention. FIG. 16A illustrates the normal operation state in which a stabilized regulator output voltage Vout is supplied to an external load circuit. FIG. 16B illustrates the overcurrent protection state in which the regulator output current Iout is limited. In FIG. 16A and FIG. 16B, elements that are the same as or correspond to elements in FIG. 2A and FIG. 2B (first embodiment) or FIG. 8A and FIG. 8B (second embodiment) are indicated by the same reference characters.

As shown in FIG. 16A and FIG. 16B, the voltage regulator circuit according to the fourth embodiment mainly includes an amplifier circuit 10, an overcurrent protective circuit (or a short-circuit protective circuit) 24, and an output stage circuit 30. The amplifier circuit 10 and the output stage circuit 30 in the fourth embodiment have the same structure as those in the first embodiment.

The overcurrent protective circuit 24 shown in FIG. 16A and FIG. 16B includes a MOS transfer gate switch SW201 and a P-channel transistor P202. The MOS transfer gate switch SW201 makes or breaks a connection between the output node nd200 of the amplifier circuit 10 and the gate (that is, the node nd201) of the first P-channel transistor P301. The P-channel transistor P202 breaks or makes a connection between the power line PL and the gate (that is, the node nd201) of the first P-channel transistor P301. The overcurrent protective circuit 24 also includes an output voltage monitoring circuit 241 which monitors the regulator output voltage Vout from the regulator output terminal REGout, an output current monitoring circuit 242 which monitors the current Ids (P301) flowing through the first P-channel transistor P301 and the current Ids (P302) flowing through the second P-channel transistor P302, thereby monitoring the regulator output current Iout, which substantially equals to Ids (P301)+Ids (P302), and a switch control circuit 243 which controls the switch SW201 and the P-channel transistor P202 on the basis of the monitored voltage and current.

An outline of the operation of the voltage regulator circuit according to the fourth embodiment will now be described. In the normal operation state illustrated in FIG. 16A, the control voltage V5 output from the switch control circuit 243 to the node nd208 turns on the switch SW201 and turns off the P-channel transistor P202. In the meantime, the first P-channel transistor P301 and second P-channel transistor P302 in the output stage circuit 30 are controlled by the control voltage V2 output from the amplifier circuit 10 to the node nd200; the regulator output current Iout is supplied to the external load circuit (not shown in FIG. 16A and FIG. 16B) via either the first P-channel transistor P301 or second P-channel transistor P302; and the regulator output voltage Vout is maintained at a stable level.

If the regulator output current Iout monitored by the output current monitoring circuit 242 exceeds a first current threshold level Ith1 (shown in FIG. 18) in the normal operation state illustrated in FIG. 16A, the overcurrent protective circuit 24 switches the output stage circuit 30 to the overcurrent protection state illustrated in FIG. 16B. When the switch to the overcurrent protection state illustrated in FIG. 16B is made, the switch control circuit 243 brings the node nd208 to a low level, turns off the switch SW201, and turns on the P-channel transistor P202. Then, the voltage at the gate of the first P-channel transistor P301 of the output stage circuit 30 (that is, the node nd201) is pulled up to a high level close to the power supply voltage VDD of the power line PL; the first P-channel transistor P301 is turned off; and the current Ids (P302) passing through the second P-channel transistor P302 is supplied to the external load circuit as the regulator output current Iout. Therefore, a current not larger than the maximum permissible current Ipr (shown in FIG. 18) determined by the current output characteristics of the second P-channel transistor P302 becomes the regulator output current Iout in the overcurrent protection state, and an overcurrent will not flow from the regulator output terminal REGout to the external load circuit.

If the regulator output current Iout monitored by the output current monitoring circuit 242 falls below a second current threshold level Ith2 (shown in FIG. 18) in the overcurrent protection state illustrated in FIG. 16B, the overcurrent protective circuit 24 switches the output stage circuit 30 to the normal operation state illustrated in FIG. 16A. When the switch to the normal operation state illustrated in FIG. 16A is made, the switch control circuit 243 brings its output node nd208 to a high level, turns on the switch SW201, and turns off the P-channel transistor P202. Then, both the first P-channel transistor P301 and the second P-channel transistor P302 of the output stage circuit 30 are controlled by the control voltage V2 output from the amplifier circuit 10 to the node nd200; the regulator output current Iout is supplied to the external load circuit via either the first P-channel transistor P301 or the second P-channel transistor P302; and the regulator output voltage Vout is kept to a stable level.

If the regulator output voltage Vout monitored by the output voltage monitoring circuit 241 exceeds a certain reference voltage Vref2 (shown in FIG. 19) in the normal operation state illustrated in FIG. 16A, the overcurrent protective circuit 24 switches the output stage circuit 30 to the overcurrent protection state illustrated in FIG. 16B. When the switch to the overcurrent protection state illustrated in FIG. 16B is made, the switch control circuit 243 brings its output node nd208 to a low level, turns off the switch SW201, and turns on the P-channel transistor P202. Then, the voltage at the gate of the first P-channel transistor P301 of the output stage circuit 30 (that is, the node nd201) is pulled up to a high level close to the power supply voltage VDD; the first P-channel transistor P301 is turned off; and the current Ids (P302) passing through the second P-channel transistor P302 is supplied to the external load circuit as the regulator output current Iout. Therefore, a current not larger than the maximum permissible current Ipr (shown in FIG. 19) determined by the current output characteristics of the second P-channel transistor P302 becomes the regulator output current Iout in the overcurrent protection state, and an overcurrent will not flow from the regulator output terminal REGout to the external load circuit.

If the regulator output voltage Vout monitored by the output current monitoring circuit 241 exceeds the reference voltage Vref2 in the overcurrent protection state illustrated in FIG. 16B, the overcurrent protective circuit 24 switches the output stage circuit 30 to the normal operation state illustrated in FIG. 16A. When the switch to the normal operation state illustrated in FIG. 16A is made, the switch control circuit 243 brings the node nd208 to a high level, turns on the switch SW201, and turns off the P-channel transistor P202. Then, both the first P-channel transistor P301 and the second P-channel transistor P302 of the output stage circuit 30 are controlled by the control voltage V2 output from the amplifier circuit 10 to the node nd200; the regulator output current Iout is supplied to the external load circuit via either the first P-channel transistor P301 or the second P-channel transistor P302; and the regulator output voltage Vout is kept at a stable level.

Figure 17:
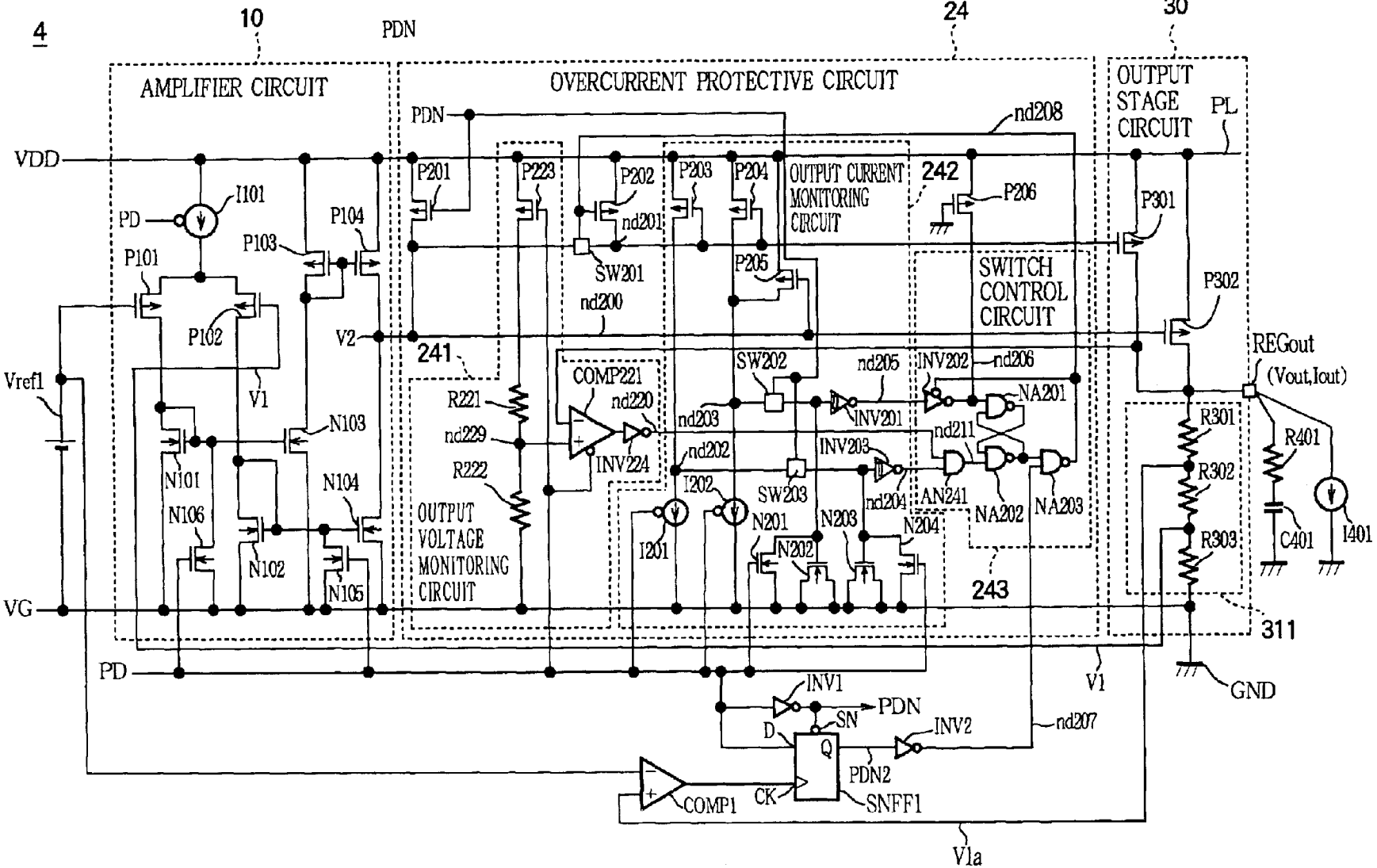
FIG. 17 is a circuit diagram showing the detailed structure of the voltage regulator circuit according to the fourth embodiment.
Figure 18:
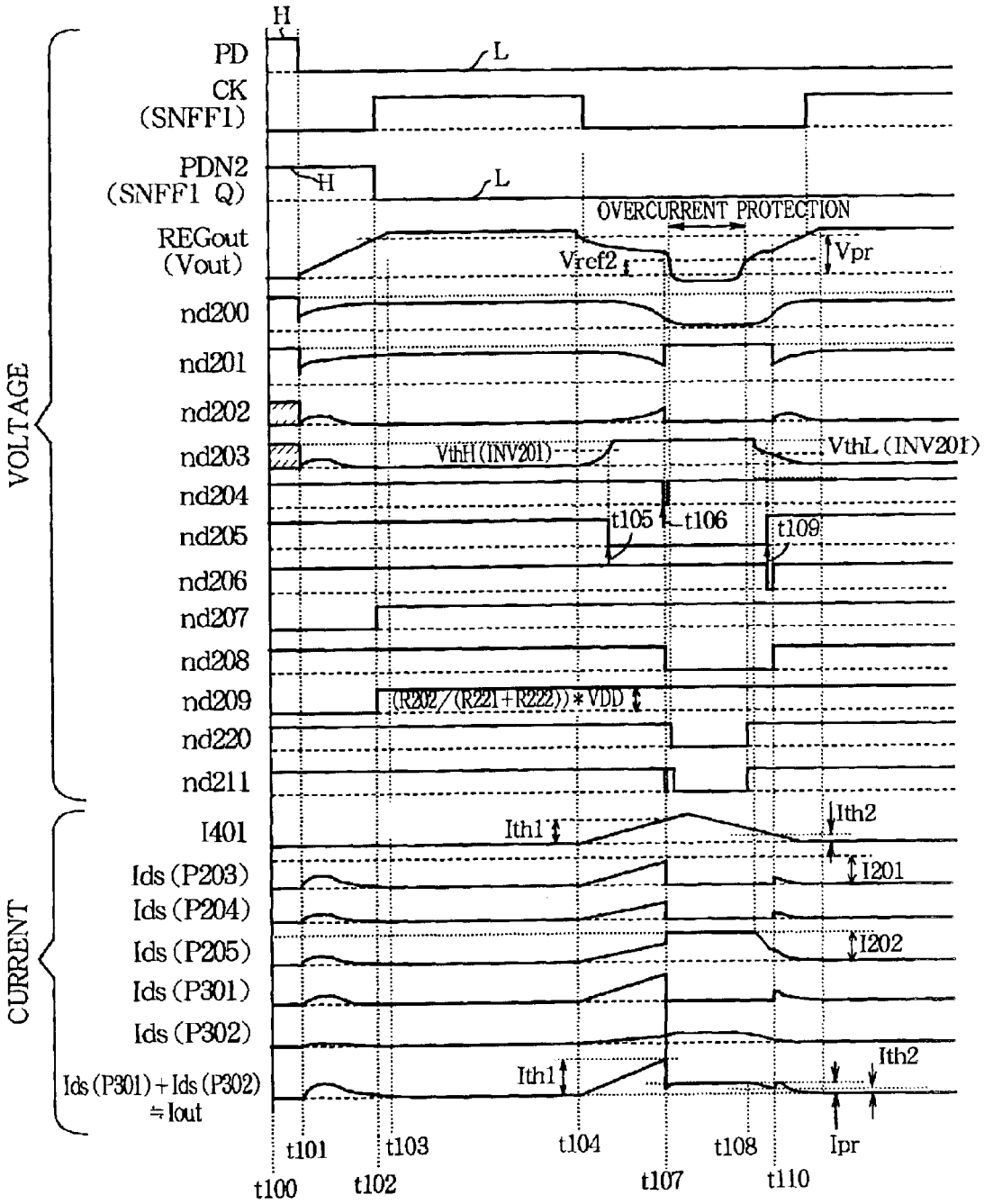
FIG. 18 is a timing chart illustrating the operation of the voltage regulator circuit (mainly the operation of the output current monitoring circuit) according to the fourth embodiment.
Figure 19:
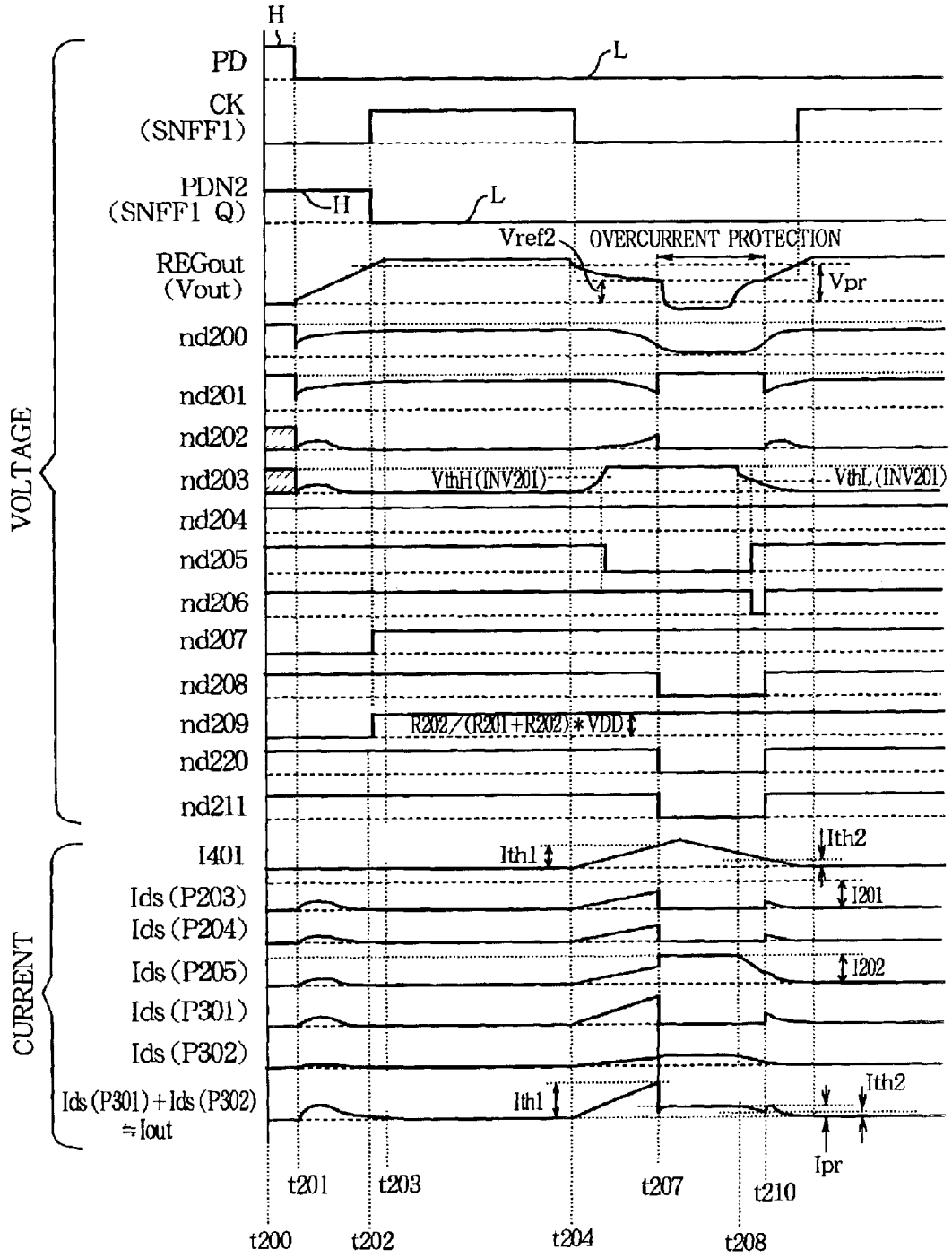
FIG. 19 is a timing chart illustrating the operation of the voltage regulator circuit (mainly the operation of the output voltage monitoring circuit) according to the fourth embodiment.

Next, the voltage regulator circuit according to the fourth embodiment will now be described in detail. FIG. 17 is a circuit diagram showing the detailed structure of the voltage regulator circuit according to the fourth embodiment. FIG. 18 and FIG. 19 are timing charts illustrating the operation of the voltage regulator circuit according to the fourth embodiment, FIG. 18 mainly illustrating the operation of the output current monitoring circuit 242 and FIG. 19 mainly illustrating the operation of the output voltage monitoring circuit 241. In FIG. 17, elements that are the same as or correspond to elements in FIG. 3 (first embodiment) or FIG. 9 (second embodiment) are indicated by the same reference characters. The voltage regulator circuit according to the fourth embodiment can be manufactured as a semiconductor integrated circuit device 4.

The overcurrent protective circuit 24 shown in FIG. 17 includes a MOS transfer gate switch SW201 and a P-channel transistor P202. The MOS transfer gate switch SW201 makes or breaks a connection between the output node nd200 of the amplifier circuit 10 and the gate (that is, the node nd201) of the first P-channel transistor P301. The P-channel transistor P202 breaks or makes a connection between the power line PL and the gate (that is, the node nd201) of the first P-channel transistor P301. The overcurrent protective circuit 24 also includes an output voltage monitoring circuit 241 which monitors the regulator output voltage Vout from the regulator output terminal REGout, an output current monitoring circuit 242 which monitors the regulator output current Iout from the regulator output terminal REGout, and a switch control circuit 243 which controls the switch SW201 and the P-channel transistor P202 on the basis of the monitored regulator output voltage Vout and regulator output current Iout. The overcurrent protective circuit 24 further includes a P-channel transistor P201 connected between the power line PL and the node nd200 to which the control voltage V2 output from the amplifier circuit 10 is applied. The gate of the P-channel transistor P201 receives the inverted power-down signal PDN. The operations of the voltage regulator circuit during the power-down state and when changing to the non-power-down state are the same as those in the first or second embodiment.

The output current monitoring circuit 242 shown in FIG. 17 has the same structure and performs the same operation as the output current monitoring circuit 211 shown in FIG. 3 (first embodiment).

The output voltage monitoring circuit 241 shown in FIG. 17 has substantially the same structure and performs substantially the same operation as the output voltage monitoring circuit 221 shown in FIG. 9 (second embodiment) The output voltage monitoring circuit 241 shown in FIG. 17 differs from the output voltage monitoring circuit 221 shown in FIG. 9 just in that an inverter INV224 is provided instead of the NAND gate NA221 seen in FIG. 9.

The switch control circuit 243 shown in FIG. 17 has substantially the same structure and performs substantially the same operation as the switch control circuit 212 shown in FIG. 3 (first embodiment). The switch control circuit 243 shown in FIG. 17 differs from the switch control circuit 212 shown in FIG. 9 just in that an AND gate AN241 is provided in the switch control circuit 243 shown in FIG. 17. An input terminal of the AND gate AN241 is coupled to the output node nd204 of the output current monitoring circuit 242, and the other input terminal is coupled to the output node nd220 of the output voltage monitoring circuit 241. The output terminal of the AND gate AN241 is coupled to an input terminal of the NAND gate NA202.

The operation of the voltage regulator circuit according to the fourth embodiment will now be described with reference to FIG. 17, FIG. 18, and FIG. 19. The operation of the voltage regulator circuit according to the fourth embodiment during the power-down state, when changing to the non-power-down state, and during the normal operation state (a period from time t100 to time t104 in FIG. 18 or period from time t200 to time t204 in FIG. 19) is the same as that of the first or second embodiment.

The operation of the voltage regulator circuit according to the fourth embodiment shown in FIG. 18 when the regulator output current Iout from the regulator output terminal REGout increases and exceeds a first current threshold level Ith1 (a period from time t104 to time t110 in FIG. 18) is the same as that in the first embodiment.

The operation of the voltage regulator circuit according to the fourth embodiment shown in FIG. 19 when the regulator output voltage Vout from the regulator output terminal REGout decreases to a level lower than the reference voltage Vref2 (a period from time t204 to time t210 in FIG. 19) is the same as that in the second embodiment.

As has been described above, the voltage regulator circuit according to the fourth embodiment switches from the normal operation state to the overcurrent protection state when the regulator output current Iout from the regulator output terminal REGout is too large or when the regulator output voltage Vout from the regulator output terminal REGout falls below the reference voltage Vref2, so that the fourth embodiment produces the same effect as the first or second embodiment. Except for the above-mentioned respects, the fourth embodiment is the same as the first or second embodiment.

Modified Example of Fourth Embodiment

Figure 20:
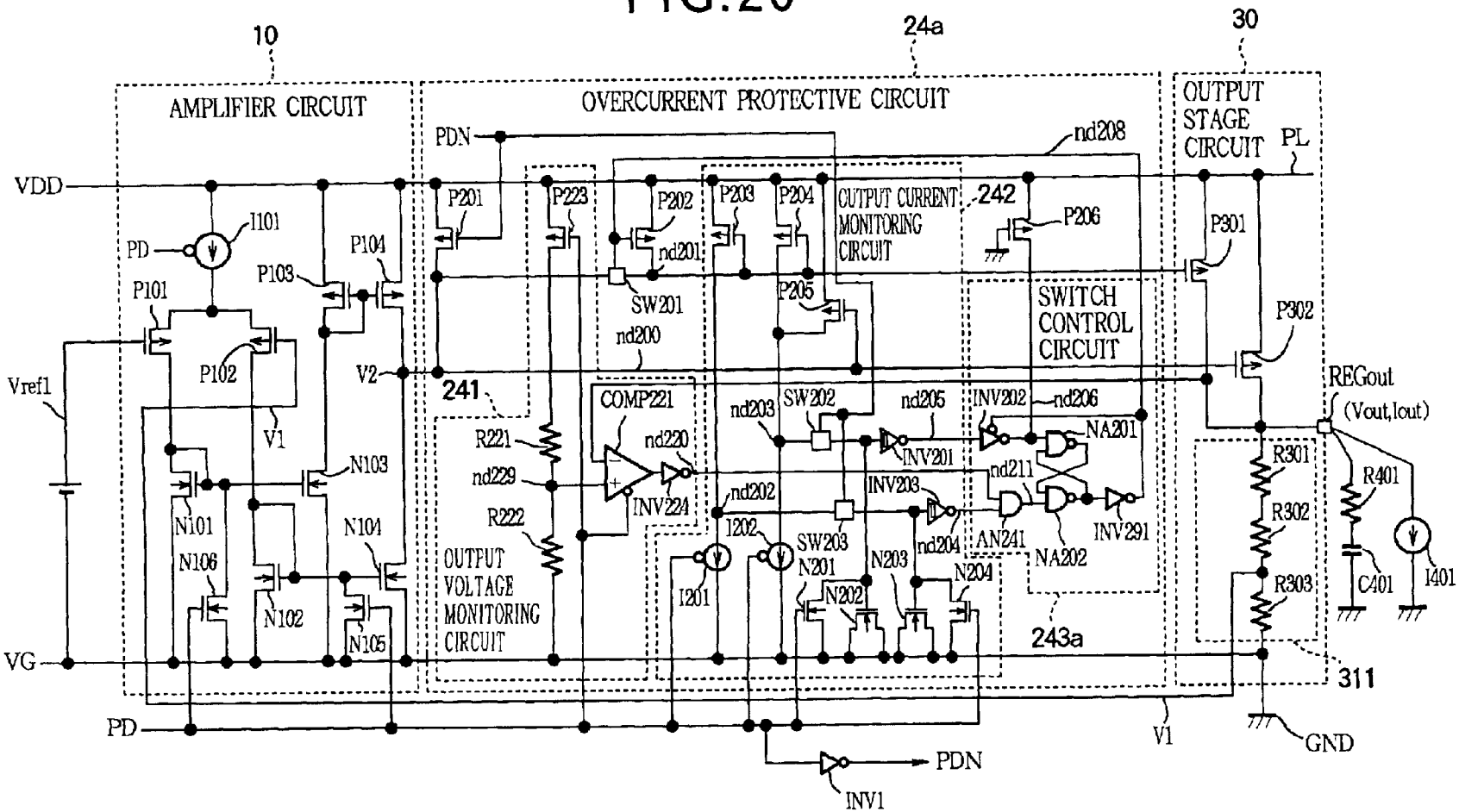
FIG. 20 is a circuit diagram showing the detailed structure of a modified example of the voltage regulator circuit according to the fourth embodiment.

FIG. 20 is a circuit diagram showing the detailed structure of a modified example of the voltage regulator circuit according to the fourth embodiment. In FIG. 20, elements that are the same as or correspond to elements in FIG. 17 are indicated by the same reference characters.

The voltage regulator circuit shown in FIG. 20 differs from the voltage regulator circuit shown in FIG. 17 in that a structure for speeding up the rise of the regulator output voltage Vout from the regulator output terminal REGout in the non-power-down state of the voltage regulator circuit is not provided. More specifically, the voltage regulator circuit shown in FIG. 20 does not have the comparator COMP1, the flip-flop circuit SNFF1, and the inverter INV2, which are seen in FIG. 17. In addition, the structure of the switch control circuit 243*a* in the overcurrent protective circuit 24*a* of the voltage regulator circuit shown in FIG. 20 differs from the structure of the switch control circuit 243 in the overcurrent protective circuit 24 of the voltage regulator circuit shown in FIG. 17. The overcurrent protective circuit 24*a* shown in FIG. 20 does not have the NAND gate NA221 shown in FIG. 17 and has an inverter INV291 instead. With the voltage regulator circuit shown in FIG. 20, the circuit structure can be simplified. Except for the above-mentioned respects, the voltage regulator circuit shown in FIG. 20 is the same as the voltage regulator circuit shown in FIG. 17.

Fifth Embodiment

Figure 21A:
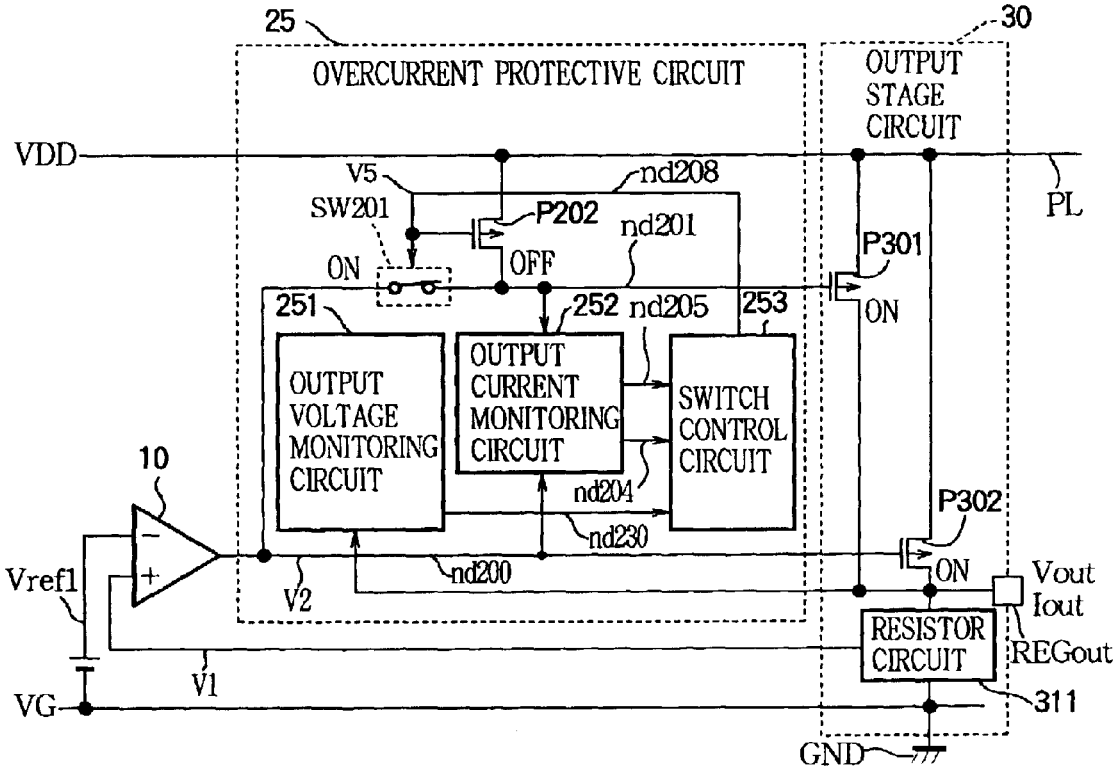
Figure 21B:
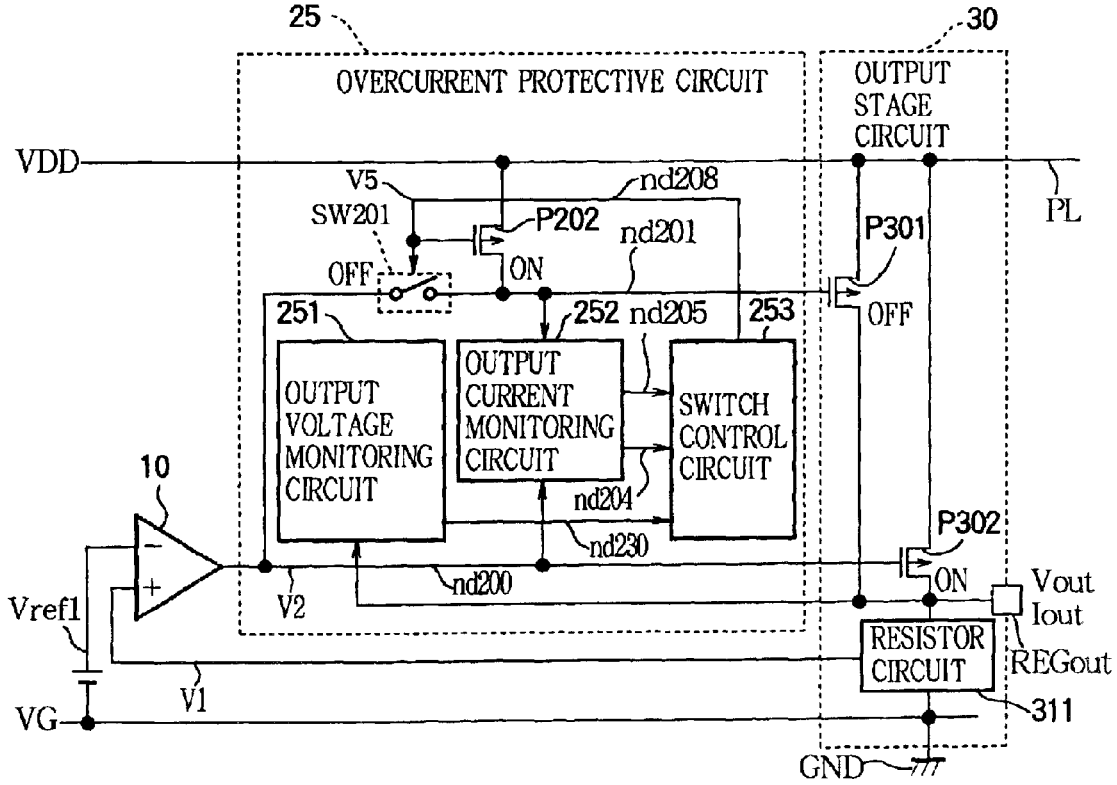

FIG. 21A and FIG. 21B are block diagrams schematically showing the structure of the voltage regulator circuit according to the fifth embodiment of the present invention. FIG. 21A illustrates the normal operation state in which a stabilized regulator output voltage Vout is supplied to an external load circuit. FIG. 21B illustrates the overcurrent protection state in which the regulator output current Iout is limited. In FIG. 21A and FIG. 21B, elements that are the same as or correspond to elements in FIG. 2A and FIG. 2B (first embodiment) or FIG. 12A and FIG. 12B (third embodiment) are indicated by the same reference characters.

As shown in FIG. 21A and FIG. 21B, the voltage regulator circuit according to the fifth embodiment mainly includes an amplifier circuit 10, an overcurrent protective circuit (or a short-circuit protective circuit) 25, and an output stage circuit 30. The amplifier circuit 10 and the output stage circuit 30 in the fifth embodiment have the same structure as those in the first embodiment.

The overcurrent protective circuit 25 shown in FIG. 21A and FIG. 21B includes a MOS transfer gate switch SW201 and a P-channel transistor P202. The MOS transfer gate switch SW201 makes or breaks a connection between the output node nd200 of the amplifier circuit 10 and the gate (that is, the node nd201) of the first P-channel transistor P301. The P-channel transistor P202 breaks or makes a connection between the power line PL and the gate (that is, the node nd201) of the first P-channel transistor P301. The overcurrent protective circuit 25 also includes an output voltage monitoring circuit 251 which monitors the regulator output voltage Vout from the regulator output terminal REGout, an output current monitoring circuit 252 which monitors the current Ids (P301) flowing through the first P-channel transistor P301 and the current Ids (P302) flowing through the second P-channel transistor P302, thereby monitoring the regulator output current Iout, which substantially equals to Ids (P301)+Ids (P302), and a switch control circuit 253 which controls the switch SW201 and the P-channel transistor P202 on the basis of the monitored voltage and current.

An outline of the operation of the voltage regulator circuit according to the fifth embodiment will now be described. In the normal operation state illustrated in FIG. 21A, the control voltage V5 output from the switch control circuit 253 to the node nd208 turns on the switch SW201 and turns off the P-channel transistor P202. In the meantime, the first P-channel transistor P301 and second P-channel transistor P302 in the output stage circuit 30 are controlled by the control voltage V2 output from the amplifier circuit 10 to the node nd200; the regulator output current Iout is supplied to the external load circuit (not shown in FIGS. 21A and 21B) via either the first P-channel transistor P301 or second P-channel transistor P302; and the regulator output voltage Vout is maintained at a stable level.

If the regulator output current Iout monitored by the output current monitoring circuit 252 exceeds a first current threshold level Ith1 (shown in FIG. 23) in the normal operation state illustrated in FIG. 21A, the overcurrent protective circuit 25 switches the output stage circuit 30 to the overcurrent protection state illustrated in FIG. 21B. When the switch to the overcurrent protection state illustrated in FIG. 21B is made, the switch control circuit 253 brings its output node nd208 to a low level, turns off the switch SW201, and turns on the P-channel transistor P202. Then, the voltage at the gate of the first P-channel transistor P301 in the output stage circuit 30 (that is, the node nd201) is pulled up to a high level close to the power supply voltage VDD of the power line PL; the first P-channel transistor P301 is turned off; and the current Ids (P302) passing through the second P-channel transistor P302 is supplied to the external load circuit as the regulator output current Iout. Therefore, a current not larger than the maximum permissible current Ipr (shown in FIG. 23) determined by the current output characteristics of the second P-channel transistor P302 becomes the regulator output current Iout in the overcurrent protection state, and an overcurrent will not flow from the regulator output terminal REGout to the external load circuit.

If the regulator output current Iout monitored by the output current monitoring circuit 252 falls below a second current threshold level Ith2 (shown in FIG. 23) in the overcurrent protection state illustrated in FIG. 21B, the overcurrent protective circuit 25 switches the output stage circuit 30 to the normal operation state illustrated in FIG. 21A. When the switch to the normal operation state illustrated in FIG. 21A is made, the switch control circuit 253 brings the node nd208 to a high level, turns on the switch SW201, and turns off the P-channel transistor P202. Then, both the first P-channel transistor P301 and the second P-channel transistor P302 of the output stage circuit 30 are controlled by the control voltage V2 output from the amplifier circuit 10 to the node nd200; the regulator output current Iout supplied via either the first P-channel transistor P301 or the second P-channel transistor P302 flows out from the regulator output terminal REGout to the external load circuit; and the regulator output voltage Vout is kept to a stable level.

If the regulator output voltage Vout monitored by the output voltage monitoring circuit 251 exceeds a certain reference voltage (shown in FIG. 24) in the normal operation state illustrated in FIG. 21A, the overcurrent protective circuit 25 switches the output stage circuit 30 to the overcurrent protection state illustrated in FIG. 21B. When the switch to the overcurrent protection state illustrated in FIG. 21B is made, the switch control circuit 253 brings its output node nd208 to a low level, turns off the switch SW201, and turns on the P-channel transistor P202. Then, the voltage at the gate of the first P-channel transistor P301 of the output stage circuit 30 (that is, the node nd201) is pulled up to a high level close to the power supply voltage VDD; the first P-channel transistor P301 is turned off; and the current Ids (P302) passing through the second P-channel transistor P302 is supplied to the external load circuit as the regulator output current Iout. Therefore, a current not larger than the maximum permissible current Ipr (shown in FIG. 24) determined by the current output characteristics of the second P-channel transistor P302 becomes the regulator output current Iout in the overcurrent protection state, and an overcurrent will not flow from the regulator output terminal REGout to the external load circuit.

If the regulator output voltage Vout monitored by the output current monitoring circuit 251 exceeds the reference voltage in the overcurrent protection state illustrated in FIG. 21B, the overcurrent protective circuit 25 switches the output stage circuit 30 to the normal operation state illustrated in FIG. 21A. When the switch to the normal operation state illustrated in FIG. 21A is made, the switch control circuit 253 brings the node nd208 to a high level, turns on the switch SW201, and turns off the P-channel transistor P202. Then, both the first P-channel transistor P301 and the second P-channel transistor P302 of the output stage circuit 30 are controlled by the control voltage V2 output from the amplifier circuit 10 to the node nd200; the regulator output current Iout is supplied to the external load circuit via either the first P-channel transistor P301 or second P-channel transistor P302; and the regulator output voltage Vout is kept at a stable level.

Figure 22:
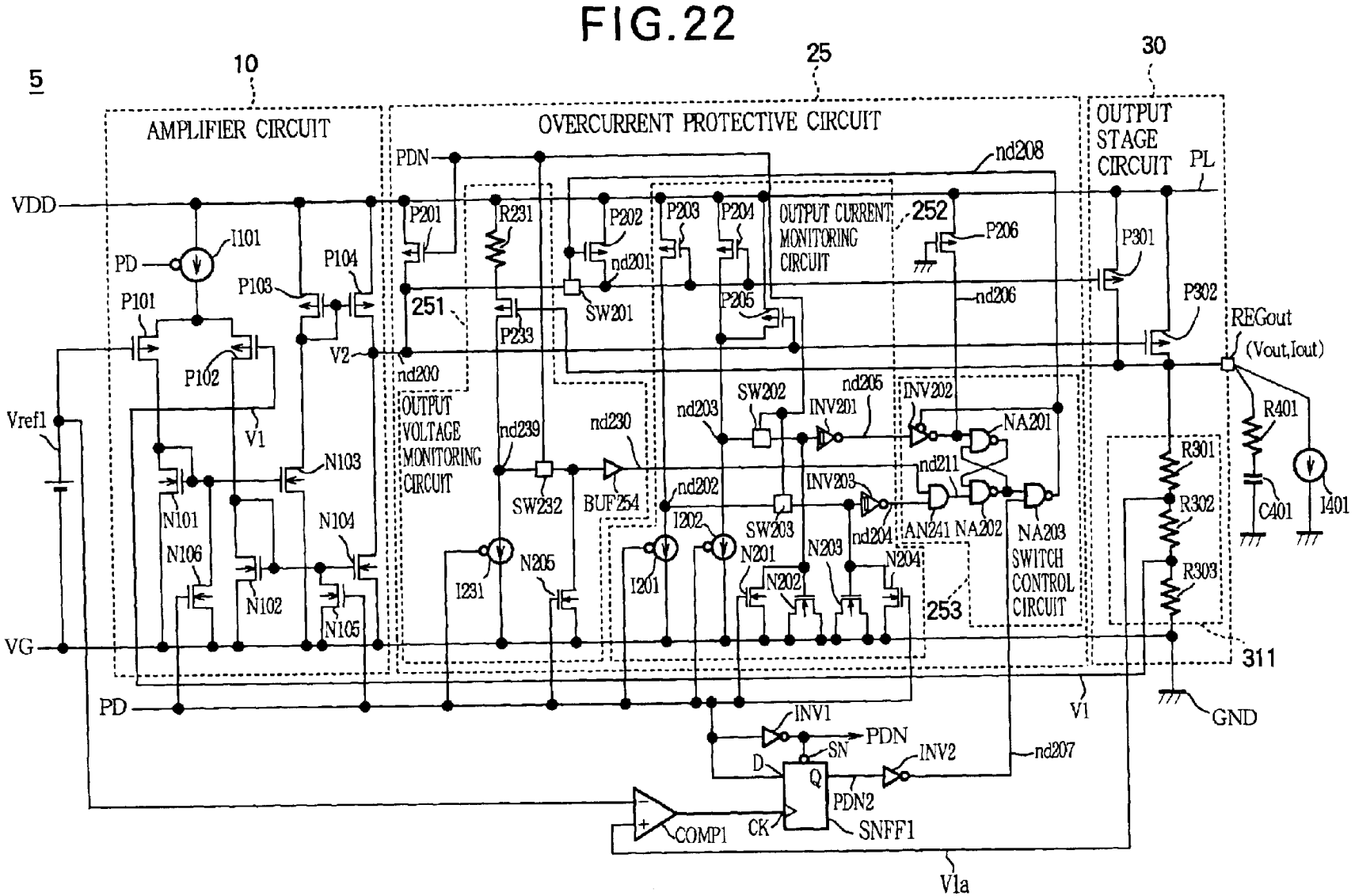
FIG. 22 is a circuit diagram showing the detailed structure of the voltage regulator circuit according to the fifth embodiment.
Figure 23:
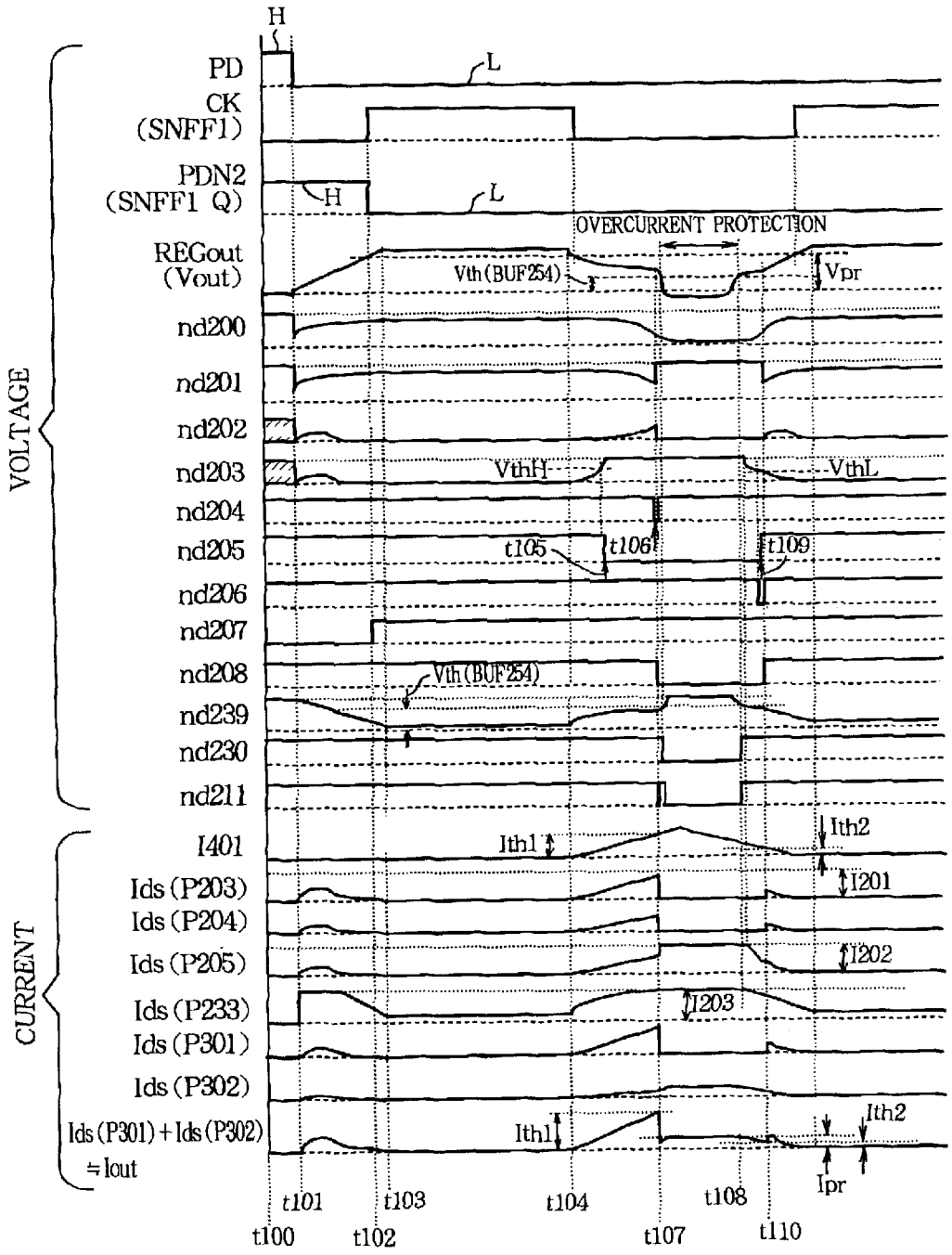
FIG. 23 is a timing chart illustrating the operation of the voltage regulator circuit (mainly the operation of the output current monitoring circuit) according to the fifth embodiment.
Figure 24:
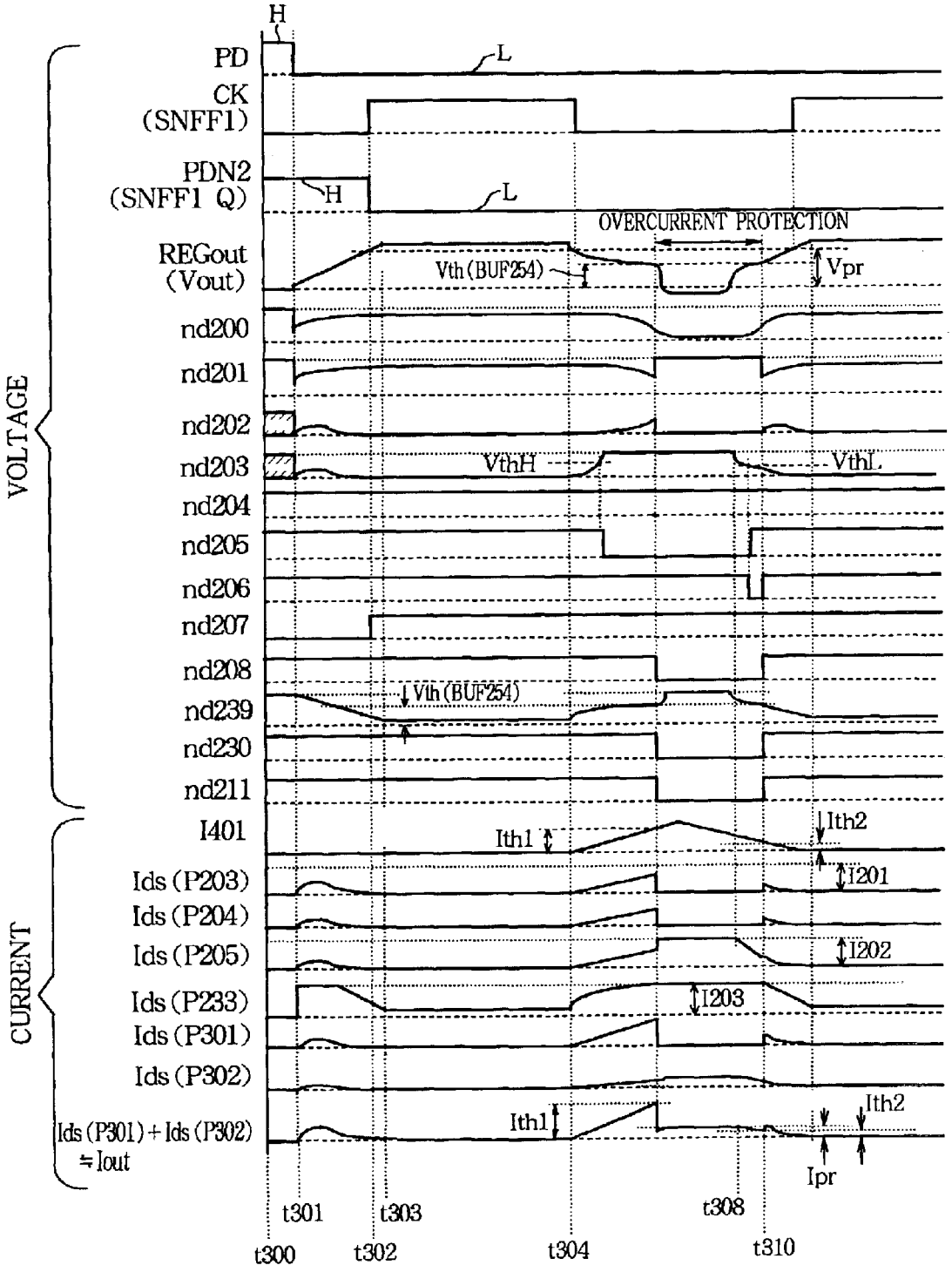
FIG. 24 is a timing chart illustrating the operation of the voltage regulator circuit (mainly the operation of the output voltage monitoring circuit) according to the fifth embodiment.

Next, the voltage regulator circuit according to the fifth embodiment will now be described in detail. FIG. 22 is a circuit diagram showing the detailed structure of the voltage regulator circuit according to the fifth embodiment. FIG. 23 and FIG. 24 are timing charts illustrating the operation of the voltage regulator circuit according to the fifth embodiment, FIG. 23 mainly illustrating the operation of the output current monitoring circuit 252 and FIG. 24 mainly illustrating the operation of the output voltage monitoring circuit 251. In FIG. 22, elements that are the same as or correspond to elements in FIG. 3 (first embodiment) or FIG. 17 (third embodiment) are indicated by the same reference characters. The voltage regulator circuit according to the fifth embodiment can be manufactured as a semiconductor integrated circuit device 5.

The overcurrent protective circuit 25 shown in FIG. 22 includes a MOS transfer gate switch SW201 and a P-channel transistor P202. The MOS transfer gate switch SW201 makes or breaks a connection between the output node nd200 of the amplifier circuit 10 and the gate (that is, the node nd201) of the first P-channel transistor P301. The P-channel transistor P202 breaks or makes a connection between the power line PL and the gate (that is, the node nd201) of the first P-channel transistor P301. The overcurrent protective circuit 25 also includes an output voltage monitoring circuit 251 which monitors the regulator output voltage Vout from the regulator output terminal REGout, an output current monitoring circuit 252 which monitors the regulator output current Iout from the regulator output terminal REGout, and a switch control circuit 253 which controls the switch SW201 and the P-channel transistor P202 on the basis of the monitored regulator output voltage Vout and regulator output current Iout. The overcurrent protective circuit 25 further includes a P-channel transistor P201 connected between the power line PL and the node nd200 to which the control voltage V2 output from the amplifier circuit 10 is applied. The gate of the P-channel transistor P201 receives the inverted power-down signal PDN. The operations of the voltage regulator circuit in the power-down state and in the non-power-down state are the same as those in the first or third embodiment.

The output current monitoring circuit 252 shown in FIG. 22 has the same structure and performs the same operation as the output current monitoring circuit 211 shown in FIG. 3 (first embodiment).

The output voltage monitoring circuit 251 shown in FIG. 22 has substantially the same structure and performs substantially the same operation as the output voltage monitoring circuit 231 shown in FIG. 13 (third embodiment). The output voltage monitoring circuit 251 shown in FIG. 22 differs from the output voltage monitoring circuit 231 shown in FIG. 13 just in that the inverters INV231 and INV232 and the NAND gate NA231 seen in FIG. 13 are not provided and a buffer BUF254 is provided instead. In the fifth embodiment, when the regulator output voltage Vout decreases below the threshold voltage Vth (BUF254) of the buffer BUF254, the voltage regulator circuit enters from the normal operation status to the overcurrent protection status. In addition, when the regulator output voltage Vout exceeds the threshold voltage Vth (BUF254) of the buffer BUF254, the voltage regulator circuit returns from the overcurrent protection status to the normal operation status.

The switch control circuit 253 shown in FIG. 22 has substantially the same structure and performs substantially the same operation as the switch control circuit 212 shown in FIG. 3 (first embodiment). The switch control circuit 241 shown in. FIG. 22 differs from the switch control circuit 212 shown in FIG. 3 just in that an AND gate AN241 is provided in the switch control circuit 253 shown in FIG. 22. An input terminal of the AND gate AN241 is coupled to the output node nd204 of the output current monitoring circuit 252, and the other input terminal is coupled to the output node 220 of the output voltage monitoring circuit 251. The output terminal of the AND gate AN241 is coupled to an input terminal of the NAND gate NA202.

The operation of the voltage regulator circuit according to the fifth embodiment will now be described with reference to FIG. 22, FIG. 23, and FIG. 24. The operation of the voltage regulator circuit according to the fifth embodiment during its power-down state, when entering its non-power-down state, and during the normal operation state (a period from time t100 to time t104 in FIG. 23 or period from time t300 to time t304 in FIG. 24) is the same as that of the first or third embodiment.

As shown in FIG. 23, the operation of the voltage regulator circuit according to the fifth embodiment when the regulator output current Iout increases and exceeds a first current threshold level Ith1 (a period from time t104 to time t110 in FIG. 23) is the same as that in the first embodiment.

As shown in FIG. 24, the operation of the voltage regulator circuit according to the fifth embodiment when the regulator output voltage Vout decreases to a level lower than the reference voltage (a period from time t304 to time t310 in FIG. 24) is the same as that in the third embodiment.

As has been described above, the voltage regulator circuit according to the fifth embodiment switches from the normal operation state to the overcurrent protection state when the regulator output current Iout from the regulator output terminal REGout is too large or when the regulator output voltage Vout from the regulator output terminal REGout falls below the reference voltage, so that the fifth embodiment produces the same effect as the first or third embodiment. Except for the above-mentioned respects, the fifth embodiment is the same as the first or third embodiment.

Modified Example of Fifth Embodiment

Figure 25:
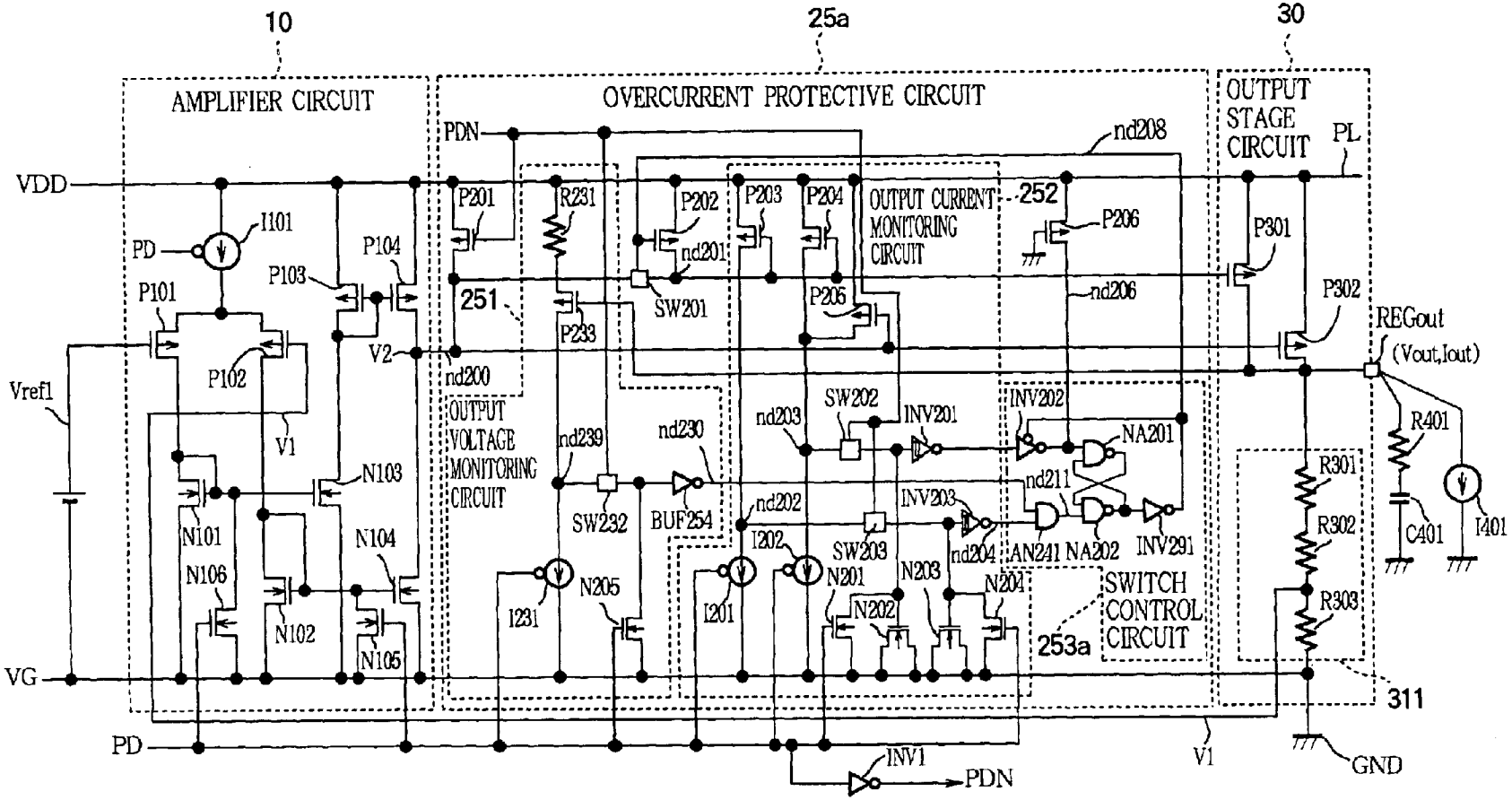
FIG. 25 is a circuit diagram showing the detailed structure of a modified example of the voltage regulator circuit according to the fifth embodiment.

FIG. 25 is a circuit diagram showing the detailed structure of a modified example of the voltage regulator circuit according to the fifth embodiment. In FIG. 25, elements that are the same as or correspond to elements in FIG. 22 are indicated by the same reference characters.

The voltage regulator circuit shown in FIG. 25 differs from the voltage regulator circuit shown in FIG. 22 in that a structure for speeding up the rise of the regulator output voltage Vout from the regulator output terminal REGout in the non-power-down state of the voltage regulator circuit is not provided. More specifically, the voltage regulator circuit shown in FIG. 25 does not have the comparator COMP1, the flip-flop circuit SNFF1, and the inverter INV2, which are seen in FIG. 22. In addition, the structure of the switch control circuit 253*a* in the overcurrent protective circuit 25*a* of the voltage regulator circuit shown in FIG. 25 differs from the structure of the switch control circuit 253 in the overcurrent protective circuit 25 of the voltage regulator circuit shown in FIG. 22. The overcurrent protective circuit 25*a* shown in FIG. 25 does not have the NAND gate NA221 shown in FIG. 22 and has an inverter INV291 instead. With the voltage regulator circuit shown in FIG. 25, the circuit structure can be simplified. Except for the above-mentioned respects, the voltage regulator circuit shown in FIG. 25 is the same as the voltage regulator circuit shown in FIG. 22.

Sixth Embodiment

Figure 26A:
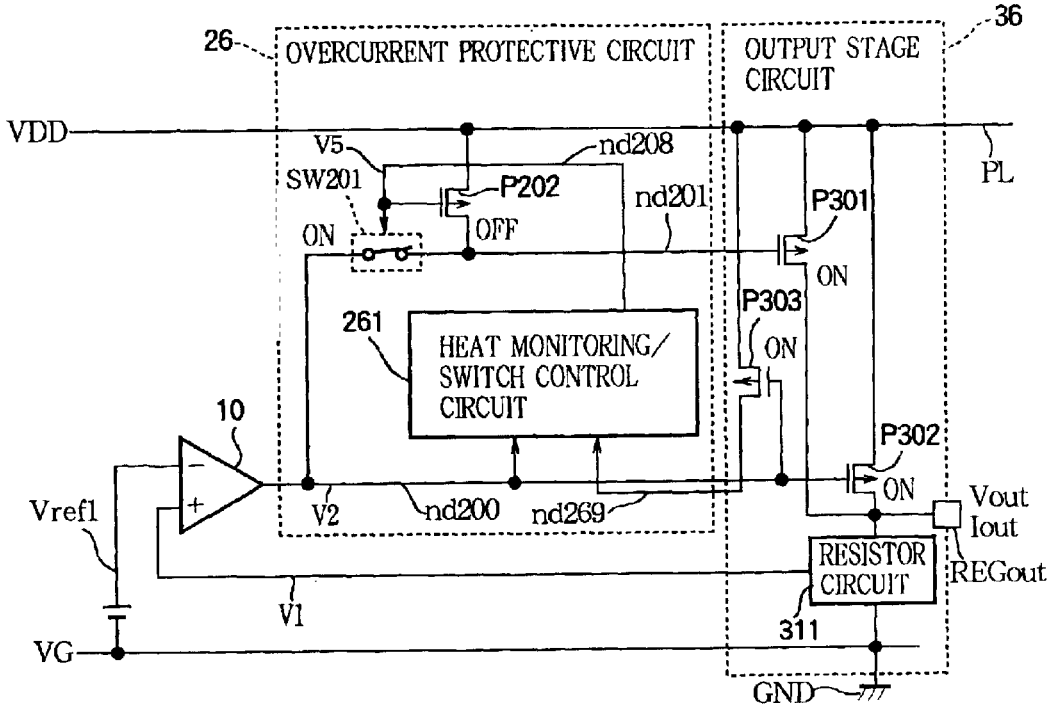
Figure 26B:
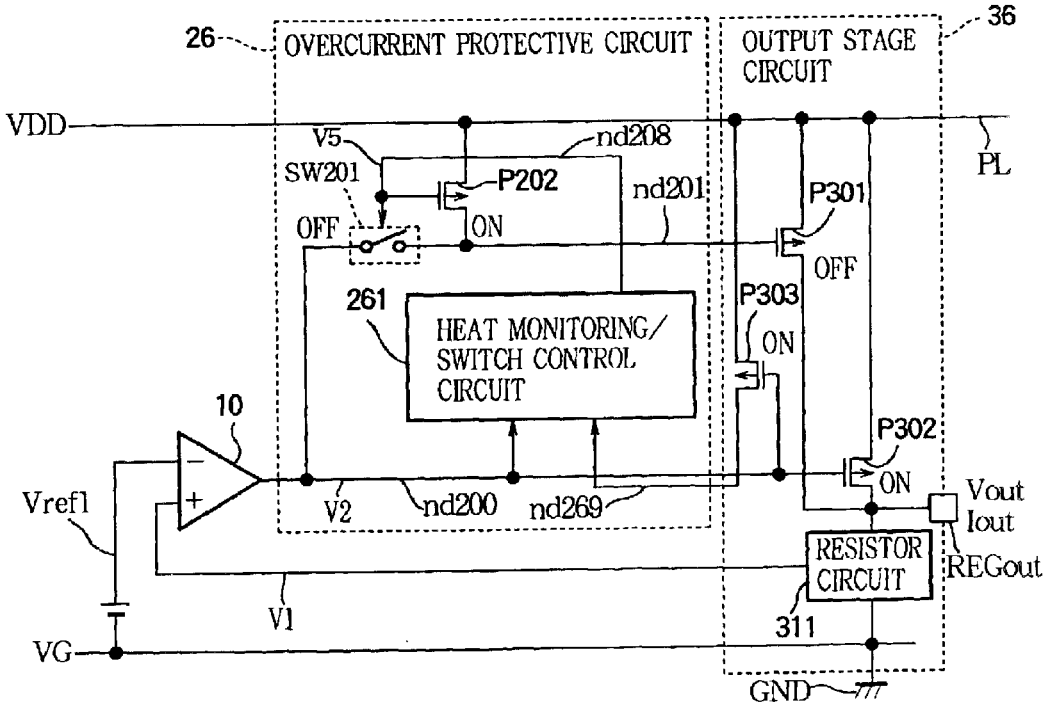

FIG. 26A and FIG. 26B are block diagrams schematically showing the structure of the voltage regulator circuit according to the sixth embodiment of the present invention. FIG. 26A illustrates the normal operation state in which a stabilized regulator output voltage Vout is supplied to an external load circuit. FIG. 26B illustrates the overcurrent protection state in which the regulator output current Iout is limited. In FIG. 26A and FIG. 26B, elements that are the same as or correspond to elements in FIG. 2A and FIG. 2B (first embodiment) are indicated by the same reference characters.

As shown in FIG. 26A and FIG. 26B, the voltage regulator circuit according to the sixth embodiment mainly includes an amplifier circuit 10, an overcurrent protective circuit (or a short-circuit protective circuit) 26, and an output stage circuit 36. The amplifier circuit 10 in the sixth embodiment has the same structure as that in the first embodiment.

The output stage circuit 36 shown in FIG. 26A differs from the output stage circuit 30 of the first embodiment in that a P-channel transistor P303 is provided as a heat (or temperature) sensing element. The P-channel transistor P303 has a source coupled to the power line PL, a gate coupled to the node nd200, and a drain (that is, the node nd269) coupled to a heat monitoring/switch control circuit 261. The P-channel transistor P303 is disposed near the first P-channel P301 and the second P-channel P302 used to supply the regulator output current Iout. If increase in the regulator output current Iout causes an excessively large current to flow through either the first P-channel transistor P301 or second P-channel transistor P302, thereby producing heat, the temperature of the P-channel transistor P303 rises, thereby decreasing the conductance gm thereof. Therefore, the regulator output current Iout can be monitored by detecting changes in conductance gm of the P-channel transistor P303.

The overcurrent protective circuit 26 shown in FIG. 26A and FIG. 26B includes a MOS transfer gate switch SW201 and a P-channel transistor P202. The MOS transfer gate switch SW201 makes or breaks a connection between the output node nd200 of the amplifier circuit 10 and the gate of the first P-channel transistor P301. The P-channel transistor P202 breaks or makes a connection between the power line PL and the gate (that is, the node nd201) of the first P-channel transistor P301. The overcurrent protective circuit 26 also includes a heat monitoring/switch control circuit 261 which monitors changes in conductance gm of the P-channel transistor P303 and controls the switch SW201 and P-channel transistor P202 in accordance with the monitored results.

An outline of the operation of the voltage regulator circuit according to the sixth embodiment will now be described. In the normal operation state illustrated in FIG. 26A, the control voltage V5 output from the heat monitoring/switch control circuit 261 turns on the switch SW201 and turns off the P-channel transistor P202. In the meantime, the first P-channel transistor P301 and second P-channel transistor P302 in the output stage circuit 36 are controlled by the control voltage V2 output from the amplifier circuit 10; the regulator output current Iout is supplied to the external load circuit (not shown in FIGS. 26A and 26B) via either the first P-channel transistor P301 or second P-channel transistor P302; and the regulator output voltage Vout is maintained at a stable level.

The overcurrent protective circuit 26 switches the output stage circuit 36 from the normal operation state illustrated in FIG. 26A to the overcurrent protection state illustrated in FIG. 26B, in accordance with changes in conductance gm of the P-channel transistor P303 monitored by the heat monitoring/switch control circuit 261. When the switch to the overcurrent protection state illustrated in FIG. 26B is made, the heat monitoring/switch control circuit 261 brings its output node nd208 to a low level, turns off the switch SW201, and turns on the P-channel transistor P202. Then, the voltage at the gate of the first P-channel transistor P301 of the output stage circuit 36 (that is, the node nd201) is pulled up to a high level close to the power supply voltage VDD; the first P-channel transistor P301 is turned off; and the regulator output current Iout is supplied to the external load circuit just via the second P-channel transistor P302. Therefore, a current not larger than the maximum permissible current Ipr determined by the current output characteristics of the second P-channel transistor P302 becomes the regulator output current Iout in the overcurrent protection state, and an overcurrent will not flow from the regulator output terminal REGout to the external load circuit.

If conductance gm of the P-channel transistor P303 monitored by the heat monitoring/switch control circuit 261 increases in the overcurrent protection state illustrated in FIG. 26B, the overcurrent protective circuit 26 switches the output stage circuit 36 to the normal operation state illustrated in FIG. 26A. When the switch to the normal operation state illustrated in FIG. 26A is made, the heat monitoring/switch control circuit 261 brings is output node nd208 to a high level, turns on the switch SW201, and turns off the P-channel transistor P202. Then, both the first P-channel transistor P301 and the second P-channel transistor P302 of the output stage circuit 36 are controlled by the control voltage V2 output from the amplifier circuit 10; the regulator output current Iout is supplied to the external load circuit via either the first P-channel transistor P301 or second P-channel transistor P302; and the regulator output voltage Vout is kept to a stable level.

Figure 27:
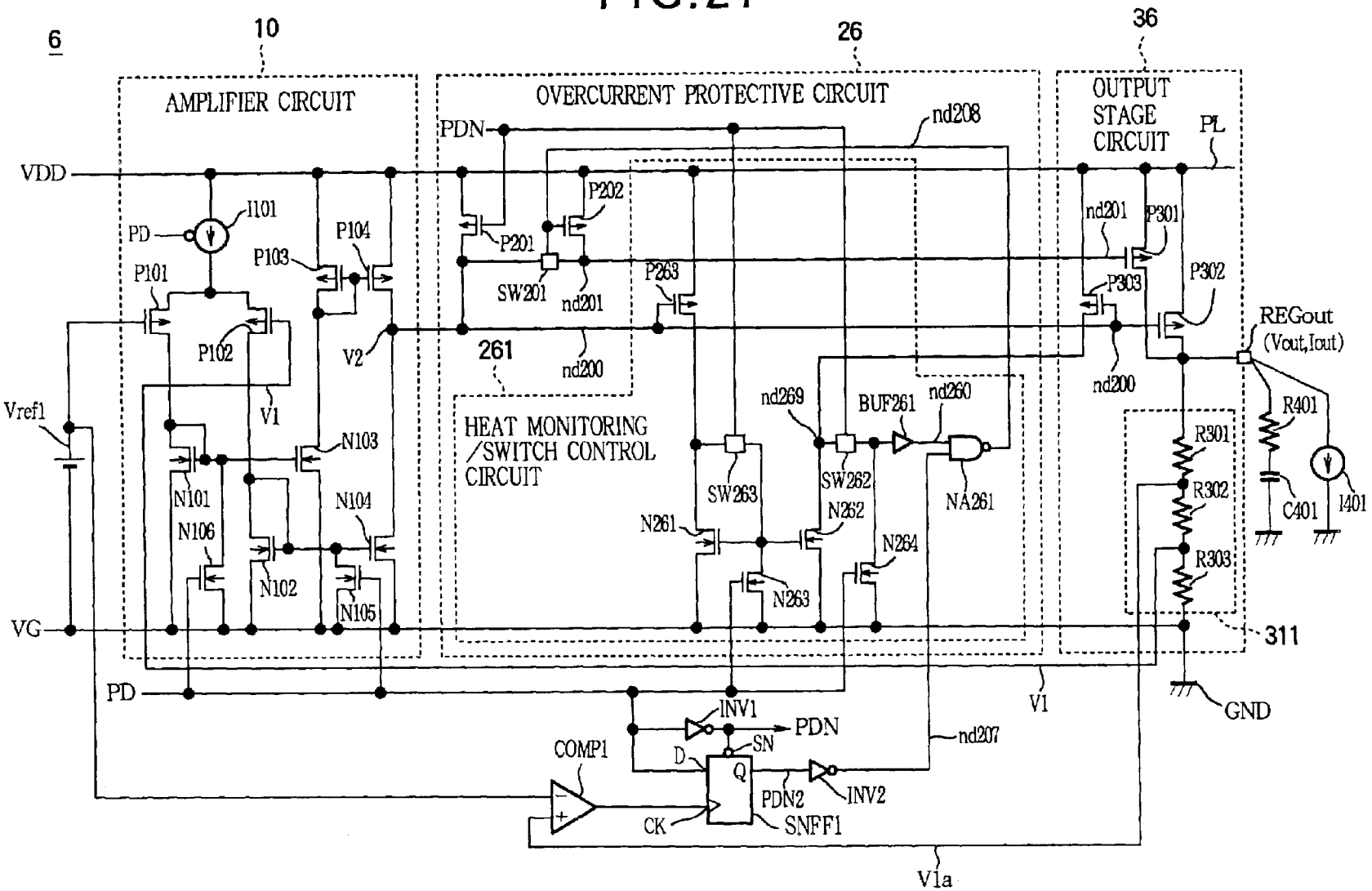
FIG. 27 is a circuit diagram showing the detailed structure of the voltage regulator circuit according to the sixth embodiment.
Figure 28:
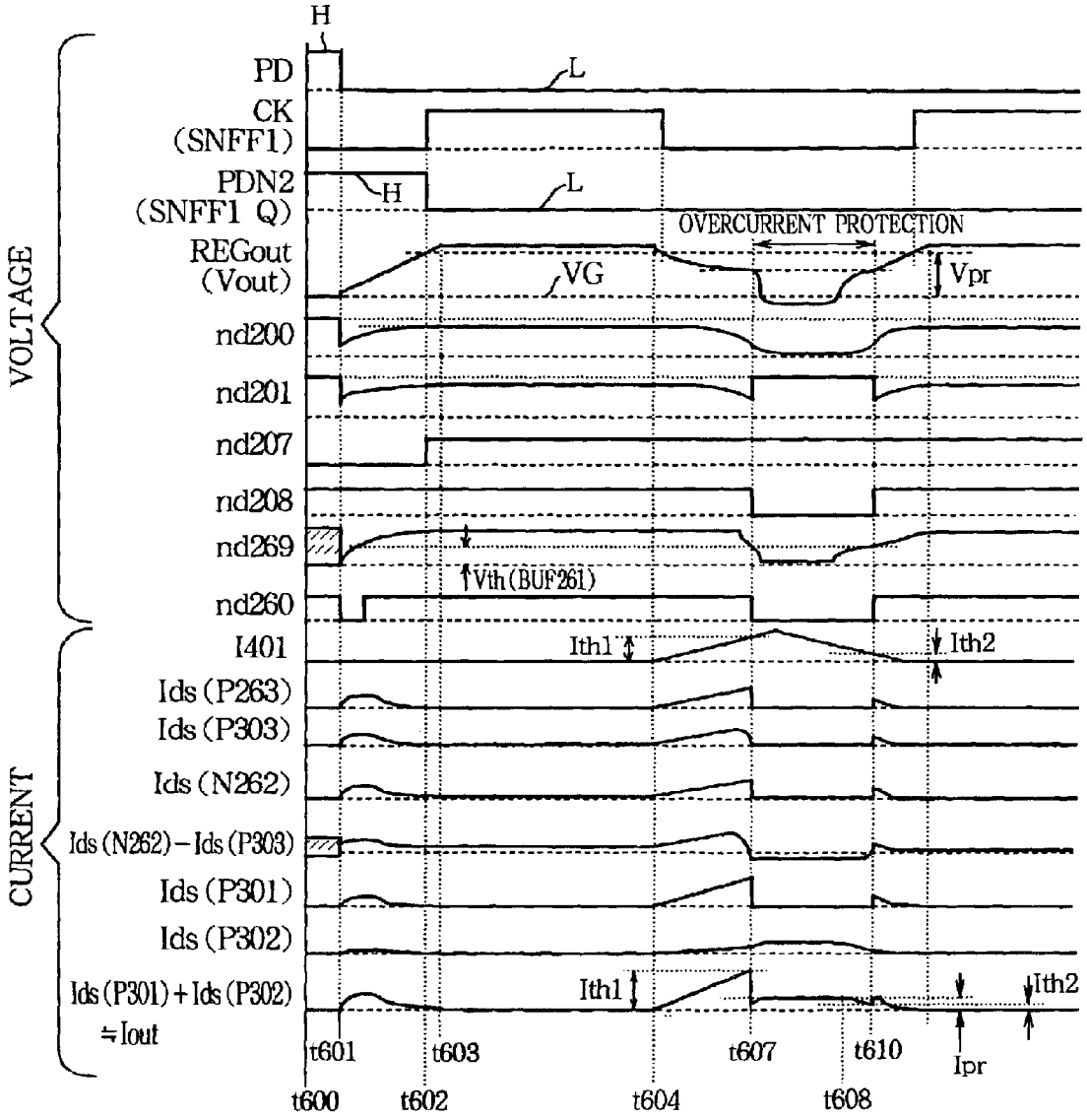
FIG. 28 is a timing chart illustrating the operation of the voltage regulator circuit according to the sixth embodiment.

Next, the voltage regulator circuit according to the sixth embodiment will now be described in detail. FIG. 27 is a circuit diagram showing the detailed structure of the voltage regulator circuit according to the sixth embodiment. FIG. 28 is a timing chart illustrating the operation of the voltage regulator circuit according to the sixth embodiment. In FIG. 27, elements that are the same as or correspond to elements in FIG. 3 (first embodiment) are indicated by the same reference characters. The voltage regulator circuit according to the sixth embodiment can be manufactured as a semiconductor integrated circuit device 6.

The overcurrent protective circuit 26 shown in FIG. 27 includes a MOS transfer gate switch SW201 and a P-channel transistor P202. The MOS transfer gate switch SW201 makes or breaks a connection between the output node nd200 of the amplifier circuit 10 and the gate (that is, the node nd201) of the first P-channel transistor P301. The P-channel transistor P202 breaks or makes a connection between the power line PL and the gate (that is, the node nd201) of the first P-channel transistor P301. The overcurrent protective circuit 26 also includes a heat monitoring/switch control circuit 261 which monitors changes in conductance gm of the P-channel transistor P303 and controls the switch SW201 and the P-channel transistor P202 in accordance with the monitored conductance gm. The overcurrent protective circuit 26 further includes a P-channel transistor P201, which is connected between the power line PL and the node nd200 to which the control voltage V2 output from the amplifier circuit 10 is applied. The gate of the P-channel transistor P201 receives the inverted power-down signal PDN. When the voltage regulator circuit is in the power-down state, the power-down signal PD is high; the inverted power-down signal PDN is low; the P-channel transistor P201 is in its on-state; the voltage at the nodes nd200 and nd201 is pulled up to the level of the power supply voltage VDD; the first P-channel transistor P301 and the second P-channel transistor P302 are in off-state; and the output stage circuit 36 enters the deactivated state. When the voltage regulator circuit enters the non-power-down state, the inverted power-down signal PDN is high; the P-channel transistor P201 is turned off; the voltage at the nodes nd200 and nd201 matches the control voltage V2 output from the amplifier circuit 10; the first P-channel transistor P301 and second P-channel transistor P302 are turned on; and the output stage circuit 36 enters the activated state.

The heat monitoring/switch control circuit 261 shown in FIG. 27 includes a P-channel transistor P263, which has a source coupled to the power line PL and a gate coupled to the output node nd200 of the amplifier circuit 10. The drain of the P-channel transistor P263 is coupled to the drain of an N-channel transistor N261. The N-channel transistor N261 has a gate coupled to the gate of an N-channel transistor N262. The N-channel transistors N261 and N262 forms a current mirror circuit. The N-channel transistors N261 and N262 have a source coupled to the ground GND. A MOS transfer gate switch SW263 is coupled between the gate and drain of the N-channel transistor N261 and makes a connection between the gate and drain in the non-power-down state. An N-channel transistor N263 is coupled between the ground GND and a connection node between the gate of the N-channel transistor N261 and the gate of the N-channel transistor N262. The N-channel transistor N263 pulls down the gate of the N-channel transistors N261 and N262 to the ground voltage VG in the power-down state of the voltage regulator circuit. The drain of the N-channel transistor N262 is coupled to the drain of the P-channel transistor P303 in the output stage circuit 36 (that is, the node nd269). The node nd269 coupled to the P-channel transistor P303 is coupled to an end of the MOS transfer gate switch SW262. The other end of the switch SW262 is coupled to the input terminal of the buffer BUF261. An N-channel transistor N264 is coupled between the ground GND and the connection node between the switch SW262 and buffer BUF261. The N-channel transistor N264 pulls down the input terminal of the buffer BUF261 to the ground voltage VG in the power-down state. The heat monitoring/switch control circuit 261 has a NAND gate NA261, which receives the output voltage of the buffer BUF261 and the voltage at the node nd207 and outputs the control voltage V5 to the output node nd208 of the heat monitoring/switch control circuit 261. The NAND gate NA261 keeps the overcurrent protective circuit 26 from starting its operation until the regulator output voltage Vout reaches a predetermined level in the non-power-down state of the voltage regulator circuit (until time t602 shown in FIG. 28).

The operation of the voltage regulator circuit according to the sixth embodiment will now be described in detail, with reference to FIG. 27 and FIG. 28. In the power-down state between time t600 and time t601 in FIG. 28, the power-down signal PD is high; the voltage regulator circuit is in the power-down state; the voltage regulator circuit is disabled; and the regulator output terminal REGout outputs the ground voltage VG. Because the terminal SN of the flip-flop circuit SNFF1 receives the inverted power-down signal PDN, that is, a low level signal from the inverter INV1, the signal PDN2 output from the terminal Q of the flip-flop circuit SNFF1 is high; the input node nd207 of the NAND gate NA221 receives a low voltage from the inverter INV2; and the output node nd208 of the heat monitoring/switch control circuit 261 outputs a high voltage.

When the power-down signal PD is brought to a low level at time t601 in FIG. 28, the voltage regulator circuit enters the non-power-down state, and the regulator output voltage Vout from the regulator output terminal REGout starts increasing. The flip-flop circuit SNFF1 is reset at time t601 by a high voltage input to the terminal SN, a low voltage is input to the input terminal D, and no clock is supplied to the terminal CK, so that the output signal PDN2 of the flip-flop circuit SNFF1 is kept high. In the meantime, the node nd207 is low, the node nd208 is high, the switch SW201 is in its on-state, and the P-channel transistor P202 is in its off-state, in the overcurrent protective circuit 26. Accordingly, the output node nd200 of the amplifier circuit 10 and the output node nd201 of the overcurrent protective circuit 26 are at the same voltage.

When the voltage regulator circuit starts operating, the rise in the regulator output voltage Vout from the regulator output terminal REGout can be sped up by allowing a large current to flow through either the first P-channel transistor P301 or second P-channel transistor P302 in the output stage circuit 30 (that is, disabling overcurrent protection) for a very short period. To enable this, the overcurrent protective circuit 26 is disabled during the period from time t601 to time t602 in FIG. 10, by bringing the node nd207 to a low level and keeping the output node nd208 of the heat monitoring/switch control circuit 261 high.

When the regulator output voltage Vout exceeds a predetermined level Vpr, where $Vpr=((R301+R302+R303)/(R302+R303))*Vref1,$ (at time t602 in FIG. 28), the output of the comparator COMP1 goes from high to low; a low-to-high clock is supplied to the terminal CK of the flip-flop circuit SNFF1; the output signal PDN2 of the flip-flop circuit SNFF1 goes from high to low; and the voltage at the node nd207 goes from low to high. Accordingly, the overcurrent protective circuit 26 starts monitoring the operation of output overcurrent protection at time t602, as shown in FIG. 28.

If an external load circuit (including a resistor R401, a capacitor C401, and a current source I401, for instance) is connected to the regulator output terminal REGout, a regulator output current Iout supplied via either the first P-channel transistor P301 or second P-channel transistor P302 in the output stage circuit 36 flows out from the regulator output terminal REGout. Then, the regulator output voltage Vout, which varies depending on the output voltage—output current characteristics (VI characteristics) of the voltage regulator circuit, starts decreasing depending on the increase of the regulator output current Iout.

A current Ids (P303) proportional to the dimension ratio between the P-channel transistors P302 and P303 flows through the P-channel transistor P303 in the output stage circuit 36. The gate of the P-channel transistor P303 is coupled to the node nd200 connected to the gate of the second P-channel transistor P302 in the output stage circuit 36. A current Ids (P263) proportional to the dimension ratio between the P-channel transistors P302 and P263 flows through the P-channel transistor P263 in the heat monitoring/switch control circuit 261. The gate of the P-channel transistor P263 is coupled to the node nd200 connected to the gate of the second P-channel transistor P302 in the output stage circuit 36. The current Ids (P263) flows through the N-channel transistor N261, and the current Ids (N262) multiplied by the current mirror ratio between the N-channel transistors N261 and N262 flow through the N-channel transistor N262. If the dimension ratio between the P-channel transistors P263 and P302 is 1 or smaller or if the current mirror ratio between the N-channel transistors N261 and N262 is 1 or smaller, the value of the current Ids (N262) becomes smaller than the value of the current Ids (P303). Accordingly, the voltage at the connection node nd269 between the drain of the P-channel transistor P303 in the output stage circuit 36 and the N-channel transistor N262 becomes the nower suoolv voltaae VDD.

If increase in the regulator output current Iout from the regulator output terminal REGout causes an overcurrent to flow through either the first P-channel transistor P301 or second P-channel transistor P302, the second P-channel transistor P302 in the output stage circuit 36 produces heat due to excessive power consumption. If the P-channel transistor P303 is disposed in the vicinity of the first P-channel transistor P301 and/or second P-channel transistor P302, the temperature of the P-channel transistor P303 rises, decreasing the conductance gm of the P-channel transistor P303 and the ratio of current Ids (P303) to current Ids (N262). Accordingly, the voltage at the connection node nd269 between the drain of the P-channel transistor P303 and the N-channel transistor N262 falls below the power supply voltage VDD. If the voltage at the node nd269 falls below the threshold voltage Vth (BUF261) of the buffer BUF261, the output of the buffer BUF261 goes low (at time t607); the output node nd208 of the heat monitoring/switch control circuit 261 goes low; the switch SW201 is turned off; the P-channel transistor P202 is turned on; and the output node nd201 of the overcurrent protective circuit 26 is pulled up to the power supply voltage VDD. Pulling up the node nd201 to the power supply voltage VDD turns off the first P-channel transistor P301 in the output stage circuit 36. Then, the current Ids (P302) flowing through the second P-channel transistor P302 becomes the regulator output current Iout, of which value is limited by the current output capability of the second P-channel transistor P302, and the regulator output voltage Vout of the regulator output terminal REGout decreases (after time t607 of FIG. 28). This decrease in the regulator output voltage Vout decreases the positive input level (feedback voltage V1) of the amplifier circuit 10, and the output node nd200 of the amplifier circuit 10 decreases to a level close to the ground voltage VG. Accordingly, while the overcurrent protective circuit 26 is performing overcurrent protection, the regulator output current Iout is limited in accordance with the current output capability of the second P-channel transistor P302 in the output stage circuit 36, of which gate voltage has become closer to the ground voltage VG.

If decrease in the regulator output current Iout from the regulator output terminal REGout decreases the heat produced by the second P-channel transistor P302 in the output stage circuit 36 in the overcurrent protection state, the temperature of the P-channel transistor P303 decreases. Then, conductance gm of the P-channel transistor P303 increases, increasing the ratio of the current Ids (P303) to current Ids (P262) (after time t608). The voltage at the connection node nd269 between the drain of the P-channel transistor P303 and the N-channel transistor N262 rises from a level close to the ground voltage VG. When the voltage at the node nd269 exceeds the threshold voltage Vth (BUF261) of the buffer BUF261, the output of the buffer BUF261 goes from low to high (at time t610). The output node nd208 of the heat monitoring/switch control circuit 261 returns to a high level again; the sum of the currents of the first P-channel transistor P301 and of the second P-channel transistor P302 becomes the regulator output current Iout from the regulator output terminal REGout; and the voltage regulator circuit returns to the normal operation state.

The regulator output current lout of the regular output terminal REGout which turns off the first P-channel transistor P301 is determined by the dimension ratio between the P-channel transistors P263 and P303, the current mirror ratio between the N-channel transistors N261 and N262, the power supply voltage VDD, the thermal resistance of the package, and so on. The regulator output current lout from the regulator output terminal REGout which turns on the first P-channel transistor P301 again is also determined by the dimension ratio between the P-channel transistors P263 and P303, the current mirror ratio between N-channel transistors N261 and N262, the power supply voltage VDD, the thermal resistance of the package, and so on. The regulator output current in the overcurrent protection state, in which the first P-channel transistor P301 is held off, is determined by the power supply voltage VDD and the current output capability of the second P-channel transistor P302 in the output stage circuit 36.

As has been described above, the voltage regulator circuit according to the sixth embodiment detects that the regulator output current Iout is too large, on the basis of conductance gm of the P-channel transistor P303, and enters the overcurrent protection state in which the regulator output current Iout is limited up to a predetermined current level, so that the voltage regulator circuit can be protected from an overload or short-circuit.

If the external load circuit returns to the normal state during the overcurrent protection state of the voltage regulator circuit, the voltage regulator circuit according to the sixth embodiment can automatically resume the stabilized voltage output. Accordingly, an instantaneous surge in the regulator output current Iout or an instantaneous drop of the regulator output voltage Vout due to disturbance may enable the overcurrent protection function, but the normal operation state, in which a stabilized voltage is output from the regulator output terminal REGout, can be automatically restored. This eliminates the need for carrying out a reset operation to bring the whole voltage regulator circuit into the power-down state and then back to the non-power-down state.

Because the current is limited according to a temperature rise in a limited area of the P-channel transistor due to excessive load current, the sixth embodiment is suitable for performing safe output short-circuit protection against large load current, when mounted in a package with a widely varying supply voltage VDD, a high thermal resistance, and a large range of operating temperature.

Modified Example of Sixth Embodiment

Figure 29:
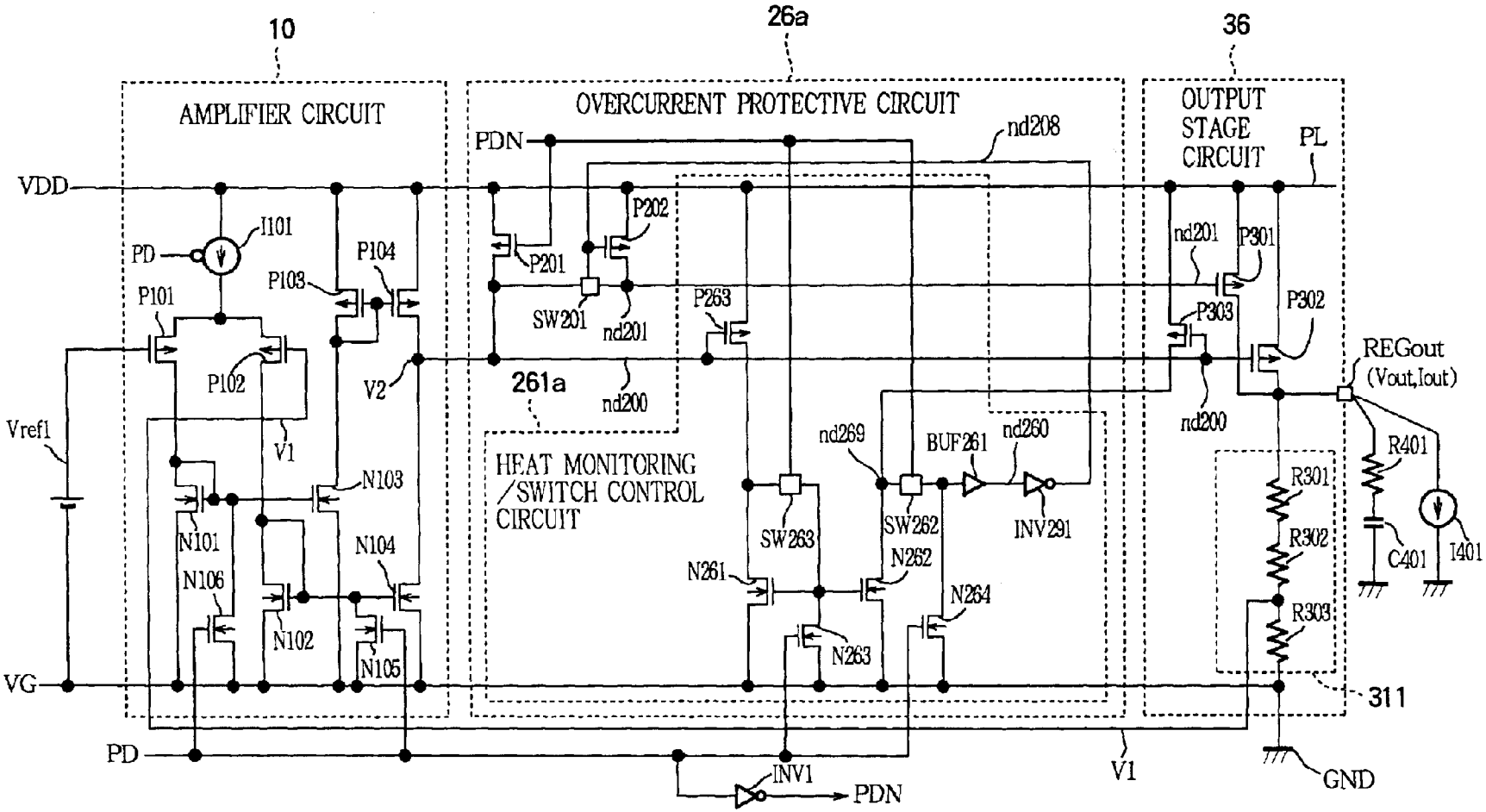
FIG. 29 is a circuit diagram showing the detailed structure of a modified example of the voltage regulator circuit according to the sixth embodiment.

FIG. 29 is a circuit diagram showing the detailed structure of a modified example of the voltage regulator circuit according to the sixth embodiment. In FIG. 29, elements that are the same as or correspond to elements in FIG. 27 are indicated by the same reference characters.

The voltage regulator circuit shown in FIG. 29 differs from the voltage regulator circuit shown in FIG. 27 in that a structure for speeding up the rise of the regulator output voltage Vout from the regulator output terminal REGout in the non-power-down state of the voltage regulator circuit is not provided. More specifically, the voltage regulator circuit shown in FIG. 29 does not have the comparator COMP1, the flip-flop circuit SNFF1, and the inverter INV2, which are seen in FIG. 27. In addition, the structure of the heat monitoring/switch control circuit 261*a* in the overcurrent protective circuit 26*a* of the voltage regulator circuit shown in FIG. 29 differs from the structure of the heat monitoring/switch control circuit 261 in the overcurrent protective circuit 26 of the voltage regulator circuit shown in FIG. 27. Moreover, the overcurrent protective circuit 26*a* shown in FIG. 29 does not have the NAND gate NA203 shown in. FIG. 27 and has an inverter INV291 instead. With the voltage regulator circuit shown in FIG. 29, the circuit structure can be simplified. Except for the above-mentioned respects, the voltage regulator circuit shown in FIG. 29 is the same as the voltage regulator circuit shown in FIG. 27.

Other Modifications

The current output elements of the output stage circuit 30 or 36 are the first P-channel transistor P301 and the second P-channel transistor P302 in the embodiments described above. However, each of the first P-channel transistor P301 and the second P-channel transistor P302 may be replaced by another circuit that has the same function as the P-channel transistor.

The switch for turning on or off the first P-channel transistor P301 in the output stage circuit 30 or 36 is configured by the MOS transfer gate switch SW201 and P-channel transistor P202 in the embodiments described above. However, other elements may be used for turning on or off the first P-channel transistor P301 in the output stage circuit 30 or 36.

The resistor circuit 311 of the output stage circuit 30 or 36 includes three resistors R301, R302, and R303 in the embodiments described above. However, the number of the resistors may not be three. The resistor circuit 311 can be a different circuit that can generate a voltage corresponding to the regulator output voltage Vout.

A single type of amplifier circuit 10 has been described in the embodiments described above. However, the amplifier circuit 10 may be replaced by a different circuit such as the amplifier circuit 11 shown in FIG. 5 (example given for the sake of comparison).

The fourth embodiment has been described as a combination of the first and second embodiments, and the fifth embodiment has been described as a combination of the first and third embodiments. In addition, the sixth embodiment may be combined with any of the first to fifth embodiments.

In the first, fourth, and fifth embodiments, a single type of structure has been indicated for the output current monitoring circuit 211, 242, or 252. However, the circuit is not limited to the above-described structure and may be replaced by another circuit having the same function.

In the second to fifth embodiments, two types of structures have been indicated for the output voltage monitoring circuit. However, the circuit is not limited to the above-described structure and may be replaced by another circuit having the same function.

In the sixth embodiment, a single type of structure has been indicated for the heat sensing element and heat monitoring circuit. However, the circuit is not limited to the above-described structure and may be replaced by another circuit having the same function.

The invention being thus described, it will be obvious that the same may be varied in many ways. Such variations are not to be regarded as a departure from the spirit and scope of the invention, and all such modifications as would be obvious to one skilled in the art are intended to be included within the scope of following claims.

What is claimed is:

1. A voltage regulator circuit comprising:

an output stage circuit connected to a power line and including a regulator output terminal, said output stage circuit operating either in a normal operation state in which a regulator output voltage stabilized in accordance with an input control voltage is supplied from said regulator output terminal to an external load circuit connected thereto or in an overcurrent protection state in which a regulator output current which is limited up to a predetermined level is supplied from said regulator output terminal to the external load circuit;

a first control circuit which generates the control voltage in accordance with the regulator output voltage and outputs the control voltage to said output stage circuit; and a second control circuit which monitors a state of said output stage circuit, wherein when said second control circuit is in the normal operation state, said second control circuit switches said output stage circuit from the normal operation state to the overcurrent protection state in accordance with a monitored state of said output stage circuit, and when said second control circuit is in the overcurrent protection state, said second control circuit switches from the overcurrent protection state to the normal operation state in accordance with a monitored state of said output stage circuit.

2. The voltage regulator circuit according to claim 1, wherein the state of said output stage circuit monitored by said second control circuit includes the regulator output current, and said second control circuit switches said output stage circuit from the normal operation state to the overcurrent protection state when the regulator output current exceeds a predetermined first current threshold level, and from the overcurrent protection state to the normal operation state when the regulator output current falls below a predetermined second current threshold level.

3. The voltage regulator circuit according to claim 1, wherein the state of said output stage circuit monitored by said second control circuit includes the regulator output voltage, and said second control circuit switches said output stage circuit from the normal operation state to the overcurrent protection state when the regulator output voltage falls below a predetermined first reference voltage, and from the overcurrent protection state to the normal operation state when the regulator output voltage exceeds a predetermined second reference voltage.

4. The voltage regulator circuit according to claim 1, wherein the state of said output stage circuit monitored by said second control circuit includes the regulator output current and the regulator output voltage, and said second control circuit switches said output stage circuit from the normal operation state to the overcurrent protection state when the regulator output current exceeds a predetermined first current threshold level or when the regulator output voltage falls below a predetermined first reference voltage, and switches said output stage circuit from the overcurrent protection state to the normal operation state when the regulator output current falls below a predetermined second current threshold level or when the regulator output voltage exceeds a predetermined second reference voltage.

5. The voltage regulator circuit according to claim 1, wherein said output stage circuit includes a heat sensing element, the state of said output stage circuit monitored by said second control circuit includes an output signal of said heat sensing element, and said second control circuit switches said output stage circuit between the normal operation state and the overcurrent protection state, in accordance with the output signal of said sensing element.

6. The voltage regulator circuit according to claim 5, wherein said heat sensing element includes a P-channel transistor which increases conductance thereof as a temperature of said P-channel transistor increases.

7. The voltage regulator circuit according to claim 1, wherein said output stage circuit includes:

a first switch circuit connected between said power line and said regulator output terminal, said first switch circuit being in an on-state during the normal operation state and in off-state during the overcurrent protection state; and a second switch circuit connected between said power line and said regulator output terminal, said second switch circuit being in an on-state bath during the normal operation state and during the overcurrent protection state.

8. The voltage regulator circuit according to claim 7, wherein said first switch circuit is controlled by said first control circuit during the normal operation state and by said second control circuit during the overcurrent protection state, and said second switch circuit is controlled by said first control circuit both during the normal operation state and during the overcurrent protection state.

9. The voltage regulator circuit according to claim 7, wherein said first switch circuit includes a first P-channel transistor, and said second switch circuit includes a second P-channel transistor.

10. The voltage regulator circuit according to claim 7, wherein said second control circuit switches the control voltage input to said first switch circuit during the overcurrent protection state, to a voltage which turns off said first switch circuit.

11. The voltage regulator circuit according to claim 10, wherein the voltage which turns off said first switch circuit is a voltage of said power line.

12. The voltage regulator circuit according to claim 1, wherein said output stage circuit includes a resistor circuit connected between said regulator output terminal and ground, said resistor circuit outputting a voltage corresponding to the regulator output voltage to said first control circuit.

13. The voltage regulator circuit according to claim 12, wherein said resistor circuit includes a plurality of resistors connected in series, and the voltage corresponding to the regulator output voltage is a voltage at a node among the plurality of resistors.

14. The voltage regulator circuit according to claim 13, wherein said first control circuit receives a certain reference voltage, and said first control circuit controls the control voltage supplied to said output stage circuit in such a way that the voltage corresponding to the regulator output voltage becomes closer to the reference voltage.

15. The voltage regulator circuit according to claim 1, further comprising a circuit which starts operation of said second control circuit after a delay from a start of operation of said output stage circuit and said first control circuit when said voltage regulator circuit in a power-down state receives a signal to clear the power-down state and to enter a non-power-down state.

16. The voltage regulator circuit according to claim 15, wherein a time after the delay from the start of operation of said output stage circuit and said first control circuit is a time at which the regulator output voltage reaches a predetermined level.

17. An integrated circuit device comprising a voltage regulator circuit, wherein said voltage regulator circuit comprises:

an output stage circuit connected to a power line and including a regulator output terminal said output stage circuit operating either in a normal operation state in which a regulator output voltage stabilized in accordance with an input control voltage is supplied from said regulator output terminal to an external load circuit connected thereto or in an overcurrent protection state in which a regulator output current which is limited up to a predetermined level is supplied from said regulator output terminal to the external load circuit;

a first control circuit which generates the control voltage in accordance with the regulator output voltage and outputs the control voltage to said output stage circuit; and a second control circuit which monitors a state of said output stage circuit, wherein when said second control circuit is in the normal operation state, said second control circuit switches said output stage circuit from the normal operation state to the overcurrent protection state in accordance with a monitored state of said output stage circuit, and when said second control circuit is in the overcurrent protection state, said second control circuit switches from the overcurrent protection state to the normal operation state in accordance with a monitored state of said output stage circuit.

* * * * *